US012599196B2

(12) United States Patent
Orand et al.

(10) Patent No.: US 12,599,196 B2
(45) Date of Patent: Apr. 14, 2026

(54) DEVICE FOR AN ARTICLE OF FOOTWEAR INCLUDING A FRAME WITH A FOOTWEAR PLATE

(71) Applicant: NIKE, Inc., Beaverton, OR (US)

(72) Inventors: Austin J. Orand, Portland, OR (US); Jan Raken, Seattle, WA (US); Aaron K. Seid, Portland, OR (US); Richard Kristian Hansen, Vancouver, WA (US); Kimberly A. Sokol, Vancouver, WA (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/801,917

(22) Filed: Aug. 13, 2024

(65) Prior Publication Data

US 2025/0072560 A1 Mar. 6, 2025

Related U.S. Application Data

(60) Provisional application No. 63/535,883, filed on Aug. 31, 2023.

(51) Int. Cl.

| | |
|---|---|
| ***A43B 13/42*** | (2006.01) |
| ***A43B 7/14*** | (2022.01) |
| ***A43B 7/144*** | (2022.01) |
| ***A43B 13/02*** | (2022.01) |
| ***A43B 13/18*** | (2006.01) |

(52) U.S. Cl.

CPC ..... *A43B 13/42* (2013.01); *A43B 7/144* (2013.01); *A43B 7/1495* (2013.01); *A43B 13/02* (2013.01); *A43B 13/181* (2013.01)

(58) Field of Classification Search

None

See application file for complete search history.

(56) References Cited

U.S. PATENT DOCUMENTS

| | | | | | |
|---|---|---|---|---|---|
| 474,574 | A | | 5/1892 | Bruzon | |
| 1,058,561 | A | * | 4/1913 | Davis | A43B 7/1495 36/170 |
| 1,081,678 | A | | 12/1913 | Langerak | |
| 1,812,622 | A | | 6/1931 | Costello | |
| 2,149,664 | A | * | 3/1939 | Brown | A43B 7/1495 36/170 |
| 3,555,706 | A | * | 1/1971 | Edmonds | A43B 5/00 36/102 |
| 4,476,639 | A | * | 10/1984 | Zaccaria | A43C 7/02 36/114 |
| 4,550,511 | A | * | 11/1985 | Gamm | A43C 11/1493 36/91 |

(Continued)

FOREIGN PATENT DOCUMENTS

| | | | |
|---|---|---|---|
| AT | 14419 | U2 | 11/2015 |
| AU | 439212 | B2 | 8/1973 |

(Continued)

*Primary Examiner* — Jila M Mohandesi

(74) *Attorney, Agent, or Firm* — Banner & Witcoff, Ltd.

(57) ABSTRACT

A device for an article of footwear includes a frame that has a footwear plate and an arced shield. The footwear plate is configured to extend at least partially along and under a sole of a wearer's foot. The arced shield is integral with the footwear plate and configured to extend transversely from the footwear plate at least partially over a superior portion of the wearer's foot.

18 Claims, 36 Drawing Sheets

(56) References Cited

U.S. PATENT DOCUMENTS

| | | | | |
|---|---|---|---|---|
| 4,860,464 | A * | 8/1989 | Misevich | A43B 7/1495 36/114 |
| 5,481,814 | A | 1/1996 | Spencer | |
| 5,704,138 | A * | 1/1998 | Donnadieu | A43B 5/002 36/50.1 |
| 5,724,265 | A | 3/1998 | Hutchings | |
| 5,896,608 | A * | 4/1999 | Whatley | A43B 13/28 36/12 |
| 5,955,667 | A | 9/1999 | Fyfe | |
| 6,018,705 | A | 1/2000 | Gauidet et al. | |
| 6,052,654 | A | 4/2000 | Gaudet et al. | |
| 6,092,305 | A | 7/2000 | Troy et al. | |
| 6,430,843 | B1 | 8/2002 | Potter et al. | |
| 6,876,947 | B1 | 4/2005 | Darley et al. | |
| 6,882,955 | B1 | 4/2005 | Ohlenbusch et al. | |
| 6,978,684 | B2 | 12/2005 | Nurse | |
| 7,685,747 | B1 | 3/2010 | Gasparovic et al. | |
| 7,793,438 | B1 | 9/2010 | Busse et al. | |
| 8,549,774 | B2 | 10/2013 | Meschter et al. | |
| 8,763,275 | B2 | 7/2014 | Shalom et al. | |
| 8,769,845 | B2 | 7/2014 | Lin | |
| 8,991,071 | B2 | 3/2015 | Bathum et al. | |
| 9,089,184 | B1 | 7/2015 | Kiser et al. | |
| 9,788,596 | B2 | 10/2017 | Schenone | |
| 9,908,027 | B2 | 3/2018 | Beers | |
| 10,045,588 | B2 | 8/2018 | Berend et al. | |
| 10,055,948 | B2 | 8/2018 | Kim | |
| 10,137,011 | B2 | 11/2018 | Herr | |
| 10,426,637 | B2 | 10/2019 | Tong et al. | |
| 10,568,381 | B2 | 2/2020 | Walker | |
| 10,758,001 | B2 | 9/2020 | Case et al. | |
| 10,918,160 | B2 * | 2/2021 | Hopkins | A43C 1/00 |
| 11,185,125 | B2 | 11/2021 | Blanche et al. | |
| 11,308,184 | B2 | 4/2022 | Andon et al. | |
| 11,475,449 | B2 | 10/2022 | Andon et al. | |
| 11,513,610 | B2 | 11/2022 | Goel et al. | |
| 11,553,754 | B2 | 1/2023 | Andon et al. | |
| 11,666,115 | B2 * | 6/2023 | Blanche | A43B 23/088 36/102 |
| 12,059,052 | B2 | 8/2024 | Dean et al. | |
| 2002/0007568 | A1 | 1/2002 | Kellerman et al. | |
| 2003/0009913 | A1 | 1/2003 | Potter et al. | |
| 2004/0177531 | A1 | 9/2004 | DiBenedetto et al. | |
| 2004/0237351 | A1 | 12/2004 | Howell | |
| 2006/0064902 | A1 * | 3/2006 | Ashton | A43B 23/24 36/94 |
| 2008/0263896 | A1 | 10/2008 | Karandonis et al. | |
| 2010/0063778 | A1 | 3/2010 | Schrock et al. | |
| 2010/0063779 | A1 | 3/2010 | Schrock et al. | |
| 2010/0251572 | A1 | 10/2010 | Baudouin et al. | |
| 2013/0213147 | A1 | 8/2013 | Rice et al. | |
| 2014/0259771 | A1 | 9/2014 | Dananberg et al. | |
| 2014/0310992 | A1 | 10/2014 | Shalom et al. | |
| 2015/0020416 | A1 | 1/2015 | Wiens | |
| 2015/0265425 | A1 | 9/2015 | Aagaah et al. | |
| 2016/0051012 | A1 | 2/2016 | Avar et al. | |
| 2018/0153254 | A1 | 6/2018 | Fusco et al. | |
| 2018/0153264 | A1 | 6/2018 | Amos et al. | |
| 2018/0360147 | A1 | 12/2018 | Fiedler et al. | |
| 2019/0110527 | A1 | 4/2019 | Ghasletwala | |
| 2019/0365014 | A1 | 12/2019 | Andon | |
| 2020/0368579 | A1 | 11/2020 | Cusey et al. | |
| 2020/0375269 | A1 | 12/2020 | Andon et al. | |
| 2021/0197021 | A1 | 7/2021 | Giedwoyn et al. | |
| 2021/0368925 | A1 | 12/2021 | Schneider | |
| 2021/0369537 | A1 | 12/2021 | Witte et al. | |
| 2021/0378903 | A1 | 12/2021 | Mooney et al. | |
| 2022/0193490 | A1 | 6/2022 | Ghiotto et al. | |
| 2022/0202104 | A1 | 6/2022 | Walker et al. | |
| 2022/0202121 | A1 | 6/2022 | Walker et al. | |
| 2022/0218551 | A1 | 7/2022 | Ding et al. | |
| 2022/0241131 | A1 | 8/2022 | Papania-Davis et al. | |
| 2022/0362094 | A1 | 11/2022 | De Rossi et al. | |
| 2023/0124653 | A1 | 4/2023 | Farina et al. | |
| 2023/0138485 | A1 | 5/2023 | Ryabinin et al. | |
| 2023/0342767 | A1 | 10/2023 | Andon et al. | |
| 2023/0389649 | A1 | 12/2023 | Poëll | |
| 2024/0090605 | A1 | 3/2024 | Yip et al. | |

FOREIGN PATENT DOCUMENTS

| | | | |
|---|---|---|---|
| CN | 1984577 | A | 6/2007 |
| CN | 110522600 | A | 12/2019 |
| CN | 109846672 | B | 8/2021 |
| DE | 570650 | C | 2/1933 |
| DE | 102009023689 | A1 | 12/2010 |
| DE | 202016001813 | U1 | 6/2017 |
| FR | 3104004 | A1 | 6/2021 |
| JP | 2021141999 | A | 9/2021 |
| KR | 20100106527 | A | 10/2010 |
| KR | 101845063 | B1 | 4/2018 |
| WO | 2007080205 | A1 | 7/2007 |
| WO | 2014033396 | A1 | 3/2014 |
| WO | 2014109799 | A1 | 7/2014 |
| WO | 2021076440 | A1 | 4/2021 |

* cited by examiner

DEVICE FOR AN ARTICLE OF FOOTWEAR INCLUDING A FRAME WITH A FOOTWEAR PLATE

CROSS-REFERENCE TO RELATED APPLICATIONS

This application claims the benefit of priority to U.S. Provisional Application No. 63/535,883, filed Aug. 31, 2023, which is hereby incorporated by reference in its entirety.

TECHNICAL FIELD

The present disclosure generally relates to a device for an article of footwear including a frame with a footwear plate.

BACKGROUND

Footwear typically includes a sole structure configured to be located under a wearer's foot to space the foot away from the ground. Sole structures may typically be configured to provide one or more of cushioning, motion control, and resiliency.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
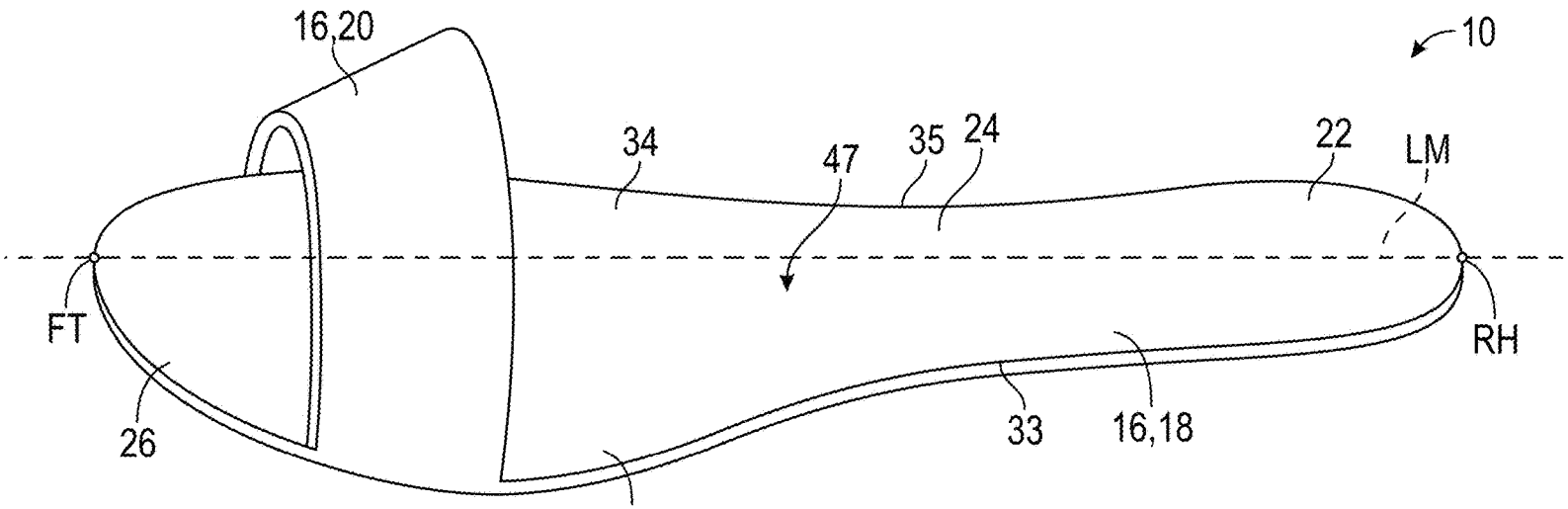
FIG. 1 is a medial perspective view of a device for an article of footwear including a frame with a footwear plate and an arced shield.

The present disclosure generally relates to a device for an article of footwear including a frame and a footwear plate configured to extend at least partially along a sole portion of a wearer's foot. In some embodiments, the frame includes an arced shield extending from the frame and configured to extend over a superior portion of a wearer's foot. Various embodiments of the frame help to support and shield the foot, and may include features that assist with movement, such as joint connectors that receive externally applied forces.

In one or more embodiments, a device for an article of footwear may include a frame that has a footwear plate and an arced shield. The footwear plate may be configured to extend at least partially along and under a sole of a wearer's foot. The arced shield may be integral with the footwear plate and configured to extend transversely from the footwear plate at least partially over a superior portion of the wearer's foot. Because the frame is configured to extend both over a superior portion of the wearer's foot and under the sole of the wearer's foot, partially enveloping the foot, the frame may function to guide movement of the foot. For example, a force applied to the frame is distributed to both the top and bottom of the foot. Additionally, the arced shield may function to protect the superior portion of the foot when incorporated in an article of footwear and worn during activities in which forces may be directed toward the superior portion such as during athletic activities. In some implementations, the frame may receive externally applied forces to assist the wearer during walking or running, such as to cause rotation of the foot about the ankle, assisting the foot with plantar flexion and reducing the amount of effort required of the wearer compared to performing the same activities without application of such externally applied forces.

In one or more implementations, the arced shield and the footwear plate may be a unitary, one-piece structure. As such, any forces applied to the footwear plate are efficiently distributed by the footwear plate. Additionally, the footwear plate may be relatively rigid and, in some implementations, may be more rigid than other components of a sole structure of the article of footwear. For example, the frame may include a carbon fiber composite material. The frame may have a compressive rigidity of a predetermined numerical value or within a predetermined range of numerical values. The frame may be sufficiently rigid to prevent flexing of the arced shield relative to the footwear plate upon receiving a force not greater than a predetermined force on the arced shield. As a result, when a wearer's foot rolls forward in a heel-to-toe direction and plantar flexes through a toe-off position, the footwear plate is sufficiently stiff to maintain forward momentum. Additionally, a frame with a relatively stiff plate efficiently converts the applied force to rotation of the frame about the wearer's ankle, for example. The frame establishes a rigidity regardless of the article of footwear in which it is incorporated. For example, when incorporated into an article of footwear, it will increase the rigidity of the sole structure of an otherwise relatively flexible sole structure, establishing at least a baseline rigidity sufficient to convey expected forces applied to the device.

In one or more embodiments, a joint connector may be operatively connected to and/or secured at a superior surface of the arced shield. For example the joint connector may be directly secured to the superior surface, or may be indirectly secured to the superior surface, such as by securement to a footwear upper. In either instance, the joint connector is considered operatively connected to the arced shield and, more particularly, to the superior surface of the arced shield.

In an example, the arced shield may be configured to extend along an interior surface of a vamp of a footwear upper, and the joint connector may include a textile secured at an exterior surface of the vamp of the footwear upper. In an implementation, the textile may be configured to be pivotable relative to the exterior surface of the footwear upper at least about two perpendicular axes. The two perpendicular axes may include, for example, a transverse axis and a longitudinal axis. In a particular example, the textile may be secured only at one end to the footwear upper, enabling the textile to function as a portion of a ball joint with respect to movement relative to the footwear upper. In one or more embodiments, the joint connector may include a magnet or magnetic material operatively secured to the textile.

In another example, the joint connector may be directly secured to the arced shield. In an implementation, the joint connector is directly secured to the arced shield. Such a joint connector may also be configured to function as a portion of a ball joint. For example, the joint connector may have a base the defines a cavity that may be generally spherical or otherwise configured to receive an additional portion of the ball joint, such as a link with a ball connected thereto. Configuring the joint connector to function as a portion of a ball joint enables flexibility in the forefoot region to be maintained. Accordingly, any external force applied to assist movement via the ball joint should not limit natural movement of the wearer's foot.

In one or more embodiments, the arced shield may extend over a forefoot portion of the footwear plate. In some implementations, the arced shield may instead or in addition extend over the midfoot portion and/or the heel portion of the footwear plate.

The footwear plate itself may also be configured to have various lengths and positions within an article of footwear. For example, the footwear plate may be configured to extend only in a forefoot region of the article of footwear, or may be configured to extend only in a forefoot region and a midfoot region of the article of footwear, or may be configured to extend only in a midfoot region and a heel region of the article of footwear, or may be configured to extend in a forefoot region, a midfoot region, and a heel region of the article of footwear.

In one or more embodiments, the arced shield may extend transversely over the footwear plate from a lateral portion of the footwear plate to a medial portion of the footwear plate. For example, the arced shield may connect to the footwear plate at a lateral edge of the footwear plate or between the lateral edge and a longitudinal midline of the footwear plate. The arced shield may also connect to the footwear plate at a medial edge of the footwear plate or between the medial edge and the longitudinal midline of the footwear plate. The arced shield is thus connected both to the medial portion and to the lateral portion of the footwear plate. Such a connection may be selective (e.g., the arced shield may be selectively attachable and detachable from the footwear plate). Alternatively, the connection may be permanent, such as when the arced shield and the footwear plate are a contiguous, one-piece component.

The arced shield may be shaped to generally follow the contour of the surface of the superior portion of a typical wearer's foot and/or a footwear upper of an article of footwear in which the device is incorporated. For example, the arced shield may have an anterior edge and a posterior edge, and the anterior edge may be nearer to a superior surface of the footwear plate than is the posterior edge such that a superior surface of the arced shield has a downward and forward pitch from the posterior edge to the anterior edge. This is similar to a typical downward slope of the superior portion of a wearer's foot forward of the ankle and/or a vamp portion of a footwear upper of an article of footwear in which the device is incorporated. By generally enveloping the foot in this relatively close manner, the frame is more easily incorporated into an article of footwear without excessively increasing the overall dimensions of the article of footwear.

In one or more implementations, the frame may be configured to receive an external force to augment plantar flexion of the wearer's foot. In an example, the joint connector may be positioned anterior to an ankle opening of the article of footwear. For example, the joint connector or other attachment features discussed herein may be configured to receive and direct an external force on the frame, such as on the arced shield, to cause rotation about the ankle, reducing the effort input by the wearer for plantar flexion. This energy assistance may enable the wearer to remain active for longer periods of time and/or to move further distances. In an example, the frame is configured for operative connection to an exoskeleton, with the exoskeleton providing the external force that assists with plantar flexion. The joint connector may be positioned at a portion of the arced shield that is over the superior portion of the wearer's foot.

A sole structure may include any implementation of the frame discussed herein. For example, a sole structure for an article of footwear may include a frame according to any examples discussed herein, such as a frame that has a footwear plate configured to extend at least partially along and under a sole of a wearer's foot, and that has an arced shield integral with the footwear plate and configured to extend transversely from the footwear plate at least partially over a superior portion of the wearer's foot. In some examples, the sole structure may further include a midsole layer, and the footwear plate may extend at least partially over the midsole layer. In an example, the footwear plate may be between a foam midsole layer and an insole, for example, or may be between an underlying midsole layer and an overlying midsole layer.

An article of footwear may include any implementation of the frames and any implementation of the sole structures discussed herein. For example, the article of footwear may include a frame that has a footwear plate configured to extend at least partially along and under a sole of a wearer's foot, and that has an arced shield integral with the footwear plate and configured to extend transversely from the footwear plate at least partially over a superior portion of the wearer's foot.

In some implementations, the article of footwear may include a footwear upper, and the arced shield may extend along an interior surface of a vamp of a footwear upper. In such an example, the article of footwear may also include a joint connector operatively connected to and/or secured at an exterior surface of the vamp of the footwear upper. For example, the joint connector may comprise a textile secured at an exterior surface of the vamp of the footwear upper as discussed herein.

In other implementations, the arced shield may extend outward of an exterior surface of the footwear upper, such as by extending from inside of the foot-receiving cavity of the footwear upper through the footwear upper at or near one or both of the medial and lateral sides of the footwear upper, and extending over the exterior surface of the footwear upper between the locations from which it extends through the footwear upper. In other implementations, the arced shield may be entirely exterior to the footwear upper, such as in an embodiment in which arced shield is continuously connected to or is selectively attachable to the footwear plate at the sole structure, such as below a lower extent of the footwear upper at the medial and/or lateral sides of the article of footwear. The joint connector may be directly secured to the arced shield in such embodiments.

The position of the arced shield relative to the footwear plate may be configured to promote relatively easy foot insertion (e.g., positioning of the sole of the wearer's foot over the footwear plate with the arced shield over a superior portion of the wearer's foot. For example, a device for an article of footwear may include a frame. The frame may have a footwear plate configured to extend at least partially along and under a sole of a wearer's foot, and the frame may also have an arced shield integral with the footwear plate and configured to extend transversely from the footwear plate at least partially over a superior portion of the wearer's foot from a medial portion of the footwear plate to a lateral portion of the footwear plate.

An anterior extent of the arced shield at the medial portion of the footwear plate may be further forward or further rearward than an anterior extent of the arced shield at the lateral portion of the footwear plate such that an anterior edge of the arced shield angles rearward or forward, respectively, from the medial portion of the footwear plate to the lateral portion of the footwear plate.

Additionally, or alternatively, a posterior edge of the arced shield may angle rearward or forward, respectively, from the medial portion of the footwear plate to the lateral portion of the footwear plate. Inserting the foot into the frame leading with the forefoot region of the foot from rearward of the posterior edge of the arced shield may be easier if foot entry is not only from rearward of the posterior edge, but also moving transversely inward toward the longitudinal midline from the side opposite the side from which the posterior edge angles forward (e.g., moving forward and transversely inward from the lateral side if the posterior edge angles forward from the medial portion to the lateral portion, and moving forward and transversely inward from the medial side if the posterior edge angles forward from the lateral portion to the medial portion).

In an example in which the anterior extent of the arced shield angles forward from one of the medial portion and the lateral portion to the other of the medial portion and the lateral portion, the anterior extent of the arced shield at the medial portion of the footwear plate may be at one of a forefoot portion or a midfoot portion of the footwear plate and the anterior extent of the arced shield at the lateral portion of the footwear plate may be at the other one of the forefoot portion or the midfoot portion of the footwear plate. In such an embodiment, the arced shield should span over the instep of the wearer's foot. An external force applied to the arced shield, such as at any of the joint connectors described herein, should result in forward rotation of the forefoot portion about the ankle (e.g., plantar flexion).

In one or more examples, a device for an article of footwear may have an arced shield that extends only partway across the superior portion of the wearer's foot. For example, in one or more embodiments, the device for an article of footwear may include a frame having a footwear plate configured to extend at least partially along and under a sole of a wearer's foot, and an arced shield integral with the footwear plate and configured to extend transversely from the footwear plate at least partially over a superior portion of the wearer's foot from one of a medial portion or a lateral portion of the footwear plate to a terminal end disposed above a superior surface of the footwear plate. When provided in an article of footwear, the arced shield may extend partially over an exterior surface of a vamp of a footwear upper or may be internal to the footwear upper. Any of the joint connectors described herein may be operatively connected to and/or secured at a superior surface of the arced shield.

By having a terminal end disposed above a superior surface of the footwear plate, the arced shield may serve its function of protecting the foot, distributing applied forces, etc., while minimizing added weight and, potentially, enabling casier foot insertion from the side of the footwear opposite that from which the arced shield extends.

In an implementation, the arced shield extends from a medial side and/or a medial edge of the footwear plate and does not extend to a lateral side and/or a lateral edge of the footwear plate. In an alternative implementation, the arced shield extends from a lateral side and/or a lateral edge of the footwear plate and does not extend to a medial side and/or a medial edge of the footwear plate.

In one or more examples, a device for an article of footwear may have two arced shields. For example, the device may include a frame that has a footwear plate configured to extend at least partially along and under the sole of a wearer's foot. A first arced shield may be integral with the footwear plate and configured to extend transversely from the footwear plate at least partially over a superior portion of the wearer's foot. A second arced shield may be integral with the footwear plate and configured to extend transversely from the footwear plate at least partially over the superior portion of the wearer's foot.

In one or more implementations, the first arced shield may be disposed at least partially over a forefoot portion of the footwear plate forward of the second arced shield. In the same embodiment or in a different embodiment, the second arced shield may be disposed at least partially over a midfoot portion of the footwear plate.

Providing two arced shields may help to distribute point loads while at the same time increasing the flexibility of the device in comparison to a device with a single arced shield extending the same fore/aft length as the two arced shields. By at least partially separating the two arced shields, the gap between them decreases the resistance to bending of the device about a transverse axis aligned with the arced shields, such as at the wearer's metatarsal-phalangeal joint. Additionally, in some implementations, providing two arced shields may help to distribute forces acting on either of the arced shields to lessen the potential of point loads transferred to the wearer's foot.

In an aspect, a first joint connector may be operatively connected to and/or secured at a superior surface of the first arced shield, and a second joint connector may be operatively connected to and/or secured at a superior surface of the second arced shield. The first and second joint connectors may be configured as any of the joint connectors disclosed herein.

Providing two joint connectors allows for the option of providing different mechanical advantages when applying an external force to the device. For example, the second arced shield and joint connector thereon which are further rearward than the first arced shield and joint connector thereon will provide a shorter lever relative to the wearer's ankle joint in comparison to the first joint connector. The greater mechanical advantage of applying external force to the first arced shield via the first (forwardmost) joint connector may be more suitable for certain activities, whereas the lesser mechanical advantage of applying external force to the second arced shield via the second (rearmost) joint connector may be more suitable for other activities.

In another aspect, the frame may further include a bridge integrally connecting the first arced shield and the second arced shield. The device may include a joint connector operatively connected to and/or secured at a superior surface of the bridge. In such an example, at least some of the increased flexibility of providing two arced shields as opposed to one larger arced shield may be realized, and the distribution of any external force applied at the joint connector is afforded at least in part via the bridge.

In one or more examples, the footwear plate used in the device may be optimized for lessening added weight while increasing plate strength. For example, a device for an article of footwear may include a frame having a footwear plate configured to extend at least partially along and under a sole of a wearer's foot. The footwear plate may include a matrix structure defining a plurality of open cells. A joint connector, such as any of the joint connectors disclosed herein, may be operatively connected to and/or secured at the frame.

A matrix structure may be configured according to a computerized design to achieve a particular stiffness profile across the sole. A design of the cell size, shape, and the footwear plate thickness and height may be used to affect the stiffness profile. In one or more implementations, at least some of the cells may be polygonal. For example, at least some of the cells may be hexagonal.

A matrix structure with a plurality of open cells may be of a lesser weight and a greater strength in comparison to a solid structure plate (e.g., without open cells) of a similar thickness. A matrix structure allows for the possibility of using different, lighter weight materials that result in the footwear plate having the same or greater strength than a solid footwear plate without open cells.

In some implementations of the device having the frame with a matrix structure, the frame may include an arced shield integral with the footwear plate and configured to extend from the footwear plate at least partially over a superior portion of the wearer's foot.

In some implementations of the device having the frame with a matrix structure, a height of the footwear plate, a thickness of the footwear plate between adjacent ones of the open cells, and/or a shape of the open cells May be configured to provide a predetermined stiffness profile of the footwear plate.

In an implementation of the footwear plate having a matrix structure used in an article of footwear configured for sprinting, for example, the footwear plate may be a full-length plate (e.g., may have a forefoot portion, a midfoot portion, and a heel portion) as sprinting is accomplished mainly using the forefoot region of the foot and flexing of the sole structure may be less during sprinting in comparison to distance running. In an article of footwear configured for distance running, the wearer often has a heel impact and a heel to toe transition is made with each stride. The footwear plate in such an embodiment may thus be shorter than in an article of footwear used for sprinting, perhaps having only a forefoot portion, or only a forefoot portion and a midfoot portion, or having a forefoot portion, a midfoot portion, and a heel portion, but a narrow heel portion or a heel portion with an aperture to allow for engagement with resilient foam portions of a midsole, for example.

In some examples of the device, the arced shield may be selectively attachable and detachable from the footwear plate. For example, a device for an article of footwear may include a frame having a footwear plate configured to extend at least partially along and under a sole of a wearer's foot. The device may include an arced shield selectively attachable to and detachable from the footwear plate and configured to extend transversely from the footwear plate at least partially over a superior portion of the wearer's foot from a medial portion of the footwear plate to a lateral portion of the footwear plate when attached to the footwear plate. By configuring the arced shield to be selectively detachable, the arced shield can be detached when desired, such as when planned activities of the wearer do not necessitate the presence of the arced shield. For example, if any of the joint connectors described herein are operatively connected to and/or secured at the frame, such as operatively connected to and/or secured at a superior surface of the arced shield, and the planned activity of the wearer does not include use of the joint connector, then detaching the arced shield results in less overall weight of the article of footwear. Additionally, selective attachment and detachment of the arced shield allows for the possibility of using different arced shields for different activities. For example, a first arced shield with a first joint connector may be attached to the footwear plate for one or more activities, and a second arced shield with another joint connector configured for connection with a different component, for example, may be attached to the footwear plate for different activities.

The arced shield may be any of the configurations described herein, such as a configuration in which the arced shield extends to both the medial and lateral portions of the footwear plate, or a configuration in which the arced shield is configured to extend over an exterior surface of a vamp of a footwear upper when attached to the footwear plate.

In an implementation, the selective attachment of the arced shield and the footwear plate is achieved via a tab and slot connection. One of the footwear plate and the arced shield includes a slot and the other of the footwear plate and the arced shield includes a tab configured to be received in the slot to attach the arced shield to the footwear plate. In an implementation in which a downward force is applied to the arced shield, the force would work with, instead of against, the connection of the arced shield and the footwear plate at the tab and slot. Other attachment features may be used to establish the selective attachment and detachment, such as the use of openings in the arced shield and footwear plate that may be aligned to receive a fastener to hold the arced shield to the footwear plate, or a hook-and-loop-type connection, etc.

In an example, a sole structure for an article of footwear includes a frame having a footwear plate configured to extend at least partially along and under a sole of a wearer's foot, a joint connector operatively connected to and/or secured at the frame, and a midsole. The midsole may include a front midsole component and a rear midsole component pivotable relative to one another between a use position and an access position at a pivot axis extending transversely across a midfoot region of the sole structure, with the sole structure lifted at the pivot axis in the access position. The footwear plate may extend at least partially along the front midsole component. For example, in one or more implementations, the footwear plate may extend only in a forefoot region of the sole structure and/or only forward of the pivot axis. In some other implementations, the front midsole component may include a heel footbed that overlays the rear midsole component in the use position and is spaced apart from the rear midsole component in the access position. In such implementations, the footwear plate may further extend along the heel footbed rearward of the pivot axis. Because the heel footbed moves with the front midsole component, configuring the footwear plate to extend rearward of the pivot axis over the rear midsole component will not interfere with pivoting at the pivot axis.

In some examples, the frame may be used in a sole structure of an article of footwear that is configured for magnetic connection to another component. For example, the sole structure may include a frame that has a footwear plate configured to extend at least partially along and under a sole of a wearer's foot, and a joint connector operatively connected to and/or secured at the frame, and a midsole. The footwear plate may extend at least partially along the midsole. The midsole may define a recess at a surface of the midsole, and a magnet or magnetic material housed in the recess. For example, the recess may be at an exterior surface of the midsole, such as the side wall of the midsole. The side wall may be an exterior side wall.

In one or more implementations, the recess may have a partially cylindrical shape. For example, the recess may be a portion of a cylindrical shape with an opening at the surface of the midsole. The magnet or magnetic material may be position adjacent the inner surface of the recess, leaving a portion of the cylindrical recess open for receiving a magnetic connector through the opening in the side surface, such as another magnet or magnetic material configured to attract the magnet or magnetic material housed in the recess.

For example, the sole structure may include a strap and another magnet or magnetic material secured to the strap and configured to attract the magnet or magnetic material housed in the recess. The magnet or magnetic material secured to the strap may be shaped to be received in the recess. Accordingly, when the magnet or magnetic material secured to the strap is received in the recess, the magnetic connection between the magnet or magnetic material housed in the recess and the magnet or magnetic material secured to the strap operatively connects the strap to the midsole. Forces may be applied to the strap to move the midsole. For example, if the recess is in a heel region of the midsole, an upward force applied to the strap will cause the footwear plate to apply an upward force to the wearer's sole rearward of the ankle joint. This force may counteract any tendency of the heel portion to move away from the wearer's sole when an upward force is applied forward of the ankle, such as at a joint connector.

In an aspect, both the medial and lateral sides of the midsole may be configured for magnetic connection to another component. For example, the recess may be a first recess, the surface of the midsole may include a medial side surface, and the magnet or magnetic material may be a first magnet or a first magnetic material, the surface of the midsole may also include a lateral side surface and may define a second recess at least partially at the lateral side surface, and the sole structure may include a second magnet or second magnetic material housed in the second recess.

In one or more embodiments, the midsole may include a front midsole component and a rear midsole component pivotable relative to one another between a use position and an access position at a pivot axis extending transversely across a midfoot region of the sole structure, with the sole structure lifted at the pivot axis in the access position. Such a midsole may be referred to as a jointed midsole. In an example, the footwear plate may be configured to extend only forward of the pivot axis, such as a footwear plate having only a forefoot portion or having only a forefoot portion and a midfoot portion. In another example, the front midsole component may include a heel footbed that overlays the rear midsole component in the use position and is spaced apart from the rear midsole component in the access position. The surface of the midsole at which the midsole defines the recess may be a surface of the heel footbed. In such an example, the heel footbed may have a forefoot portion, a midfoot portion, and a heel portion and may extend in each of the forefoot, midfoot, and heel regions of the article of footwear. The recess may be, for example, at a side surface of the heel footbed in the heel portion of the heel footbed. If the sole structure includes a strap and another magnet or magnetic material secured to the strap and configured to attract the magnet or magnetic material housed in the recess, the strap may be disposed at least partially between the heel footbed and an inner side of the footwear upper when the sole structure is in the use position. This helps further secure the strap, and helps further secure the magnet or magnetic material secured to the strap in the recess when the sole structure is in the use position.

In one or more embodiments, a sole structure for an article of footwear includes a frame having a footwear plate configured to extend at least partially along a sole of a wearer's foot, a joint connector operatively connected to and/or secured at the frame, and a midsole including a front midsole component and a rear midsole component pivotable relative to one another between a use position and an access position at a pivot axis extending transversely across a midfoot region of the sole structure, with the sole structure lifted at the pivot axis in the access position. The footwear plate may extend at least partially along the front midsole component. The front midsole component may include a heel footbed that overlays the rear midsole component in the use position and is spaced apart from the rear midsole component in the access position. A surface of the heel footbed may define a recess, and a magnet or magnetic material may be housed in the recess.

As discussed herein, the recess may be a first recess, the surface of the heel footbed defining the recess may include a medial side surface, and the magnet or magnetic material may be a first magnet or a first magnet material. The surface of the heel footbed may include a lateral side surface that defines a second recess, and the sole structure may further include a second magnet or second magnetic material housed in the second recess. As discussed herein, the recess may have a partially cylindrical shape in some implementations. As further discussed herein, a strap is included, the strap having another magnet or magnetic material secured to the strap and configured to attract the magnet or magnetic material housed in the recess and shaped to be received in the recess.

The above features and advantages and other features and advantages of the present teachings are readily apparent from the following detailed description of the modes for carrying out the present teachings when taken in connection with the accompanying drawings. It should be understood that even though in the following the embodiments may be separately described, single features thereof may be combined in additional embodiments.

Figure 2:
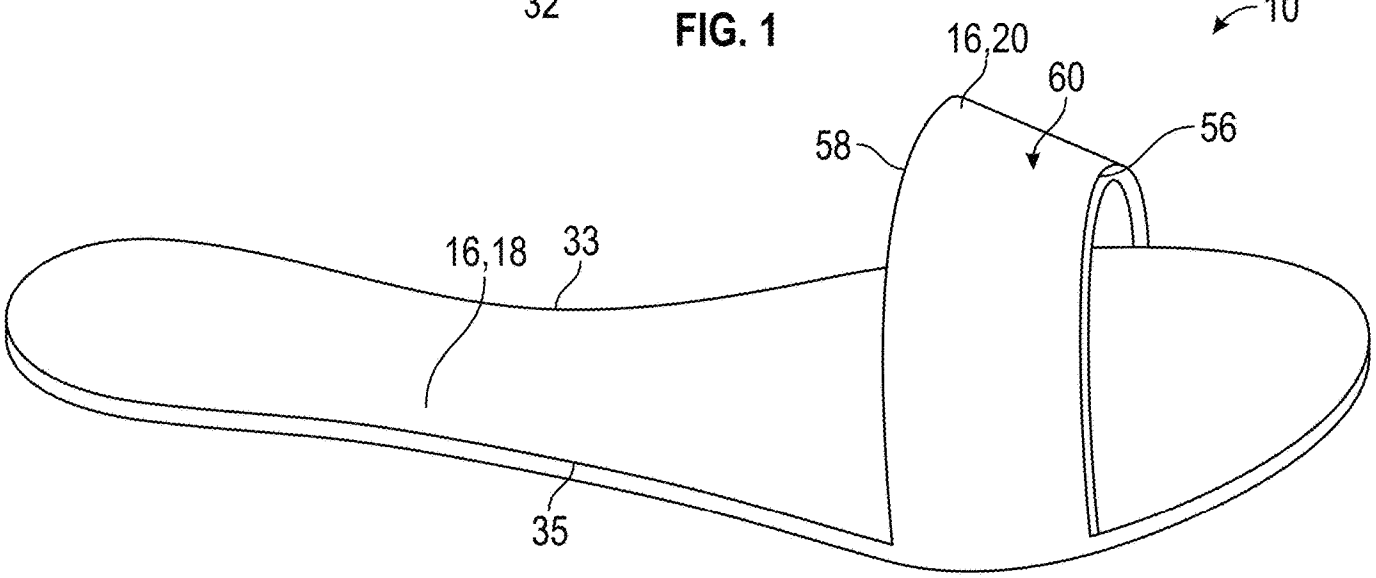
FIG. 2 is a lateral perspective view of the device of FIG. 1.
Figure 5:
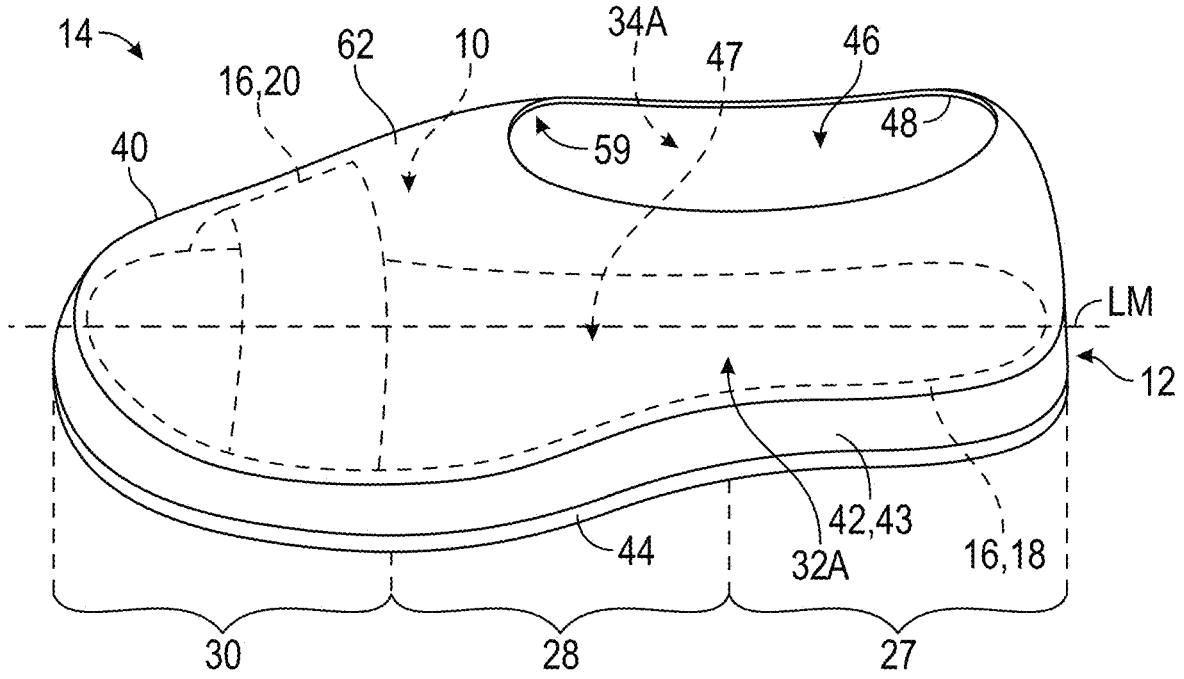
FIG. 5 is a medial perspective view of an article of footwear including a footwear upper and a sole structure with the device of FIG. 1 disposed with the arced shield extending along an interior surface of the vamp of the footwear upper.

Referring to the drawings, wherein like reference numbers refer to like components throughout the views, FIG. 1 is a medial perspective view and FIG. 2 is a lateral perspective view of a device 10 that may be used in a sole structure of an article of footwear, such as the sole structure 12 and article of footwear 14 of FIG. 5.

As shown in FIG. 1, the device 10 includes a frame 16. The frame 16 has a footwear plate 18 and an arced shield 20, as further discussed herein. The footwear plate 18 has a heel portion 22, a midfoot portion 24, and a forefoot portion 26. The heel portion 22, midfoot portion 24, and forefoot portion 26 of the footwear plate 18 correspond with a heel region 27, midfoot region 28, and forefoot region 30, respectively, of the sole structure 12 and the article of footwear 14.

The heel portion 22 of the footwear plate 18 and the heel region 27 of the sole structure 12 and the article of footwear 14 generally include the portion of the footwear plate 18 and the regions of the sole structure 12 and article of footwear 14 that correspond with rear portions of a human foot, including the calcaneus bone, when the human foot of a size corresponding with the sole structure 12 and article of footwear 14 is supported on the sole structure 12.

The forefoot portion 26 of the footwear plate 18 and the forefoot region 30 of the sole structure 12 and the article of footwear 14 generally include the portion of the footwear plate 18 and the regions of the sole structure 12 and the article of footwear 14 that correspond with the toes and the joints connecting the metatarsals with the phalanges of the human foot (interchangeably referred to herein as the "metatarsal-phalangeal joints" or "MPJ" joints).

The midfoot portion 24 of the footwear plate 18 and the midfoot region 28 of the sole structure 12 and the article of footwear 14 is disposed between the heel portion 22 and the forefoot portion 26, or between the heel region 27 and the forefoot region 30, respectively, and generally includes the portion of the footwear plate 18 and the regions of the sole structure 12 and the article of footwear 14 corresponding with an arch area of the human foot, including the navicular joint.

A sole structure within the scope of the disclosure, such as the sole structure 12, may include any implementation of the devices including the frames and arced shields thereof, discussed herein. The frame 16 includes footwear plate 18, which is configured to extend at least partially along and under a sole of a wearer's foot, and the arced shield 20, which is integral with the footwear plate 18 and configured to extend transversely from the footwear plate 18 at least partially over a superior portion of the wearer's foot. A representative human foot 50 and ankle 52 are shown in phantom in the article of footwear 114 of FIG. 6, for example, with the foot 50 disposed in the foot-receiving cavity 46 such that a footwear plate 318 extends at least partially along and under the sole 51 of the wearer's foot 50, and an arced shield 320 extends transversely from the footwear plate 318 over a superior portion 53 of the foot 50.

Also, various example features and aspects of the footwear plate 18, the sole structure 12, and the article of footwear 14 may be disclosed or explained herein with reference to a "longitudinal direction" and/or with respect to a "longitudinal length" of the footwear plate 18, sole structure 12, and article of footwear 14. As shown in FIG. 1, the "longitudinal direction" is determined as the direction of a line LM extending from a rearmost heel location (RH in FIG. 1) to the forwardmost toe location (FT in FIG. 1) of the device 10. This line LM may also be referred to as the longitudinal midline and may also serve as the longitudinal midline of the sole structure 12 and the article of footwear 14 when the footwear plate 18 is incorporated therein. The "longitudinal length" of the footwear plate 18 is the length dimension measured from the rearmost heel location RH to the forwardmost toe location FT.

As shown in FIGS. 1 and 5, the heel portion 22 of the footwear plate 18 and the heel region 27 of the sole structure 12 and the article of footwear 14 is defined herein as being between perpendicular planes bounding approximately the rear third of the footwear plate 18 and the rear third of the sole structure 12 and article of footwear 14, respectively. The midfoot portion 24 of the footwear plate 18 and the midfoot region 28 of the sole structure 12 and the article of footwear 14 is defined herein as being between perpendicular planes bounding approximately the middle third of the footwear plate 18 and the middle third of the sole structure 12 and the article of footwear 14, respectively. The forefoot portion 26 of the footwear plate 18 and the forefoot region 30 of the sole structure 12 and the article of footwear 14 is defined herein as being between perpendicular planes bounding approximately the front third of the footwear plate 18 and the front third of the sole structure 12 and the article of footwear 14, respectively.

The footwear plate 18 has a medial side 32 and a lateral side 34 both of which extend from the heel portion 22 to the forefoot portion 26 and are generally on opposite sides of the longitudinal midline LM. The medial side 32 and the lateral side 34 of the footwear plate 18 are also referred to as a medial portion 32 and a lateral portion 34 of the footwear plate 18, respectively. The medial side 32 and the lateral side 34 of the footwear plate 18 respectively correspond with a medial side 32A and a lateral side 34A of the sole structure 12 and the article of footwear 14 as well as any other components thereof, such as the footwear upper 40 shown in FIG. 5. For example, both the footwear upper 40 and the sole structure 12 have a medial side 32A and a lateral side 34A (both of which extend from the heel region 27 to the forefoot region 30 and are generally on opposite sides of the longitudinal midline LM of the article of footwear 14.

Referring to FIG. 1, the medial portion 32 of the footwear plate 18 is between a medial edge 33 of the footwear plate 18 (also referred to herein as a medial extremity of the footwear plate 18) and the longitudinal midline LM. The lateral side 34 of the footwear plate 18 is between a lateral edge 35 of the footwear plate 18 (also referred to herein as a lateral extremity of the footwear plate 18) and the longitudinal midline LM.

FIG. 5 is a medial perspective view of the article of footwear 14 including the footwear upper 40 and the sole structure 12. The sole structure 12 includes a midsole 42 and an outsole 44 secured to a ground-facing surface of the midsole 42. The midsole 42 may include one or more midsole layers, and is shown with a single midsole layer 43. The footwear plate 18 extends at least partially over the midsole layer 43.

The midsole layer 43 may be at least partially a polyurethane foam, or a polyurethane ethylene-vinyl acetate (EVA) foam and may include heat-expanded and molded EVA foam pellets. The midsole layer 43 may generally include phylon (ethylene vinyl acetate or "EVA") and/or polyurethane ("PU") base resins. For example, in one embodiment, the midsole layer 43 may be a compression molded phylon. If EVA is used, it may have a vinyl acetate (VA) level between approximately 9% and approximately 40%. Suitable EVA resins include Elvax®, provided by E. I. du Pont de Nemours and Company, and Engage™, provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

The outsole 44 may be formed from materials that may generally include natural or synthetic rubber or other suitably durable materials. The material or materials for the outsole 44 may be selected to provide a desirable combination of durability and flexibility. Synthetic rubbers that may be used include polybutadiene rubber, ethylene propylene rubber (EPR), styrene isoprene styrene (SIS) copolymer rubber, and styrene butadiene rubber.

Figure 54:
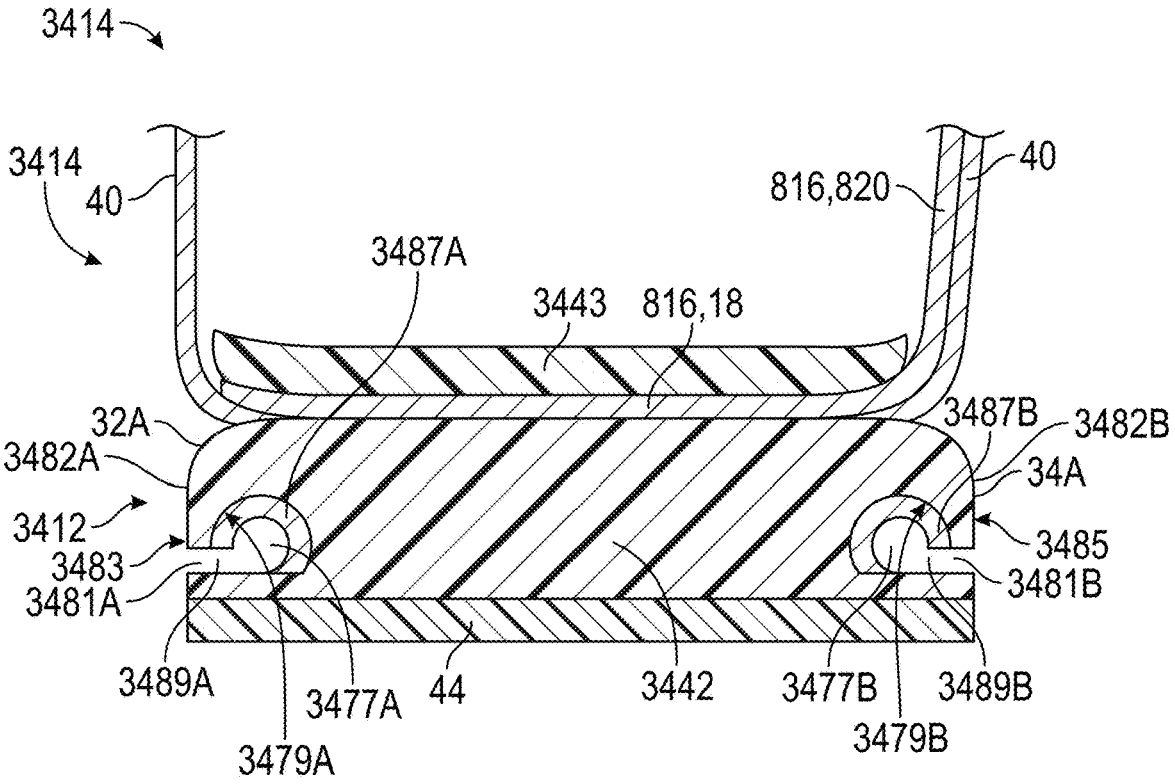
FIG. 54 is a cross-sectional view of the article of footwear of FIG. 53 taken at lines 54-54 in FIG. 53.

The sole structure 12 may include additional components, such as one or more other sole layers overlaying the midsole 42 or overlaying the footwear plate 18, and/or one or more bladders that retain gas. As shown, the device 10 is disposed within a foot-receiving cavity 46 defined by the footwear upper 40 over the sole structure 12. The footwear upper 40 defines an ankle opening 48 into the foot-receiving cavity 46. The footwear plate 18 is shown overlying the midsole 42. An insole, sockliner, and/or a strobel (not shown) may overlie the footwear plate 18 and be disposed between the foot of the wearer and the footwear plate 18. In an example, the footwear plate 18 may be between a foam midsole layer, such as midsole layer 43 and an insole, for example. An insole is not shown in FIG. 5 but would be within the foot-receiving cavity 46 above and possible resting on, the superior surface 47 of the footwear plate 18. FIG. 54 shows such an insole 3443. The superior surface 47 is also referred to herein as the foot-facing surface of the footwear plate 18. In other embodiments, such as described with respect to FIG. 6, a footwear plate may be between an underlying midsole layer and an overlying midsole layer.

The superior surface 47 of the footwear plate 18 may be shaped to generally cup the shape of the sole of the foot 50. For example, the superior surface 47 at the forefoot portion 26 may be slightly concave at a transverse cross-section. Additionally, or in the alternative, the material of an insole, such as a foam insole, could be shaped to provide additional geometry between the sole of the wearer's foot and the superior surface 47 to conform to the sole.

Additionally, the arced shield 20 may be shaped to generally follow the contour of the superior portion of a wearer's foot. When incorporated into an article of footwear having an upper, the arced shield 20 may be shaped to generally follow the contour of the upper, such as the vamp portion of the upper. For example, the arced shield 20 has an anterior edge 56 and a posterior edge 58 as shown in FIG. 2. The anterior edge 56 is nearer to a superior surface 47 (e.g., the foot-facing surface) of the footwear plate 18 than is the posterior edge 58 such that a superior surface 60 of the arced shield 20 has a downward and forward pitch from the posterior edge 58 to the anterior edge 56. This is similar to a typical downward slope of the superior portion of a wearer's foot forward of the ankle and/or a typical downward slope of a vamp portion of a footwear upper. By generally enveloping the foot in this relatively close manner, the frame 16 is more easily incorporated into an article of footwear, such as article of footwear 14 without excessively increasing the overall dimensions of the article of footwear 14.

Because the frame 16 is configured to extend both over a superior portion of the wearer's foot and under the sole of the wearer's foot, partially enveloping the foot, the frame 16 may function to guide movement of the foot. For example, a force applied to the frame 16 may be distributed to both the top and bottom of the foot because of the integral arced shield 20 and footwear plate 18. In some instances, this may help to retain the wearer's foot relative to the footwear plate 18. The integral arced shield 20 may help to prevent or lessen movement of a wearer's foot relative to the footwear plate 18 and/or to a footbed of an article of footwear in which the device 10 is incorporated when shear forces are applied to the device 10 and/or to an article of footwear incorporating the device 10. Additionally, the arced shield 20 may function to protect the superior portion of a wearer's foot when the device 10 is incorporated in an article of footwear and worn during activities in which forces may be directed toward the superior portion such as during athletic activities.

In some implementations, the frame 16 may receive forces to assist the wearer during walking or running, such as to cause rotation of the foot about the ankle, assisting the foot with plantar flexion and reducing the effort of the wearer. Forces applied to the frame 16 at the arced shield 20 may act to push at least a portion of a sole structure of an article of footwear incorporating the device 10 away from the foot but, since a footwear upper is attached to the sole structure, the footwear upper also applies a downward forces on the foot. Such applied forces may act to push another portion of the sole structure against the wearer's foot, such as if the forces are applied to the arced shield 20 in a downward manner, the portion of the sole structure rearward of the ankle joint may be pressed upward against the wearer's foot.

As used herein, an arced shield is a structure that extends at least partially upward from and transversely over the footwear plate when a bottom of the footwear plate and/or a bottom of a sole structure of an article of footwear that incorporates the device 10 is resting on a flat, horizontal ground surface. An arced shield as used herein need not have a shape like an arch. For example, an arced shield need not have a semi-circular shape, etc. An arced shield may alternatively be referred to as a supra-foot extension or an overlying extension as it is configured to be extend at least partially over the disposed the superior surface of the footwear plate, such as the superior surface 47 of footwear plate 18, and at least partially over a wearer's foot when the sole of the foot is resting on the superior surface of the footwear plate.

As shown in FIG. 1, the arced shield 20 and the footwear plate 18 are a unitary, one-piece structure. As such, any forces applied to the frame 16 are distributed to the footwear plate 18. Additionally, the frame 16 may be relatively rigid and, in some implementations, may be more rigid than other components of the sole structure 12, such as the midsole layer 43 and the outsole 44. Stated differently, the frame 16, including the footwear plate 18 and the arced shield 20, may be formed from a relatively rigid material. For example, the frame 16 may be formed from a non-foamed polymer material or, alternatively, from a composite material containing fibers such as carbon fibers and/or glass fibers. For example, the frame 16 may include a carbon fiber composite material. Forming the frame 16 from a relatively rigid material allows the frame 16 to distribute forces associated with use of the article of footwear 14 when the article of footwear 14 is in contact with a ground surface. The frame 16 may have a compressive rigidity of a predetermined numerical value or within a predetermined range of numerical values. The frame 16 may be, but is not limited to, a thermoplastic polyurethane. In an example, the frame 16 may be a polyether block amide PEBAX®, available from Arkema, Inc. in King of Prussia, Pennsylvania USA. The frame 16 may be sufficiently rigid to prevent flexing of the arced shield 20 relative to the footwear plate 18 upon receiving a force not greater than a predetermined force on the arced shield 20. As a result, when a wearer drops the foot to transition to a toe-off position and plantar flex, the footwear plate 18 is sufficiently stiff to maintain forward momentum. Additionally, a frame 16 with a relatively stiff footwear plate efficiently converts the applied force to rotation of the frame 16 about the wearer's ankle, for example.

The frame 16 may have a greater compressive stiffness as well as a greater bending stiffness than the midsole layer 43 and/or than the outsole 44 and may be thinner than the midsole layer 43. The relative stiffness of the frame 16 enables it to accomplish its functions (e.g., convey forces, encourage forward motion, and enhance stability of the sole structure 12) without unduly increasing the overall thickness (e.g., stack height) of the sole structure 12. A relatively low stack height further enhances stability by maintaining a low ratio of height to width, reducing the propensity for sideways tip.

As shown in FIG. 1, the arced shield 20 extends transversely over the footwear plate 18 from the lateral portion 34 (e.g., the lateral side) of the footwear plate 18 to the medial portion 32 (e.g., the medial side) of the footwear plate 18. The arced shield 20 is connected both to the medial portion 32 and to the lateral portion 34 of the footwear plate 18. For example, the arced shield 20 connects to the footwear plate 18 at the lateral edge 35 of the footwear plate 18. In other embodiments, the arced shield 20 may connect to the footwear plate 18 between the lateral edge 35 and the longitudinal midline LM of the footwear plate 18. The arced shield 20 is shown connected to the footwear plate 18 at the medial edge 33 of the footwear plate 18. In other embodiments, the arced shield 20 may connect to the footwear plate 18 between the medial edge 33 and the longitudinal midline LM of the footwear plate 18. Such a connection may be selective (e.g., the arced shield may be selectively attachable and detachable from the footwear plate, similar to the devices 3210 and 3310 of FIGS. 49-50). Alternatively, as shown in FIG. 1, the connection may be permanent, such as when the arced shield 20 and the footwear plate 18 are a contiguous, one-piece component.

In FIG. 1, the arced shield 20 extends over only some of the forefoot portion 26 of the footwear plate 18. In other implementations shown and discussed herein, the arced shield 20 instead or in addition extends over the midfoot portion 24 and/or the heel portion 22 of the footwear plate 18.

In FIG. 1, the footwear plate 18 has each of a forefoot portion 26, a midfoot portion 24, and a heel portion 22 and as such extends in each of the forefoot region 30, the midfoot region 28, and the heel region 27 of the article of footwear 14 of FIG. 5. In other embodiments shown and discussed herein, devices are shown having footwear plates configured to extend only in a forefoot region 30 of the article of footwear 14, or only in the forefoot region 30 and the midfoot region 28 of the article of footwear 14, or only in the midfoot region 28 and the heel region 27 of the article of footwear 14.

Figure 3:
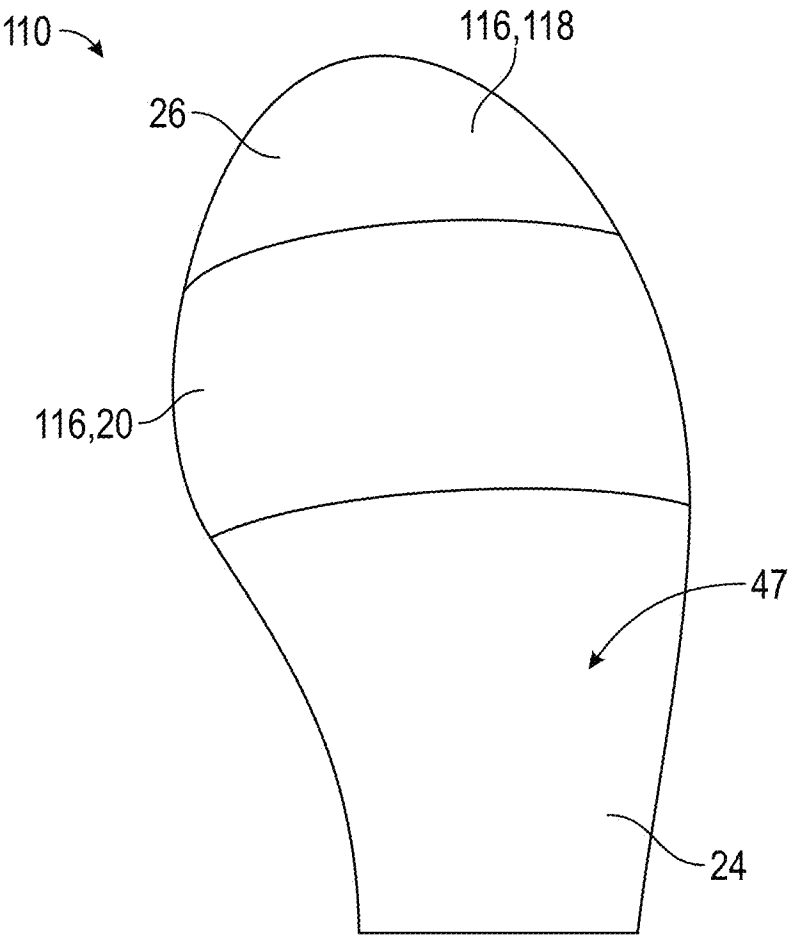
FIG. 3 is a plan view of an alternative device including a frame having a footwear plate with only a forefoot portion and midfoot portion and having the arced shield of the frame of FIG. 1.

For example, FIG. 3 shows a plan view of a device 110 alike in all aspects to the device 10 except that the device 110 includes a frame 116 with a footwear plate 118 that is alike in all aspects to footwear plate 18 except having only a forefoot portion 26 and a midfoot portion 24 (e.g., not having a heel portion 22), such that the footwear plate 118 is configured to extend only in the forefoot region 30 and the midfoot region 28 of the article of footwear 14 and not in the heel region 27 when the device 110 is incorporated into the article of footwear 14 in place of the device 10.

Figure 4:
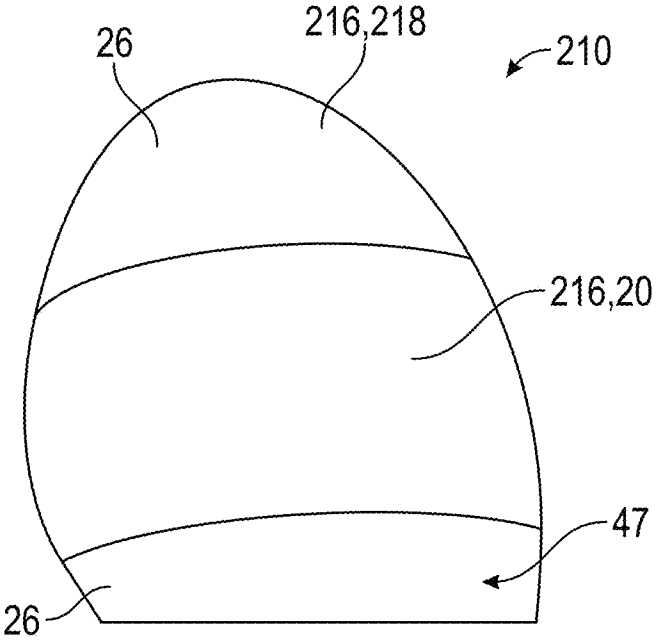
FIG. 4 is a plan view of a device for an article of footwear including a frame having a footwear plate with only a forefoot portion and having the arced shield of the frame of FIG. 1.

In another example, FIG. 4 shows a plan view of a device 210 alike in all aspects to the device 10 except that the device 210 includes a frame 216 with a footwear plate 218 that is alike in all aspects to footwear plate 18 except having only a forefoot portion 26 (e.g., not having a midfoot portion 24 and not having a heel portion 22), such that the footwear plate 218 is configured to extend only in the forefoot region 30 of the article of footwear 14 and not in the midfoot region 28 and not in the heel region 27 when the device 210 is incorporated into the article of footwear 14 in place of the device 10.

Figure 6:
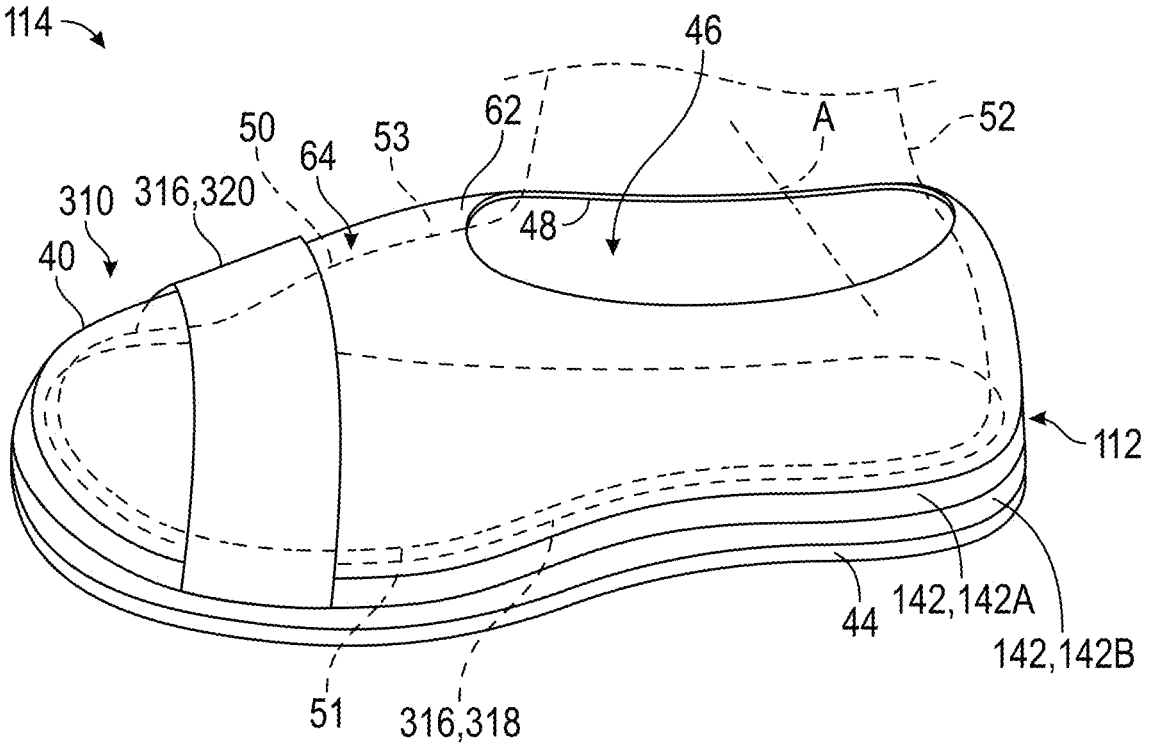
FIG. 6 is a medial perspective view of an article of footwear including a footwear upper and a sole structure with the device of FIG. 1 disposed with the arced shield extending along an exterior surface of the vamp of the footwear upper.

FIGS. 5 and 6 show different arrangements for incorporating a device having a footwear plate and an arced shield as disclosed herein in an article of footwear. In FIG. 5, the device 10 of FIG. 1 is disposed with both the footwear plate 18 and the arced shield 20 disposed in the foot-receiving cavity 46, and with the arced shield 20 extending along an interior surface 59 of the vamp 62 of the footwear upper 40.

FIG. 6 is a medial perspective view of an alternative embodiment of an article of footwear 114 including the footwear upper 40 and a sole structure 112. In FIG. 6, the article of footwear 114 includes a device 310 that has a frame 316 with a footwear plate 318 and an arced shield 320 integral with the footwear plate 318. The footwear plate 318 and the arced shield 320 are alike in all aspects to the footwear plate 18 and the arced shield 20 of FIG. 5 except that the footwear plate 318 is disposed within a midsole 142 of the sole structure 112 of the article of footwear, such as embedded between an upper midsole layer 142A and a lower midsole layer 142B. Alternatively, the footwear plate 318 could be embedded in a single midsole layer. The footwear plate 318 is shown extending to the exterior of the sidewalls of the midsole layers 142A, 142B where the arced shield 320 connects to and extends from the footwear plate 318. In this arrangement, the arced shield 320 extends along an exterior surface 64 of the footwear upper 40 at the vamp 62 of the footwear upper 40.

Figure 7:
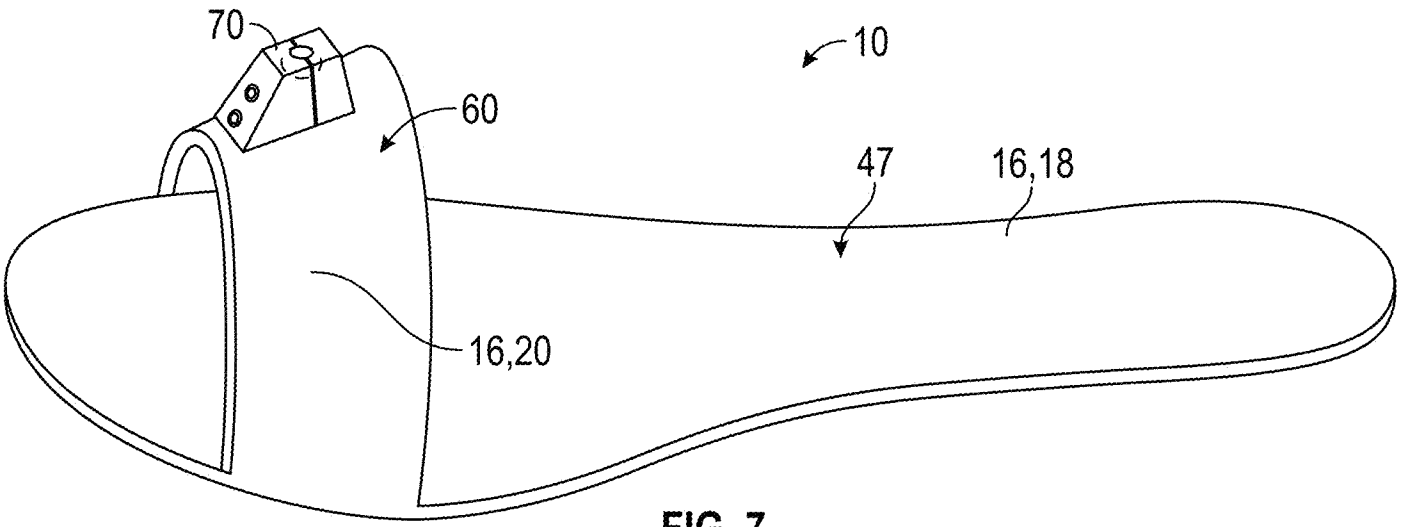
FIG. 7 is a medial perspective view of the device of FIG. 1 with a joint connector secured at a superior surface of the arced shield.

FIG. 7 is a medial perspective view of the device 10 of FIG. 1 with a joint connector 70 operatively connected to the superior surface 60 of the arced shield 20. More specifically, the joint connector 70 is directly secured at the superior surface 60 of the arced shield 20, such as secured directly to the superior surface 60.

Figure 8:
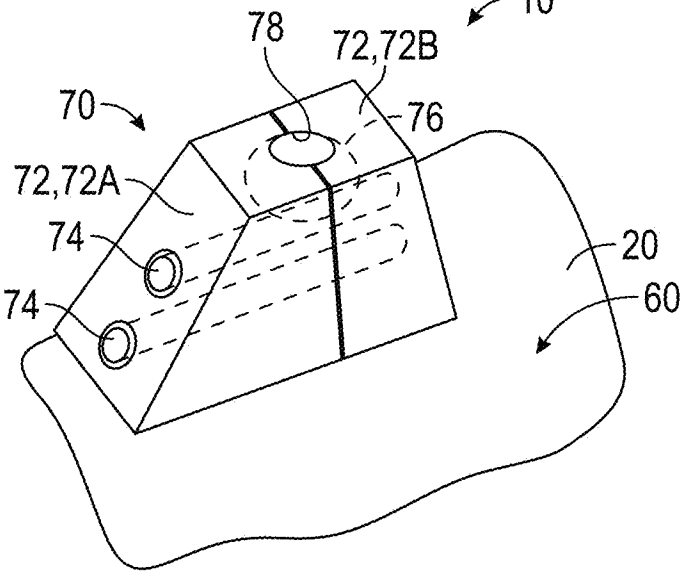
FIG. 8 is a fragmentary perspective view of the arced shield and the joint connector of FIG. 7.

FIG. 8 is a fragmentary perspective view of the device 10 of FIG. 7 showing the joint connector 70 secured to the arced shield 20. The joint connector 70 is configured to function as a portion of a ball joint. For example, the joint connector 70 has a base 72 with two portions 72A, 72B that may be secured to one another with fasteners 74 or the like and together define a cavity 76 and an opening 78 into the cavity 76. The cavity 76 may be generally spherical or otherwise configured to receive an additional portion of the ball joint through the opening 78, such as a link extending through the opening with a ball connected thereto and the ball disposed in the cavity 76. In another example, the joint connector may be a single piece forming the cavity with flexible portions, such as upwardly-extending fingers, that flex to receive a ball within the cavity. The ball would be maintained in the cavity with such a one-piece configuration even with the flexible fingers as generally forces applied through the ball would be downward forces.

An advantage of a joint connector configured in any of the implementations described herein (e.g., joint connector 70 or 70A) is the ease with which any of the devices described herein may be disconnected from any external structure, such as an exoskeleton. For example, by decoupling the device from the external structure at the joint connector, the same device may then be inserted into a different foot-receiving cavity of a differently-configured article of footwear. Additionally or in the alternative, a different article of footwear with a different device may be connected to the same external structure. Stated differently, different articles of footwear having different devices or having the same device may be used with the same external structure by coupling and decoupling from the external structure at the joint connector. Accordingly, if different articles of footwear are more suited for different activities (e.g., have different sole structures, for example, of different flexibilities, one more suited for trail running and the other more suited for road running, for example), these may be easily swapped for use with the external structure.

In at least one example of a device or article of footwear including the joint connector 70 or the joint connector 70A, the joint connector 70 or the joint connector 70A may be off-center (e.g., at a medial side of a lateral side of the superior surface of the arced shield).

Figure 9:
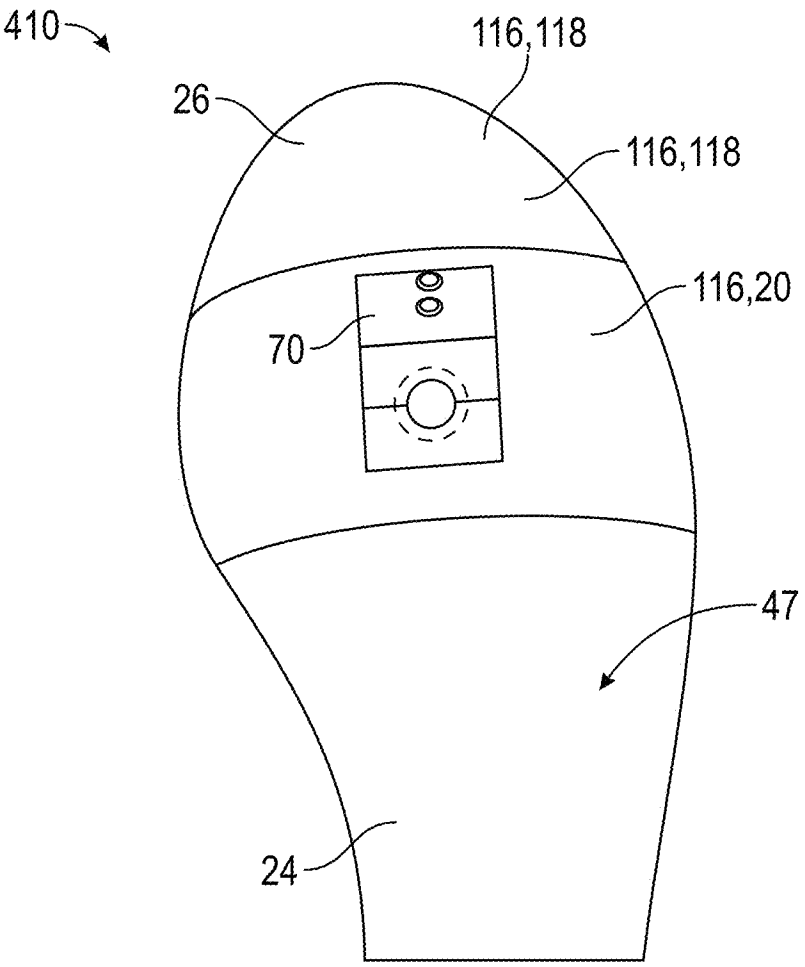
FIG. 9 is a plan view of an alternative device including a frame having a footwear plate with only a forefoot portion and a midfoot portion and having the arced shield and joint connector of the device of FIG. 7.

FIG. 9 is a plan view of an alternative device 410 including the frame 116 having the footwear plate 118 and arced shield 20 described in FIG. 3 (e.g., the footwear plate 118 having only a forefoot portion 26 and a midfoot portion 24) and having the joint connector 70 of the device 10 of FIGS. 7-8 secured to the arced shield 20.

Figure 10:
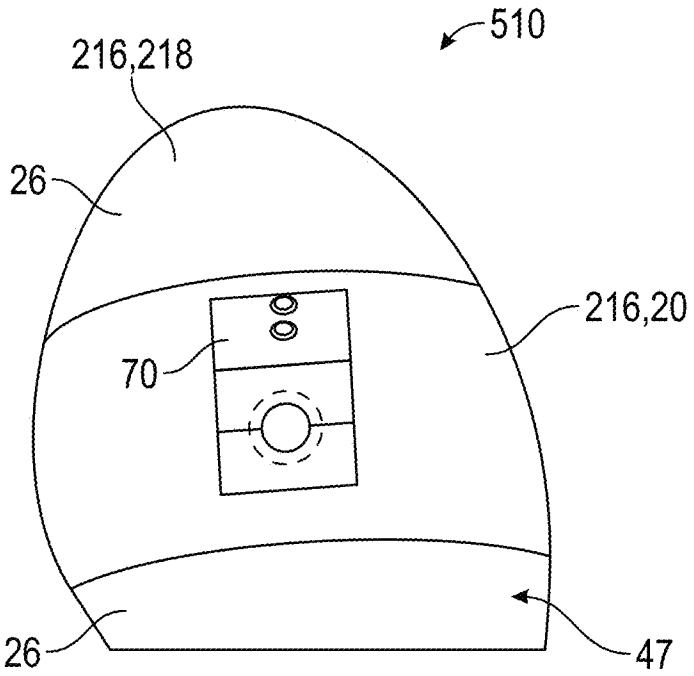
FIG. 10 is a plan view of an alternative device including a frame having a footwear plate with only a forefoot portion and having the arced shield and joint connector of the device of FIG. 7.

FIG. 10 is a plan view of an alternative device 510 including the frame 216 having the footwear plate 218 and arced shield 20 described in FIG. 4 (e.g., the footwear plate 218 having only a forefoot portion 26) and having the joint connector 70 of the device 10 of FIGS. 7-8 secured to the arced shield 20.

Figure 11:
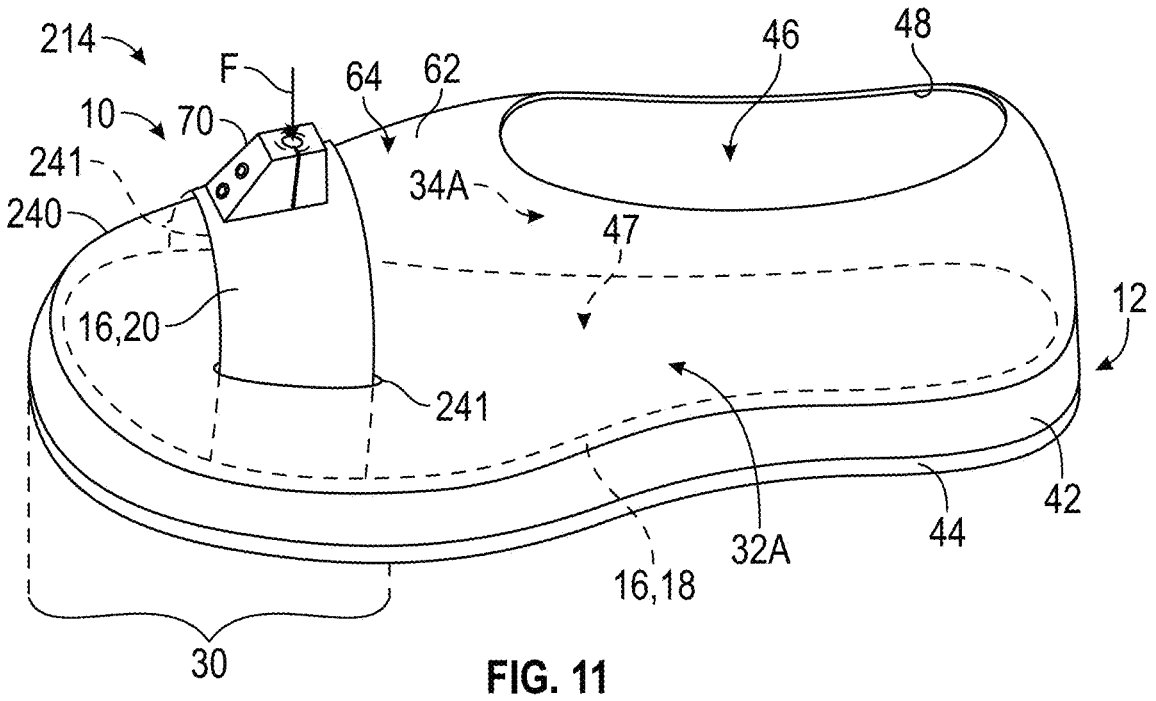
FIG. 11 is a medial perspective view of an article of footwear including a footwear upper and a sole structure with the device of FIG. 7 disposed with the arced shield extending along an exterior surface of the vamp of the footwear upper.

FIG. 11 is a medial perspective view of an article of footwear 214 including a footwear upper 240 and the sole structure 12 with the device 10 of FIG. 7. The footwear upper 240 is alike in all aspects to the footwear upper 40 except that openings 241 extend through the footwear upper 240 at the medial side 32A and the lateral side 34A so that the arced shield 20 may extend along the exterior surface 64 of the vamp 62 of the footwear upper 240. The arced shield 20 extends outward of the exterior surface 64 of the footwear upper 240 by extending from inside of the foot-receiving cavity 46 through the openings 241 in the footwear upper 240 at or near one or both of the medial and lateral sides 32A, 34A of the footwear upper 240, and extending over the exterior surface 64 of the footwear upper 240 between the locations from which it extends through the footwear upper 240 (e.g., between the openings 241). The footwear plate 18 extends over the midsole 42 as described with respect to FIG. 5.

Configuring the joint connector 70 to function as a portion of a ball joint enables flexibility in the forefoot region 30 of the article of footwear 214 to be maintained. Specifically, a ball joint connection will still permit some rotation of the article of footwear 214 about the longitudinal midline LM as well as about an axis perpendicular to the longitudinal midline LM (e.g., a vertical axis in FIG. 11) when a downward force is applied at the ball joint connector 70, such as force F shown in FIG. 11, for example, to cause rotation about a pivot axis through an ankle joint of the wearer (like pivot axis A in FIG. 6). Accordingly, an external force such as force F applied to assist movement via the ball joint should not overly limit natural movement of the wearer's foot. In an example, the frame 16 is configured for operative connection to an exoskeleton, with the exoskeleton providing the external force F at the ball joint connector 70 that assists with plantar flexion. Because the ball joint connector 70 is forward of an axis through the wearer's ankle joint (e.g., pivot axis A indicated in FIG. 6), a downward force on the joint connector 70 will cause rotation about the ankle joint in a direction consistent with plantar flexion of the wearer's foot 50. Examples of an exoskeleton used to assist with plantar flexion and improve walking or running performance are found, for example, in United States Patent Application Publication 2023/0124653A1, published Apr. 20, 2023.

Figure 12:
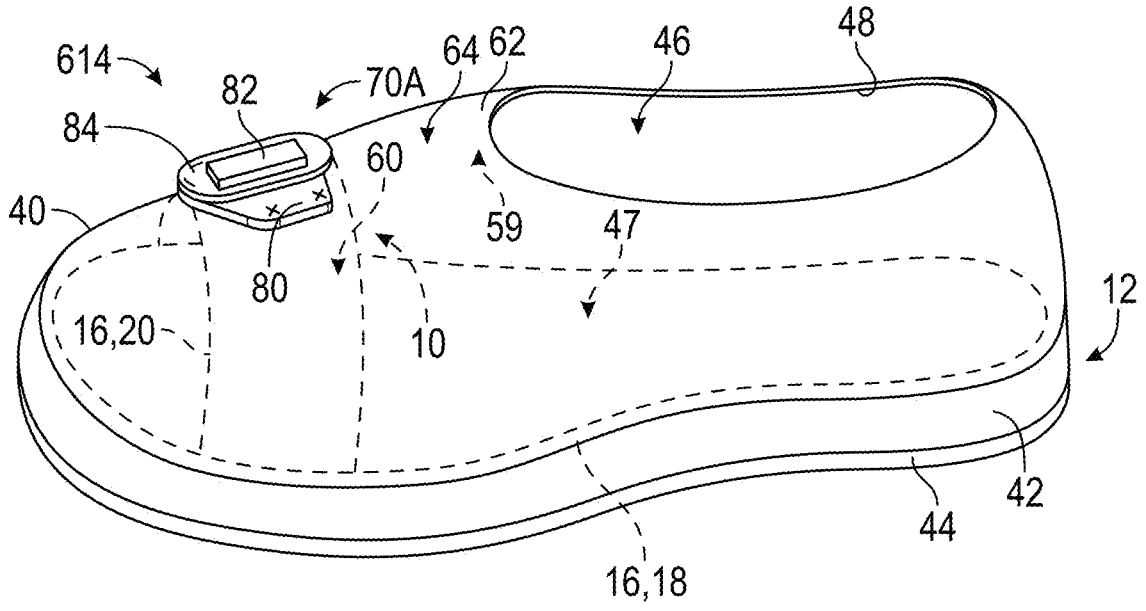
FIG. 12 is a medial perspective view of an article of footwear including the device of FIG. 1 with a joint connector that includes a textile secured at an exterior surface of the vamp of the footwear upper of the article of footwear and a magnet or magnetic material operatively secured the textile.

FIG. 12 is a medial perspective view of an article of footwear 614 that includes the device 10, the sole structure 12, and the footwear upper 40 described with respect to the article of footwear 14 of FIG. 5 and having an alternative version of a joint connector 70A which is also configured to function as a portion of a ball joint. The joint connector 70A includes a textile 80 secured at the exterior surface 64 of the vamp 62 of the footwear upper 40 of the article of footwear 614.

Figure 13:
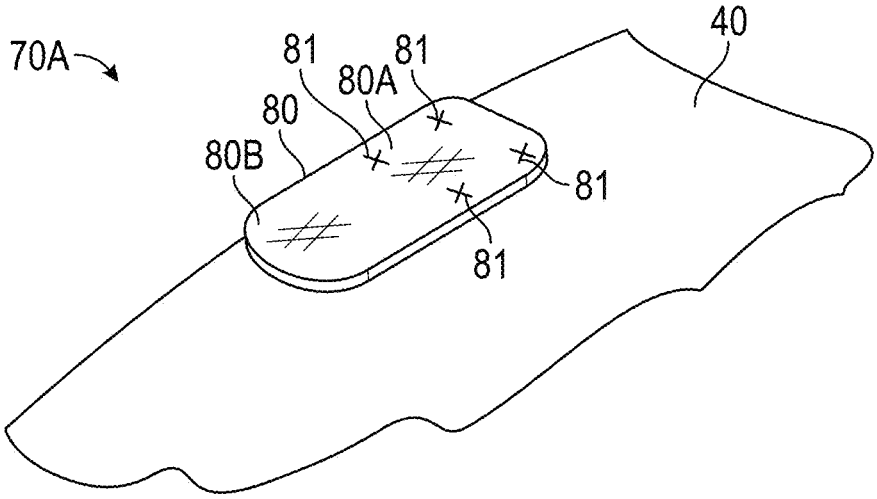
FIG. 13 is a fragmentary perspective view of a portion of the footwear upper and the textile of the joint connector of FIG. 12.
Figure 14:
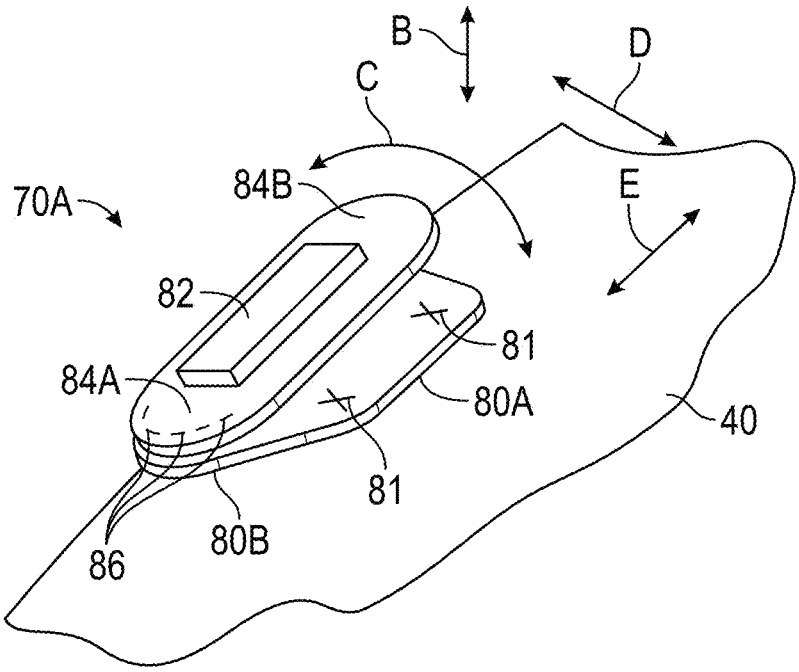
FIG. 14 is a fragmentary perspective view of a portion of the footwear upper and the joint connector of FIG. 12.

FIG. 13 is a fragmentary perspective view of a portion of the footwear upper 40 and textile 80 of the joint connector 70A of FIG. 12. As shown in FIG. 13, the textile 80 has a main portion 80A stitched to the footwear upper 40 with stitches 81 such that the main portion 80A is not movable relative to the footwear upper 40. The textile 80 has an end portion 80B integral with the main portion 80A but not stitched or otherwise directly secured to the footwear upper 40. Stated differently, the end portion 80B is only indirectly secured to the footwear upper 40 via the main portion 80A. As such, the end portion 80B is movable relative to the footwear upper 40 (e.g., the end portion 80B may be lifted away from and move toward the footwear upper 40 in the directions of double-sided arrow B, as illustrated in FIG. 14. FIG. 14 is a fragmentary perspective view of a portion of the footwear upper and the joint connector of FIG. 12. Because the textile 80 is flexible, the end portion 80B may also be tilted slightly about a longitudinal axis of the footwear upper 40 to the extent permitted by the anchored main portion 80A as indicated by double-sided arrow C. The end portion 80B is also movable slightly relative to the footwear upper 40 in a plurality of other directions in addition to the directions along the double-sided arrows B and C, such as transversely along double-sided arrow D and longitudinally along double-sided arrow E. The end portion 80B may thus be referred to as a free end portion 80B. The textile 80 is thus configured to be pivotable relative to the exterior surface 64 of the footwear upper 40 at least about two perpendicular axes. The two perpendicular axes may include, for example, a transverse axis along double-sided arrow D and a longitudinal axis along double-sided arrow E.

The joint connector 70A also includes a magnet 82 (or magnetic material) and a plastic base 84 by which the magnet 82 (or magnetic material) is operatively secured the textile 80. The magnet 82 is shown secured to the plastic base 84 such as by adhesive. The plastic base 84 is secured only at a fixed end 84A to the free end portion 80B of the textile 80 such as by stitching 86. Only some of the stitching 86 is labeled. In this arrangement, the plastic base 84 has a free end 84B. The free end 84B is opposite from the free end portion 80B of the textile 80 and movable in various directions, such as but not limited to along the double-sided arrows B and C, relative to both the fixed end 84A and the footwear upper 40.

The combination of the relatively flexible textile 80 having a free end portion 80B and the base 84 having a free end 84B opposite from the free end portion 80B enables the joint connector 70A to function as a portion of a ball joint. The joint connector 70A is operatively connected to and indirectly secured to the superior surface 60 of the arced shield 20 in FIG. 12 by the above-described securement to the footwear upper 40. As described with respect to the article of footwear 14, the arced shield 20 of the frame 16 is configured to extend along an interior surface 59 of the vamp 62 of the footwear upper 40. The textile 80 is secured only at one end (end at the main portion 80A) to the footwear upper 40, enabling the textile 80 to function as a portion of a ball joint with respect to movement relative to the footwear upper 40.

As shown, the joint connector 70A is secured to the exterior surface 64 of the footwear upper 40 directly outward of the arced shield 20. Accordingly, an external force applied to the joint connector 70A will be transferred to the arced shield 20 without limiting the natural movement of the wearer's foot due to the ability of the joint connector 70A to move relative to the footwear upper 40 as described above, which relative movement may occur even during application of an external force to the arced shield 20 via the joint connector 70A.

Accordingly, in the article of footwear 614, the frame 16 is configured to receive an external force to augment plantar flexion of the wearer's foot. For example, the joint connector 70A may receive and direct an external force on the frame 16, such as on the arced shield 20, to cause rotation about the ankle, reducing the effort input by the wearer for plantar flexion. This energy assistance may enable the wearer to remain active for longer periods of time and/or to move further distances. In an example, the frame 16 is configured for operative connection to an exoskeleton via the joint connector 70A, with the exoskeleton providing the external force that assists with plantar flexion.

Figure 15:
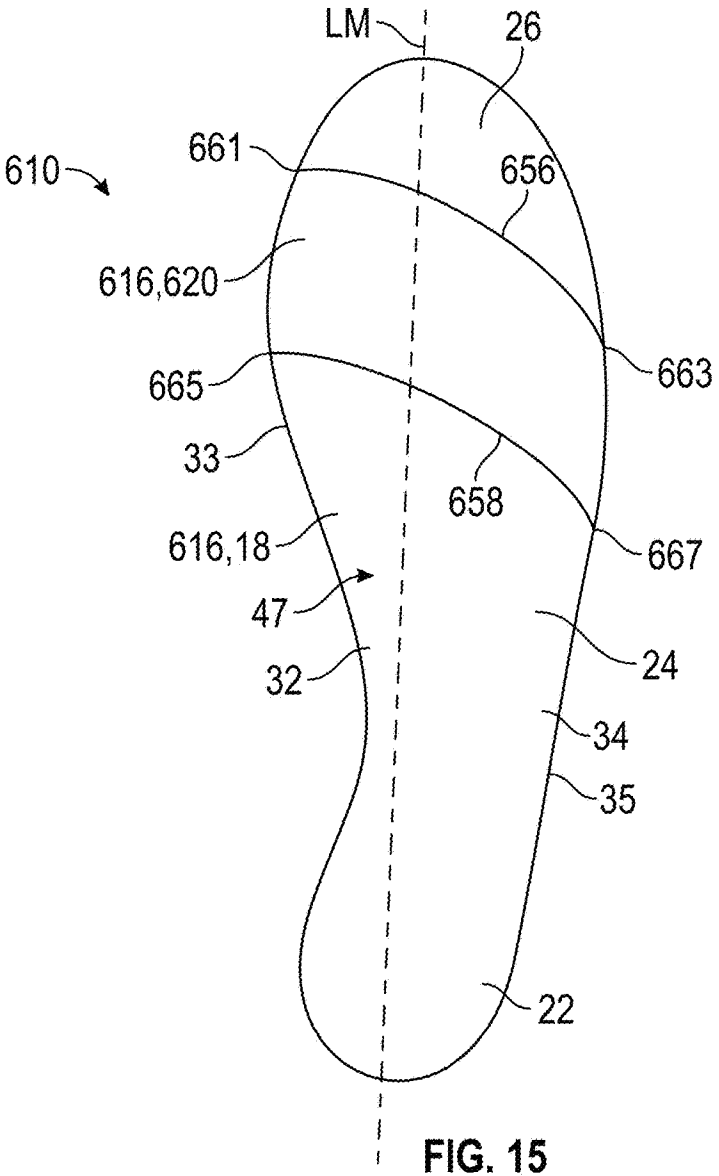
FIG. 15 is a plan view of a device for an article of footwear including a frame with a footwear plate and an arced shield.

FIG. 15 is a plan view of another device 610 for an article of footwear including a frame 616 having the footwear plate 18 as described with respect to FIG. 1, for example, and an arced shield 620. The footwear plate 18 and the arced shield 620 are integrally formed as a unitary, one-piece structure. The footwear plate 18 and the arced shield 620 are relatively rigid, and may include any of the materials described herein with respect to the frame 16 or with respect to any other device described herein. The arced shield 620 extends transversely over the footwear plate 18 from the lateral portion 34 of the footwear plate 18 to the medial portion 32 of the footwear plate 18 and is connected to both the medial portion 32 and the lateral portion 34. For example, the arced shield 620 connects to the footwear plate 18 at the lateral edge 35 of the footwear plate 18. In other embodiments, the arced shield 620 may connect to the footwear plate 18 between the lateral edge 35 and the longitudinal midline LM of the footwear plate 18. The arced shield 620 is shown connected to the footwear plate 18 at the medial edge 33 of the footwear plate 18. In other embodiments, the arced shield 620 may connect to the footwear plate 18 between the medial edge 33 and the longitudinal midline LM of the footwear plate 18. Such a connection may be selective (e.g., the arced shield 620 may be selectively attachable and detachable from the footwear plate, similar to the devices 3210 and 3310 of FIGS. 49-50). Alternatively, as shown in FIG. 15, the connection may be permanent, such as when the arced shield 620 and the footwear plate 18 are a contiguous, one-piece component.

As described with respect to arced shield 20, the arced shield 620 is shaped to extend over the superior portion 53 of the wearer's foot 50 (foot 50 shown in FIG. 6), and to generally follow the contour of the superior surface of the wearer's foot, having an anterior edge 656 and a posterior edge 658, with the anterior edge 656 nearer to the superior surface 47 of the footwear plate 18 than the posterior edge 658.

The position of the arced shield 620 relative to the footwear plate 18 promotes relatively easy foot insertion (e.g., positioning of the sole 51 of the wearer's foot 50 over the footwear plate 18 with the arced shield 620 over a superior portion 53 of the wearer's foot 50). For example, an anterior extent 661 of the arced shield 620 at the medial portion 32 of the footwear plate 18 is further forward than an anterior extent 663 of the arced shield 620 at the lateral portion 34 of the footwear plate 18 such that the anterior edge 656 of the arced shield 620 angles rearward from the medial portion 32 of the footwear plate 18 to the lateral portion 34 of the footwear plate 18. Additionally, the posterior edge 658 of the arced shield 620 angles rearward from the medial portion 32 of the footwear plate 18 to the lateral portion 34 of the footwear plate 18. Inserting the foot 50 of FIG. 6 into the frame 616 leading with the forefoot region of the foot 50 from rearward of the posterior edge 658 of the arced shield 620 is made relatively easy with this configuration if foot entry is not only from rearward of the posterior edge 658, but also moving transversely inward toward the longitudinal midline LM from the side opposite the side from which the posterior edge angles forward (e.g., moving forward and transversely inward from the medial portion 32 in FIG. 15). This assumes that, if the frame 616 is incorporated into an article of footwear, the footwear upper is also configured to facilitate (or at least not prevent) such entry.

In FIG. 15, an anterior extent 665 of the posterior edge 658 of the arced shield 620 at the medial portion 32 of the footwear plate is at the forefoot portion 26 of the footwear plate 18 and an anterior extent 667 of the posterior edge 658 of the arced shield 620 at the lateral portion 34 of the footwear plate 18 is at the midfoot portion 24 of the footwear plate 18. In such an embodiment, the arced shield 620 should span over instep of the wearer's foot 50. In an alternative embodiment, a footwear plate having only the forefoot portion 26 and the midfoot portion 24 (e.g., no heel portion 22) may be used. A downward external force applied to the arced shield 620, such as at any of the joint connectors described herein if operatively connected to the arced shield 620, should result in forward rotation about the pivot axis A of the ankle shown in FIG. 6 (e.g., plantar flexion). A downward external force applied to the arced shield is a vertical force directed toward a flat ground surface when the bottom of the plate 18 is resting on the flat ground surface.

Figure 16:
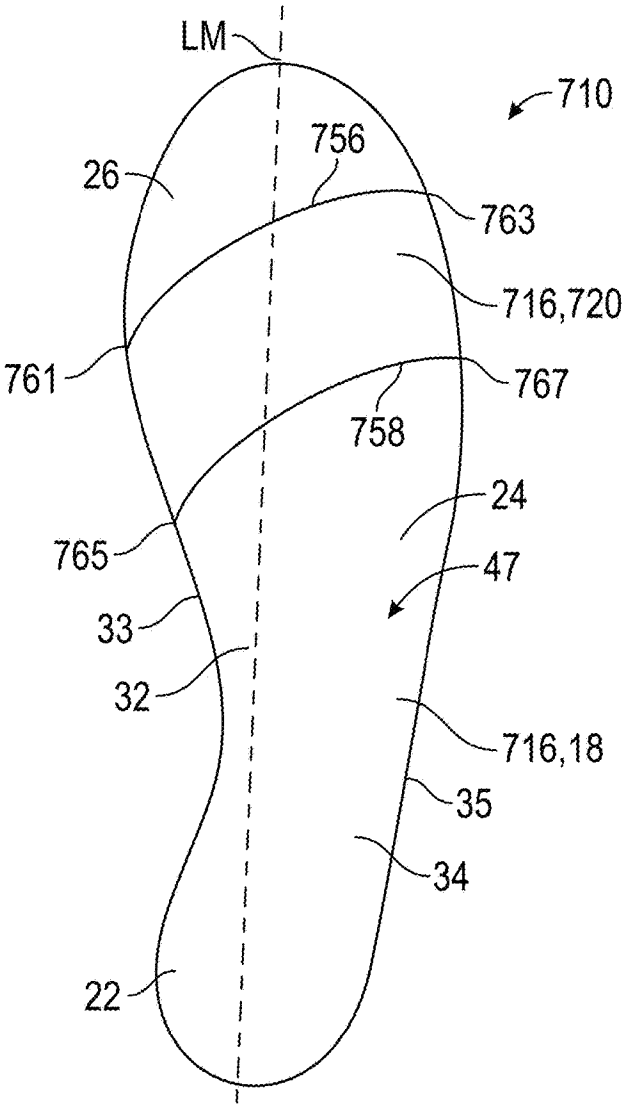
FIG. 16 is a plan view of a device for an article of footwear including a frame with a footwear plate and an arced shield.

FIG. 16 is a plan view of another device 710 for an article of footwear including a frame 716 having the footwear plate 18 as described with respect to FIG. 1, for example, and an arced shield 720. The footwear plate 18 and the arced shield 720 are integrally formed as a unitary, one-piece structure. The footwear plate 18 and the arced shield 720 are relatively rigid, and may include any of the materials described herein with respect to the frame 16 or with respect to any other device described herein. The arced shield 720 extends transversely over the footwear plate 18 from the lateral portion 34 of the footwear plate 18 to the medial portion 32 of the footwear plate 18 and is connected to both the medial portion 32 and the lateral portion 34. For example, the arced shield 720 connects to the footwear plate 18 at the lateral edge 35 of the footwear plate 18. In other embodiments, the arced shield 720 may connect to the footwear plate 18 between the lateral edge 35 and the longitudinal midline LM of the footwear plate 18. The arced shield 720 is shown connected to the footwear plate 18 at the medial edge 33 of the footwear plate 18. In other embodiments, the arced shield 720 may connect to the footwear plate 18 between the medial edge 33 and the longitudinal midline LM of the footwear plate 18. Such a connection may be selective (e.g., the arced shield 720 may be selectively attachable and detachable from the footwear plate, similar to the devices 3210 and 3310 of FIGS. 49-50). Alternatively, as shown in FIG. 16, the connection may be permanent, such as when the arced shield 720 and the footwear plate 18 are a contiguous, one-piece component.

As described with respect to arced shield 20, the arced shield 720 is shaped to extend over the superior portion 53 of the wearer's foot 50 (foot 50 shown in FIG. 6), and to generally follow the contour of the superior surface of the wearer's foot, having an anterior edge 756 and a posterior edge 758, with the anterior edge 756 nearer to the superior surface 47 of the footwear plate 18 than the posterior edge 758.

The position of the arced shield 720 relative to the footwear plate 18 promotes relatively easy foot insertion (e.g., positioning of the sole 51 of the wearer's foot 50 over the footwear plate 18 with the arced shield 720 over a superior portion 53 of the wearer's foot 50). For example, an anterior extent 761 of the arced shield 720 at the medial portion 32 of the footwear plate 18 is further rearward than an anterior extent 763 of the arced shield 720 at the lateral portion 34 of the footwear plate 18 such that the anterior edge 756 of the arced shield 720 angles forward from the medial portion 32 of the footwear plate 18 to the lateral portion 34 of the footwear plate 18. Additionally, the posterior edge 758 of the arced shield 720 angles forward from the medial portion 32 of the footwear plate 18 to the lateral portion 34 of the footwear plate 18. For example, a posterior extent 765 of the arced shield 720 at the medial portion 32 of the footwear plate 18 is further rearward than a posterior extent 767 of the arced shield 720 at the lateral portion 34 such that the posterior edge 758 angles forward from the medial portion 32 to the lateral portion 34. Inserting the foot 50 of FIG. 6 into the frame 716 leading with the forefoot region of the foot 50 from rearward of the posterior edge 758 of the arced shield 720 is made relatively easy with this configuration if foot entry is not only from rearward of the posterior edge 658, but also moving transversely inward toward the longitudinal midline LM from the side opposite the side from which the posterior edge angles forward (e.g., moving forward and transversely inward from the lateral portion 34 in FIG. 16). This assumes that, if the frame 716 is incorporated into an article of footwear, the footwear upper is also configured to facilitate (or at least not prevent) such entry.

In FIG. 16, the posterior extent 765 of the posterior edge 758 of the arced shield 720 at the medial portion 32 of the footwear plate 18 is at the midfoot portion 24 of the footwear plate 18 and the anterior extent 767 of the posterior edge 758 of the arced shield 720 at the lateral portion 34 of the footwear plate 18 is at the forefoot portion 26 of the footwear plate 18. It is noted that the anterior extent 767 of the posterior edge 758 is also the posterior extent of the arced shield 720 at the lateral edge 35 and may be referred to as such. In such an embodiment, the arced shield 720 should span over instep of the wearer's foot 50. In an alternative embodiment, a footwear plate having only the forefoot portion 26 and the midfoot portion 24 (e.g., no heel portion 22) may be used. A downward external force applied to the arced shield 720, such as at any of the joint connectors described herein if operatively connected to the arced shield 720, should result in forward rotation about the pivot axis A of the ankle (e.g., plantar flexion).

Figure 18:
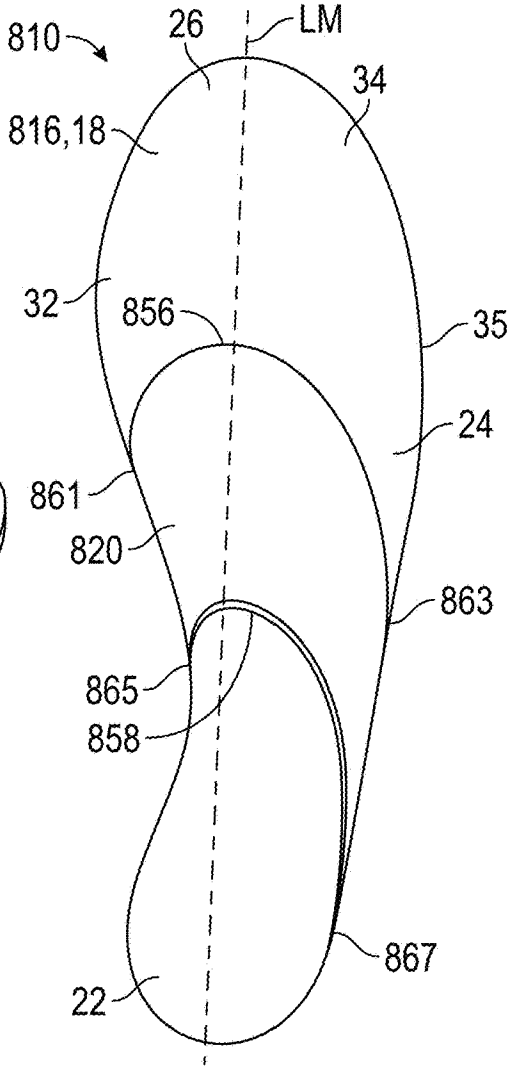
FIG. 18 is a plan view of the device of FIG. 17.
Figure 17:
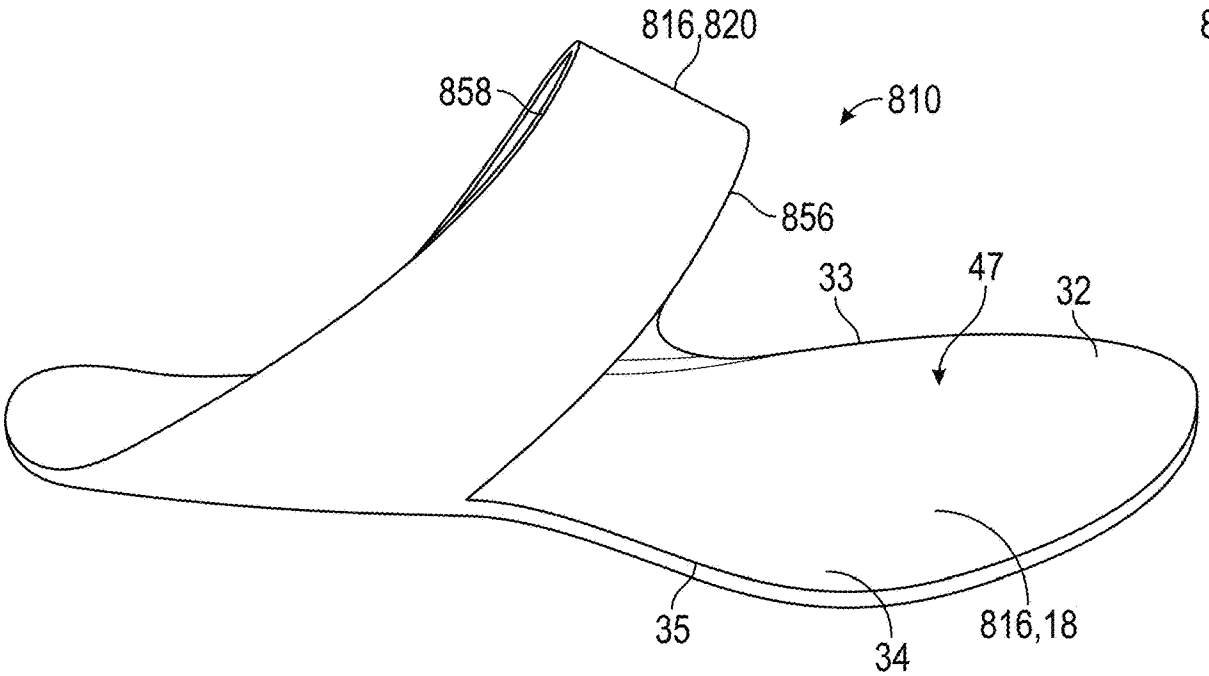
FIG. 17 is a lateral perspective view of a device for an article of footwear including a frame with a footwear plate and an arced shield.

FIG. 17 is a lateral perspective view of a device 810 for an article of footwear including a frame 816 with the footwear plate 18, as described with respect to FIG. 1, for example, and an arced shield 820. FIG. 18 is a plan view of the device 810 of FIG. 17. The footwear plate 18 and the arced shield 820 are integrally formed as a unitary, one-piece structure. The footwear plate 18 and the arced shield 820 are relatively rigid, and may include any of the materials described herein with respect to the frame 16 or with respect to any other device described herein. The arced shield 820 extends transversely over the footwear plate 18 from the lateral portion 34 of the footwear plate 18 to the medial portion 32 of the footwear plate 18 and is connected to both the medial portion 32 and the lateral portion 34. For example, the arced shield 820 connects to the footwear plate 18 at the lateral edge 35 of the footwear plate 18. In other embodiments, the arced shield 820 may connect to the footwear plate 18 between the lateral edge 35 and the longitudinal midline LM of the footwear plate 18. The arced shield 820 is shown connected to the footwear plate 18 at the medial edge 33 of the footwear plate 18. In other embodiments, the arced shield 820 may connect to the footwear plate 18 between the medial edge 33 and the longitudinal midline LM of the footwear plate 18. Such a connection may be selective (e.g., the arced shield 820 may be selectively attachable and detachable from the footwear plate 18, similar to the devices 3210 and 3310 of FIGS. 49-50). Alternatively, as shown in FIG. 17, the connection may be permanent, such as when the arced shield 820 and the footwear plate 18 are a contiguous, one-piece component.

As described with respect to arced shield 20, the arced shield 820 is shaped to extend over the superior portion 53 of the wearer's foot 50 (foot 50 shown in FIG. 6), and to generally follow the contour of the superior surface of the wearer's foot, having an anterior edge 856 and a posterior edge 858, with the anterior edge 856 nearer to the superior surface 47 of the footwear plate 18 than the posterior edge 858.

The position of the arced shield 820 relative to the footwear plate 18 promotes relatively easy foot insertion (e.g., positioning of the sole 51 of the wearer's foot 50 over the footwear plate 18 with the arced shield 820 over a superior portion 53 of the wearer's foot 50). For example, an anterior extent 861 of the arced shield 820 at the medial edge 33 of the footwear plate 18 is further forward than an anterior extent 863 of the arced shield 820 at the lateral edge 35 of the footwear plate 18 such that the anterior edge 856 of the arced shield 820 angles rearward from the medial edge 33 of the footwear plate 18 to the lateral edge 35 of the footwear plate 18. Additionally, the posterior edge 858 of the arced shield 820 angles rearward from the medial edge 33 of the footwear plate 18 to the lateral edge 35 of the footwear plate 18. Inserting the foot 50 of FIG. 6 into the frame 816 leading with the forefoot region of the foot 50 from rearward of the posterior edge 858 of the arced shield 820 is made relatively easy with this configuration if foot entry is not only from rearward of the posterior edge 858, but also moving transversely inward toward the longitudinal midline LM from the side opposite the side from which the posterior edge 858 angles forward (e.g., moving forward and transversely inward from the medial portion 32 in FIG. 18). This assumes that, if the frame 816 is incorporated into an article of footwear, the footwear upper is also configured to facilitate (or at least not prevent) such entry.

In FIG. 18, the anterior extent 865 of the posterior edge 758 of the arced shield 720 at the medial edge 33 of the footwear plate 18 is at the midfoot portion 24 of the footwear plate 18 and an anterior extent 867 of the posterior edge 858 of the arced shield 820 at the lateral edge 35 of the footwear plate 18 is at the heel portion 22 of the footwear plate 18. In such an embodiment, the arced shield 820 should span over the instep of the wearer's foot 50. A downward external force applied to the arced shield 820 forward of the ankle axis A of the wearer's foot, such as at any of the joint connectors described herein if operatively connected to the arced shield 820, should result in forward rotation about the pivot axis A of the ankle (e.g., plantar flexion).

Figure 19:
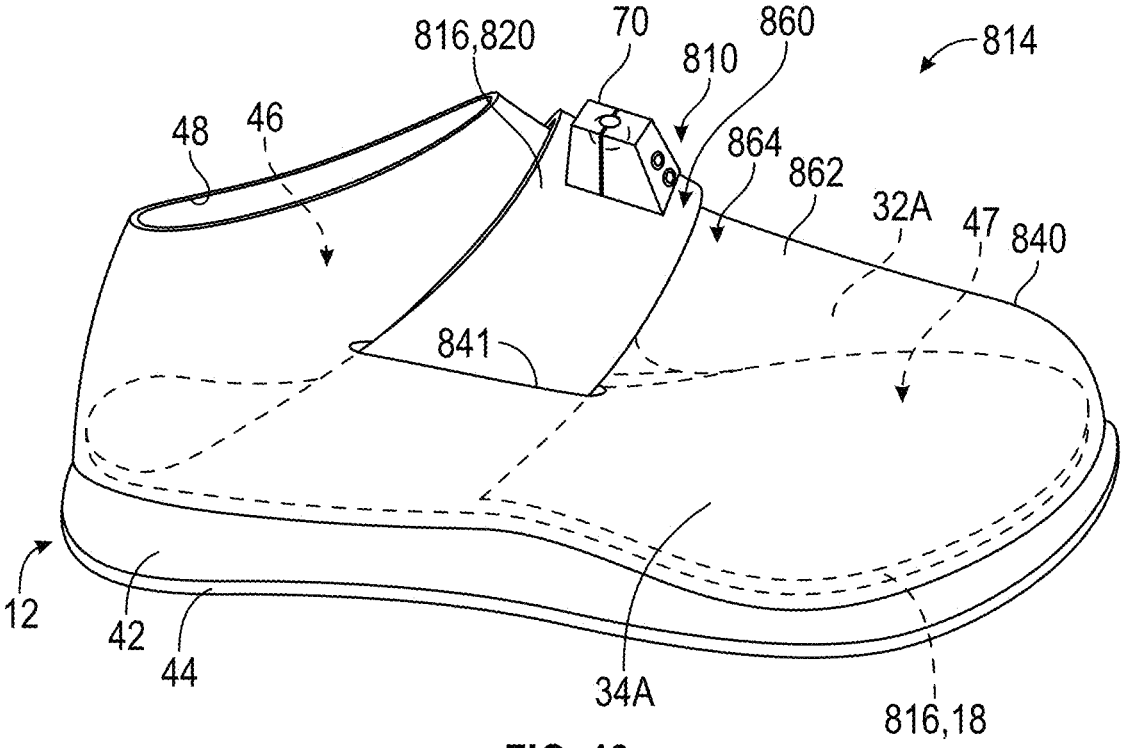
FIG. 19 is a lateral perspective view of an article of footwear including a footwear upper and a sole structure with the device of FIG. 17 disposed with the arced shield extending along an exterior surface of the vamp of the footwear upper and including the joint connector of FIG. 7.

FIG. 19 is a lateral perspective view of an article of footwear 814 including a footwear upper 840 and the sole structure 12 (described herein with the device 810 of FIG. 17) disposed with the arced shield 820 extending along an exterior surface 864 of the vamp 862 of the footwear upper 840 and including the joint connector 70 of FIG. 11 secured to the superior surface 860 of the arced shield 820. Similar to the footwear upper 240, openings 841 extend through the footwear upper 840 so that the arced shield 820 may protrude through the footwear upper 840 and extend along the exterior surface 864 of the vamp 862 of the footwear upper 840. Only one opening 841 is shown at the lateral side 34A of the footwear upper 840, but a like opening 841 extends at the medial side 32A. The arced shield 820 extends outward of the exterior surface 864 of the footwear upper 840 by extending from inside of the foot-receiving cavity 46 through the openings 841 in the footwear upper 840 at or near one or both of the medial and lateral sides 32A, 34A of the footwear upper 840, and extending over the exterior surface 864 of the footwear upper 840 between the locations from which it extends through the footwear upper 840 (e.g., between the openings 841). The footwear plate 18 extends over the midsole 42 as described with respect to FIG. 5.

Figure 20:
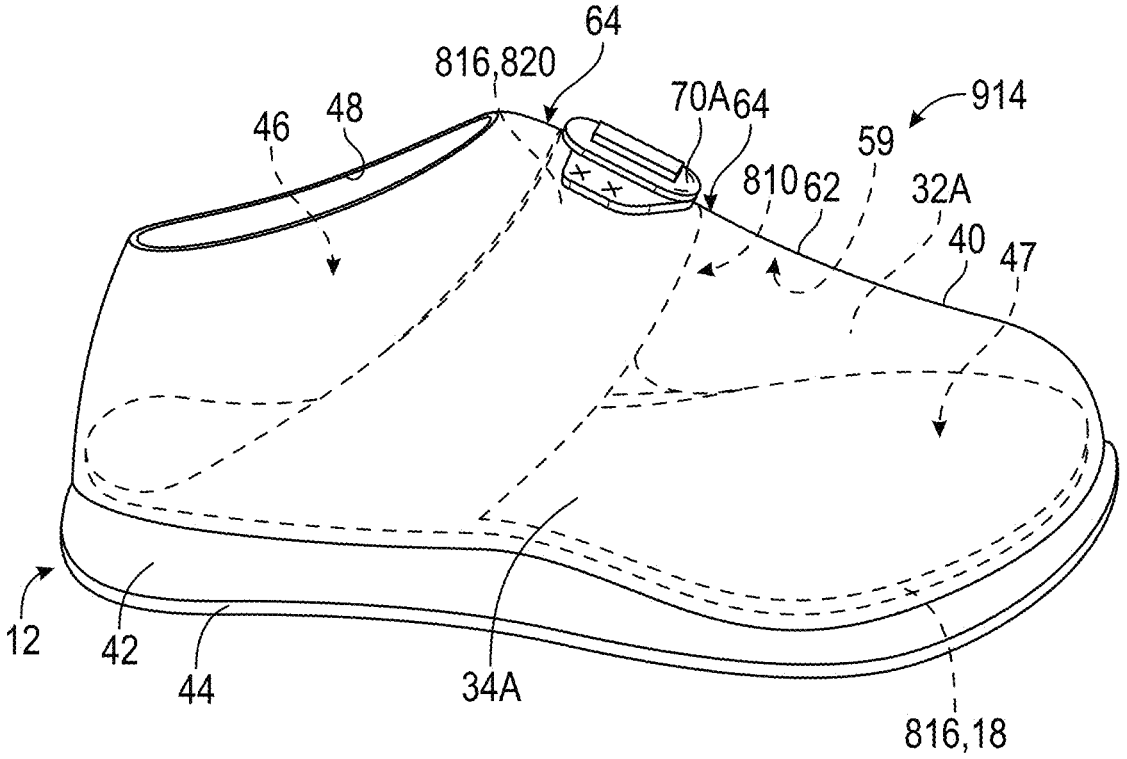
FIG. 20 is a lateral perspective view of an article of footwear including the device of FIG. 17 with the joint connector of FIG. 12.

FIG. 20 is a lateral perspective view of an article of footwear 914 including the footwear upper 40 and the sole structure 12 (described herein with the device 810 of FIG. 17) disposed with the arced shield 820 extending along the interior surface 59 of the footwear upper 40 and including the joint connector 70A of FIGS. 12-14 secured to the exterior surface 64 of the footwear upper 40 at the vamp 62 and outward of the arced shield 820. The footwear plate 18 extends over the midsole 42 as described with respect to FIG. 5.

Figure 22:
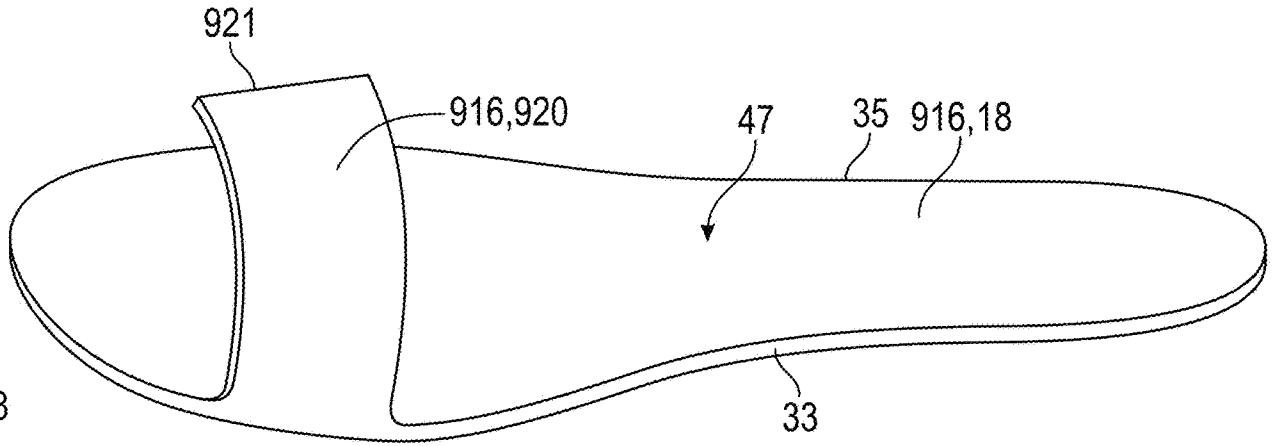
FIG. 22 is a medial perspective view of the device of FIG. 21.
Figure 21:
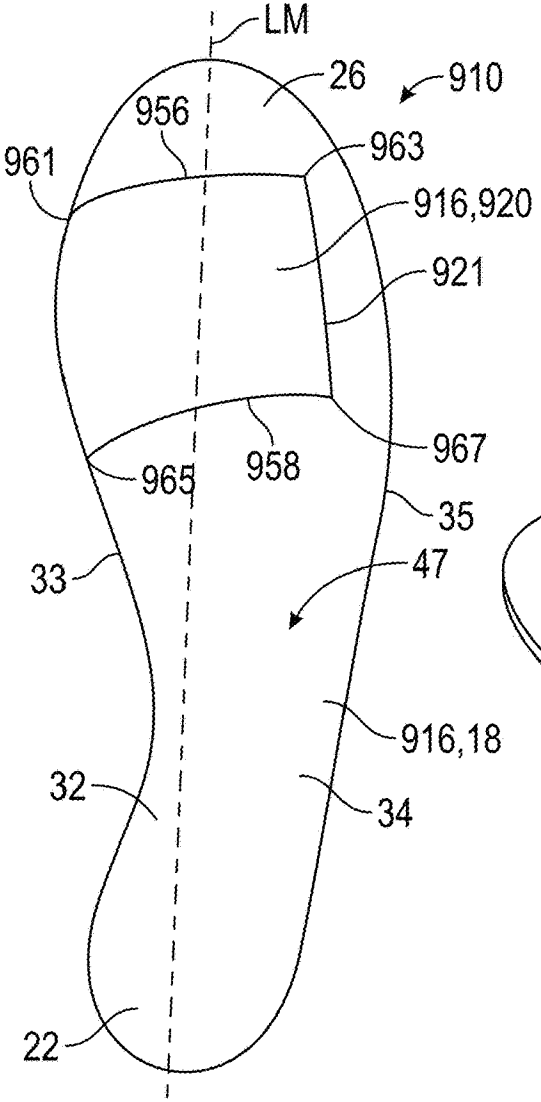
FIG. 21 is a plan view of a device for an article of footwear including a frame with a footwear plate and an arced shield that has a terminal end disposed over the superior surface of the footwear plate.

FIG. 21 is a plan view of a device 910 for an article of footwear including a frame 916 with the footwear plate 18 previously described and with an arced shield 920 integral with the footwear plate 18 (configured as a unitary, one-piece component) that has a terminal end 921 disposed over the superior surface 47 of the footwear plate 18. FIG. 22 is a medial perspective view of the device 910 of FIG. 21. The footwear plate 18 and the arced shield 920 are relatively rigid, and may include any of the materials described herein with respect to the frame 16 or with respect to any other device described herein.

The device 910 is similar to the previously described device 710, except that the arced shield 920 is used in place of arced shield 720. The arced shield 920 is configured to extend only partway across the superior portion of the wearer's foot when incorporated in an article of footwear. More specifically, the arced shield 920 is configured to extend transversely from the footwear plate 18 at least partially over a superior portion of the wearer's foot from the medial portion 32 of the footwear plate to the terminal end 921 disposed above the superior surface 47 of the footwear plate 18. In this implementation, the arced shield 920 extends from the medial portion 32 and/or the medial edge 33 of the footwear plate 18 and, although it extends over the lateral portion 34, does not extend to the lateral portion 34 and/or to the lateral edge 35 of the footwear plate 18.

The anterior edge 956 and the posterior edge 958 of the arced shield 920 slope forward in that the anterior extent 961 of the anterior edge 956 at the medial portion 32 is further rearward than the anterior extent 963 of the anterior edge 956 at the terminal end 921. Likewise, the anterior extent 965 of the posterior edge 958 at the medial portion 32 is further rearward than the anterior extent 967 of the posterior edge 958 at the terminal end 921.

When provided in an article of footwear, the arced shield 920 may extend partially over an exterior surface of a vamp of a footwear upper, or may be internal to the footwear upper similar to the placement of the arced shield 820 in FIGS. 19 and 20. Any of the joint connectors (e.g., joint connectors 70, 70A, etc.) described herein may be operatively connected to and/or secured at a superior surface of the arced shield 920.

By having the terminal end 921 disposed above the superior surface 47 of the footwear plate 18, the arced shield 920 may serve the functions of protecting the foot, distributing applied forces, etc., while minimizing added weight and, potentially, enabling easier foot insertion from the side of the footwear opposite that from which the arced shield 920 extends (e.g., foot entry from rearward of the arced shield 920 and moving forward and transversely inward from the lateral portion 34 in FIG. 21).

Figure 24:
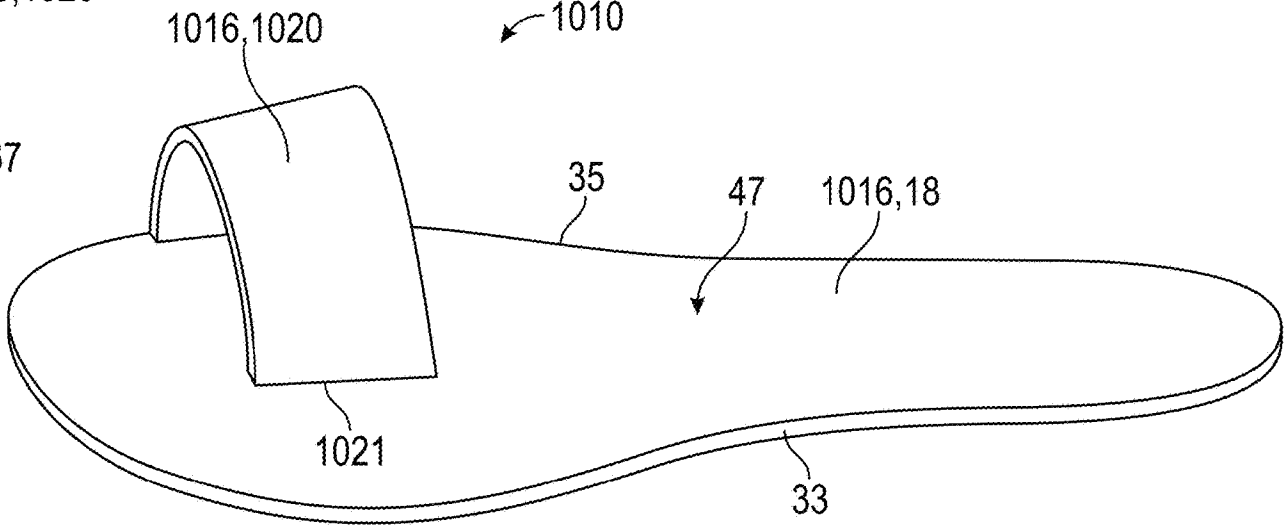
FIG. 24 is a medial perspective view of the device of FIG. 23.
Figure 23:
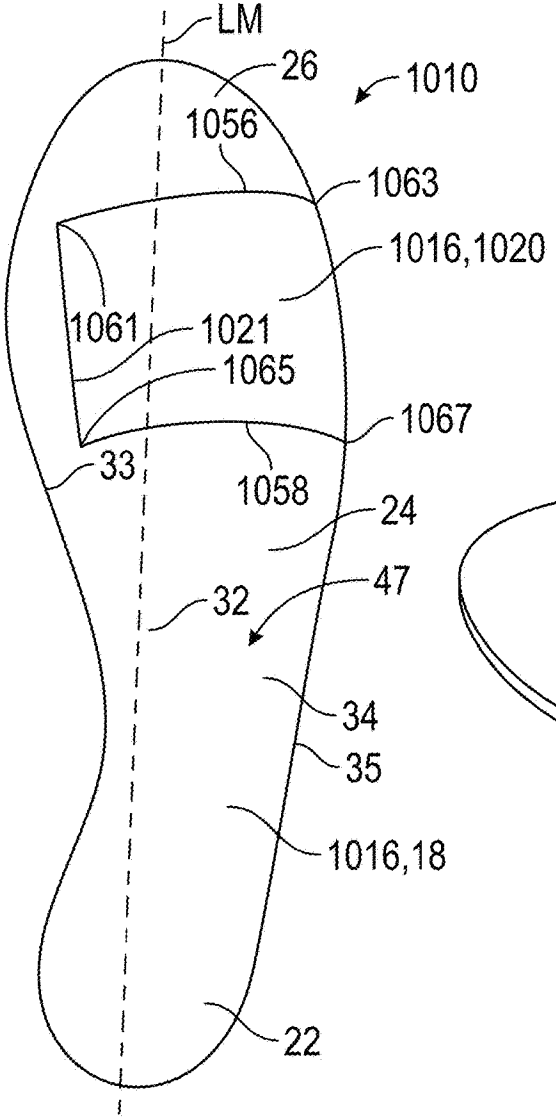
FIG. 23 is a plan view of a device for an article of footwear including a frame with a footwear plate and an arced shield that has a terminal end disposed over the superior surface of the footwear plate.

In an alternative implementation shown in FIGS. 23-24, a device 1010 for an article of footwear is provided in which an arced shield 1020 extends from a lateral side 34 and/or a lateral edge 35 of the footwear plate 18 and does not extend to a medial side 32 and/or a medial edge 33 of the footwear plate 18. More specifically, FIG. 23 is a plan view of a device 1010 for an article of footwear including a frame 1016 with the footwear plate 18 previously described and with an arced shield 1020 integral with the footwear plate 18 (configured as a unitary, one-piece component) that has a terminal end 1021 disposed over the superior surface 47 of the footwear plate 18. FIG. 24 is a medial perspective view of the device 1010 of FIG. 23. The footwear plate 18 and the arced shield 1020 are relatively rigid, and may include any of the materials described herein with respect to the frame 16 or with respect to any other device described herein.

The device 1010 is similar to the previously described device 910, except that the arced shield 1020 extends from the lateral edge 35 of the footwear plate 18 and does not extend to a medial side and/or a medial edge of the footwear plate; instead the terminal end 1021 is disposed over the superior surface of the footwear plate 18 at the medial portion 32. The arced shield 1020 is thus configured to extend only partway across the superior portion of the wearer's foot when incorporated in an article of footwear. More specifically, the arced shield 1020 is configured to extend transversely from the footwear plate 18 at least partially over a superior portion of the wearer's foot from the lateral portion 34 of the footwear plate to the terminal end 1021 disposed above the superior surface 47 of the footwear plate 18 and, although it extends over the medial portion 32, does not extend to the medial portion 32 or to the medial edge 33.

The anterior edge 1056 of the arced shield 1020 may slope slightly forward in that the anterior extent 1063 of the anterior edge 1056 at the lateral portion 34 may be further rearward than the anterior extent 1061 of the anterior edge 1056 at the terminal end 1021. Similarly, the posterior edge 1058 of the arced shield 1020 may slope slightly forward in that the anterior extent 1067 of the posterior edge 1058 at the lateral portion 34 may be further rearward than the anterior extent 1065 of the posterior edge 1058 at the terminal end 1021.

When provided in an article of footwear, the arced shield 920 may extend partially over an exterior surface of a vamp of a footwear upper, or may be internal to the footwear upper similar to the placement of the arced shield 820 in FIGS. 19 and 20. Any of the joint connectors (e.g., joint connectors 70, 70A, etc.) described herein may be operatively connected to and/or secured at a superior surface of the arced shield 920.

By having the terminal end 1021 disposed above the superior surface 47 of the footwear plate 18, the arced shield 1020 may serve the functions of protecting the foot, distributing applied forces, etc., while minimizing added weight and, potentially, enabling easier foot insertion from the side of the footwear opposite that from which the arced shield 1020 extends (e.g., foot entry from rearward of the arced shield 920 and moving forward and transversely inward from the medial portion 32 in FIG. 23).

Figure 25:
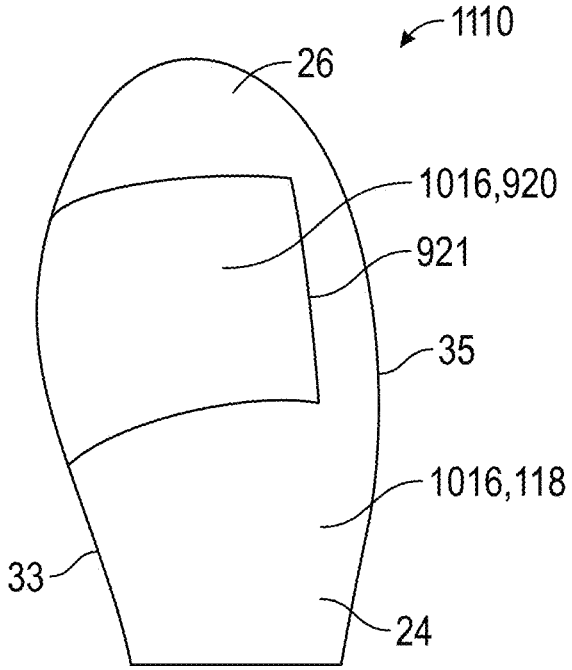
FIG. 25 is a plan view of an alternative device including a frame having a footwear plate with only a forefoot portion and midfoot portion and having the arced shield of the frame of FIG. 21.

FIG. 25 is a plan view of an alternative device 1110 including a frame 1016 having the footwear plate 118 described in FIG. 3 (having only a forefoot portion 26 and a midfoot portion 24) and having the arced shield 920 of the frame 916 of FIG. 21.

Figure 26:
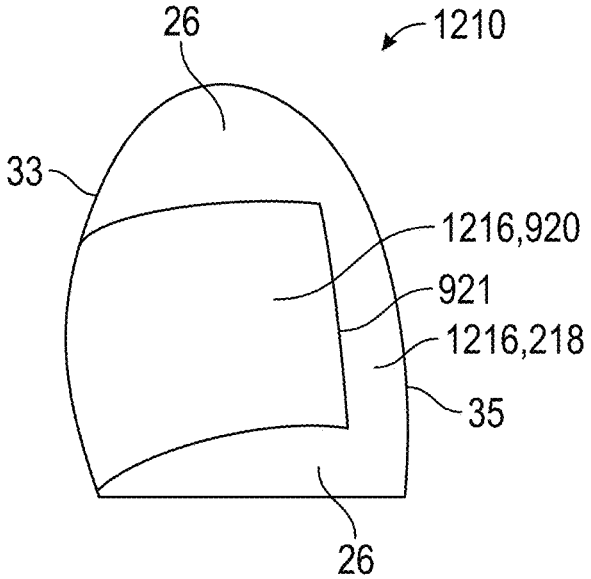
FIG. 26 is a plan view of a device for an article of footwear including a frame having a footwear plate with only a forefoot portion and having the arced shield of the frame of FIG. 21.

FIG. 26 is a plan view of a device 1210 for an article of footwear including a frame 1216 having the footwear plate 218 described in FIG. 4 (having only a forefoot portion 26) and having the arced shield 920 of the frame 916 of FIG. 21.

Figure 27:
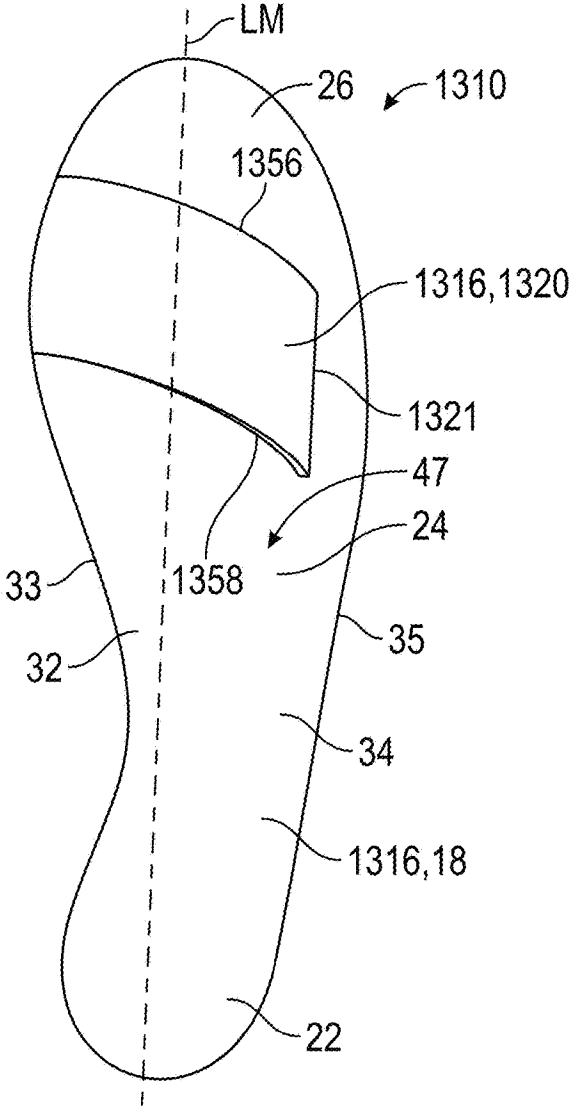
FIG. 27 is a plan view of a device for an article of footwear including a frame with a footwear plate and an arced shield that has a terminal end disposed over the superior surface of the footwear plate.

FIG. 27 is a plan view of a device 1310 for an article of footwear including a frame 1316 with the footwear plate 18 previously described and with an arced shield 1320 with a terminal end 1321 disposed over the superior surface 47 of the footwear plate 18. The arced shield 1320 is similar as described with respect to the arced shield 920 of FIG. 22 in that it extends from the medial portion 32 or medial edge 33 of the footwear plate 18 with the terminal end 1321 above the superior surface 47 at the lateral portion 34 without connecting to the lateral portion 34. However, an anterior edge 1356 and a posterior edge 1358 slope rearward from the medial edge 33 to the terminal end 1321.

Figure 28:
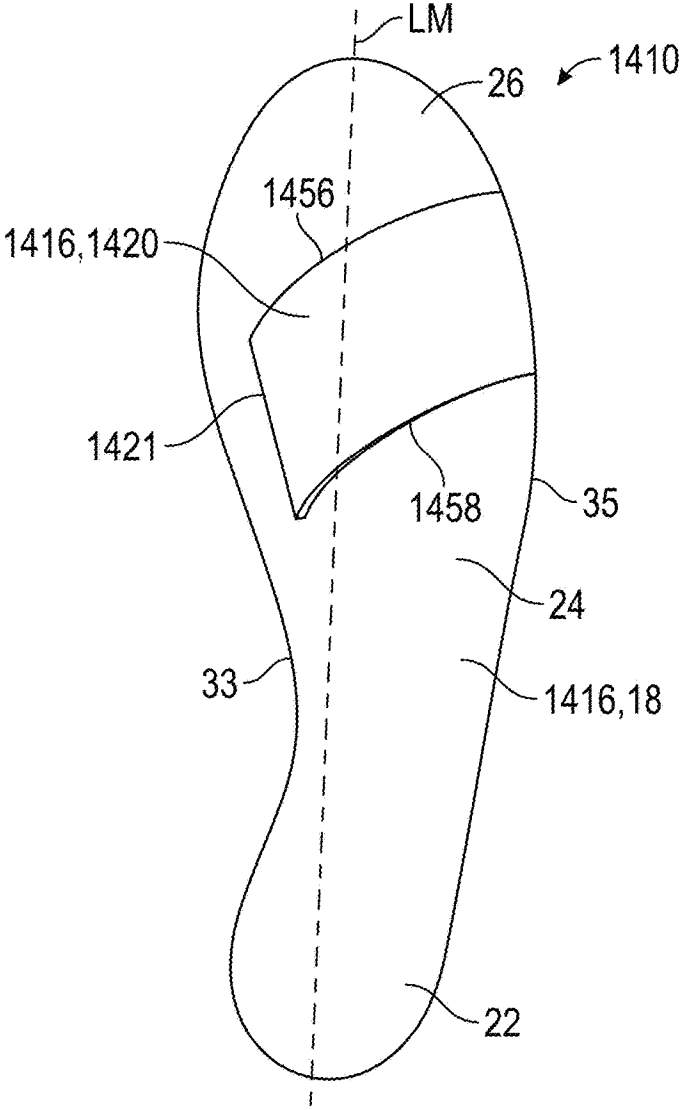
FIG. 28 is a plan view of a device for an article of footwear including a frame with a footwear plate and an arced shield that has a terminal end disposed over the superior surface of the footwear plate.

FIG. 28 is a plan view of a device 1410 for an article of footwear including a frame 1416 with the footwear plate 18 previously described and with an arced shield 1420 with a terminal end 1421 disposed over the superior surface 47 of the footwear plate 18. The arced shield 1420 is similar as described with respect to the arced shield 1020 of FIG. 23 in that it extends from the lateral portion 34 or lateral edge 35 of the footwear plate 18 with the terminal end 1421 above the superior surface 47 at the medial portion 32 without connecting at the medial portion 32. However, an anterior edge 1456 and a posterior edge 1458 slope rearward from the lateral edge 35 to the terminal end 1421 to a greater extent than do the corresponding anterior edge 1056 and posterior edge 1058 of the arced shield 1020.

Figure 29:
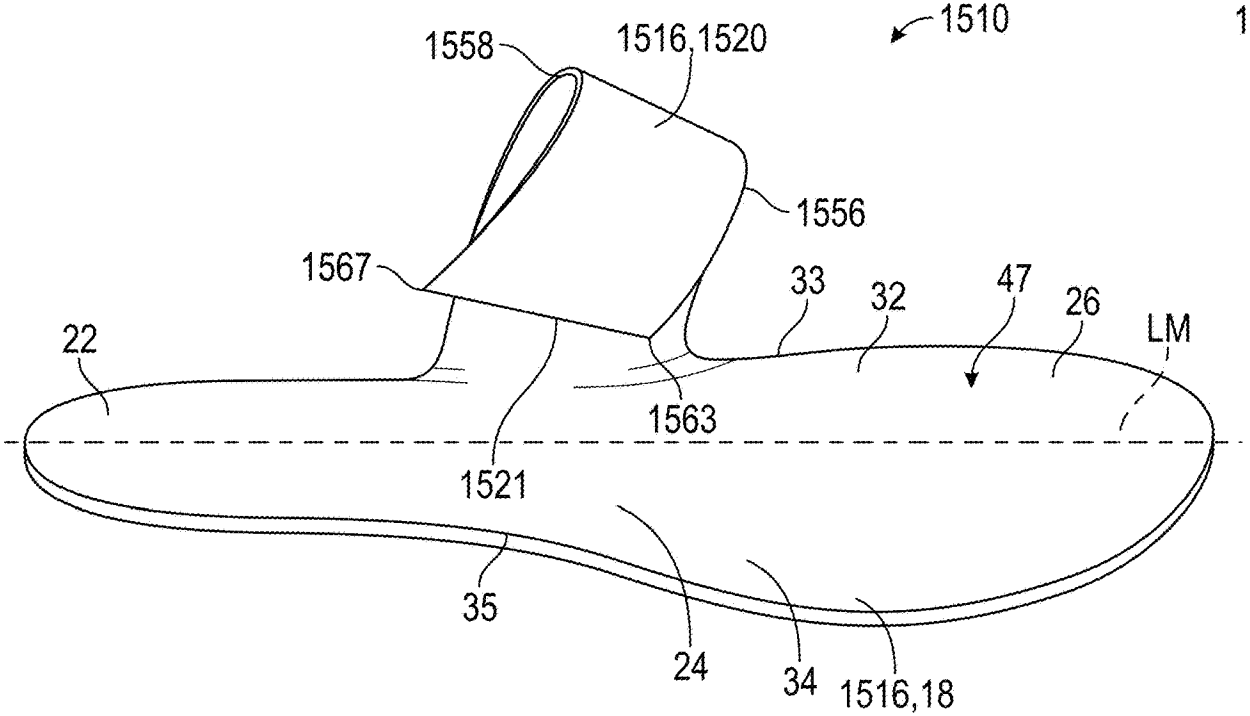
FIG. 29 is a lateral perspective view of a device for an article of footwear including a frame with a footwear plate and an arced shield that has a terminal end disposed over the superior surface of the footwear plate.

FIG. 29 is a lateral perspective view of a device 1510 for an article of footwear including a frame 1516 with the footwear plate 18 previously described and with an arced shield 1520 with a terminal end 1521 disposed over the superior surface 47 of the footwear plate 18. The arced shield 1520 is similar as described with respect to the arced shield 820 of FIGS. 17-18 except that it extends from the medial portion 32 or medial edge 33 of the footwear plate 18 with the terminal end 1521 above the superior surface 47 at the lateral portion 34 without connecting at the lateral portion 34. An anterior edge 1556 and a posterior edge 1558 are the same as described with respect to the anterior edge 856 and the posterior edge 858 except that the lateral extent 1563 of the anterior edge 1556 and the lateral extent 1567 of the posterior edge 1558 are at the terminal end 1521 rather than at the footwear plate 18.

Figure 30:
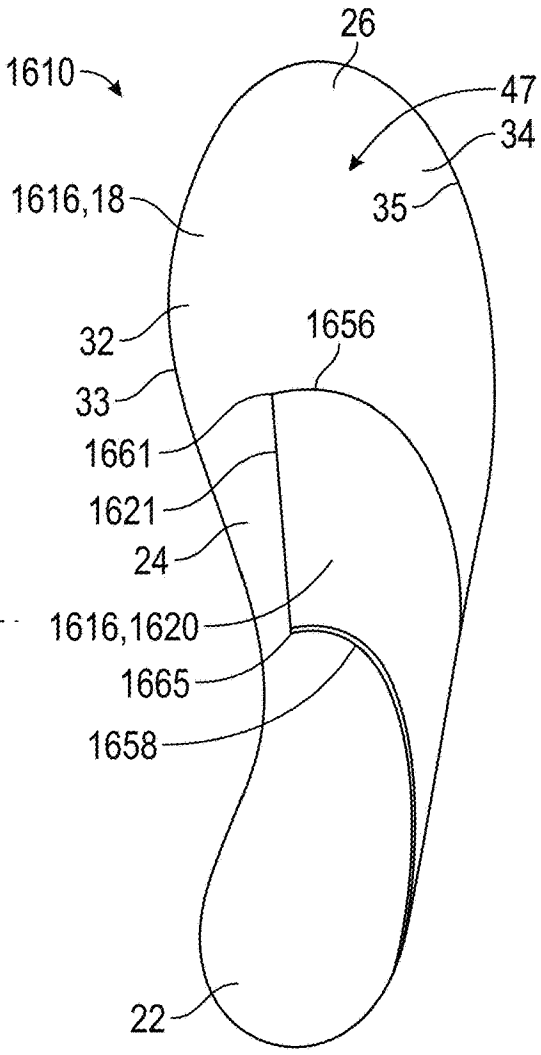
FIG. 30 is a plan view of a device for an article of footwear including a frame with a footwear plate and an arced shield that has a terminal end disposed over the superior surface of the footwear plate.

FIG. 30 is a plan view of a device 1610 for an article of footwear including a frame 1616 with the footwear plate 18 previously described and with an arced shield 1620 with a terminal end 1621 disposed over the superior surface 47 of the footwear plate 18. The arced shield 1620 is similar as described with respect to the arced shield 820 of FIGS. 17-18 except that it extends from the lateral portion 34 or lateral edge 35 of the footwear plate 18 with the terminal end 1621 above the superior surface 47 at the medial portion 32 without connecting at the medial portion 32. An anterior edge 1656 and a posterior edge 1658 are the same as described with respect to the anterior edge 856 and the posterior edge 858 except that the medial extent 1661 of the anterior edge 1656 and the medial extent 1665 of the posterior edge 1658 are at the terminal end 1621 rather than at the footwear plate 18.

Figure 31:
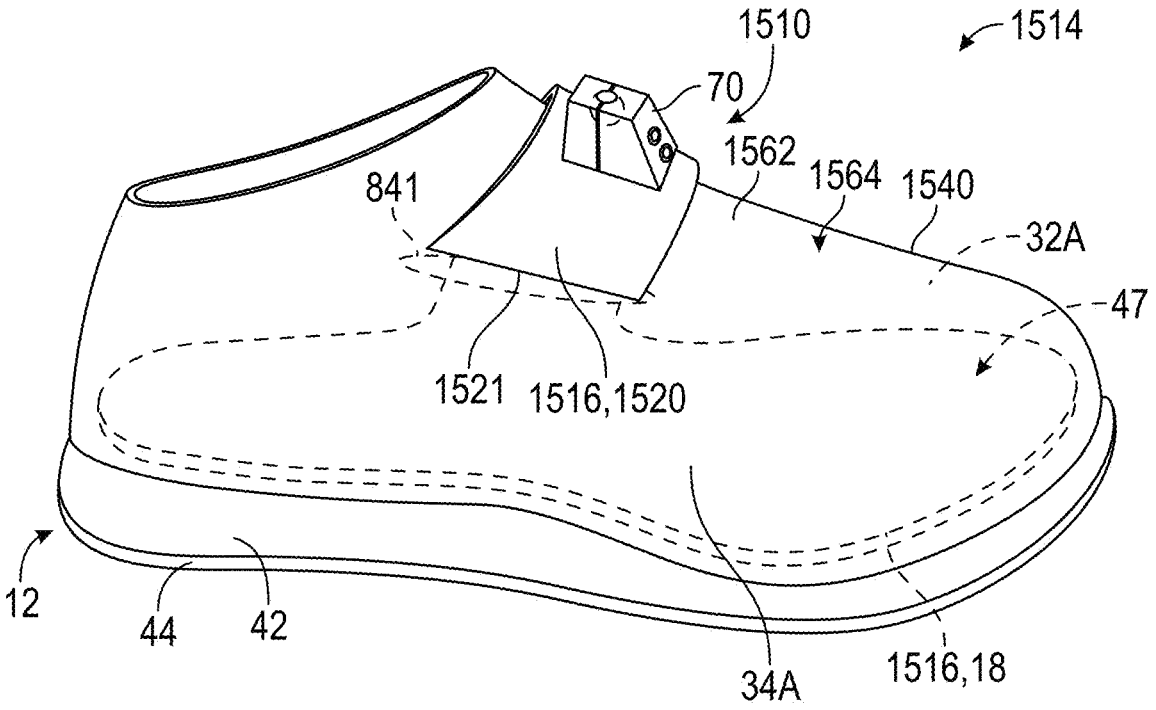
FIG. 31 is a lateral perspective view of an article of footwear including a footwear upper and a sole structure with the device of FIG. 29 disposed with the arced shield extending along an exterior surface of the vamp of the footwear upper and including the joint connector of FIG. 7.

FIG. 31 is a lateral perspective view of an article of footwear 1514 including a footwear upper 1540 and the sole structure 12 with the device 1510 of FIG. 29 disposed with the arced shield 1520 extending along an exterior surface 1564 of the vamp 1562 of the footwear upper 1540 and including the joint connector 70 of FIG. 11 secured to the arced shield 1520. Similar to the footwear upper 840, the footwear upper 1540 includes an opening 841 extending through the footwear upper 1540 so that the arced shield 1520 may extend along the exterior surface 1564 of the vamp 1562 of the footwear upper 1540. Only one opening 841 is indicated at the medial side 32A of the footwear upper 1540. The arced shield 1520 extends outward of the exterior surface 1564 of the footwear upper 1540 by extending from inside of the foot-receiving cavity 46 through the opening 841 in the footwear upper 1540, and extending over the exterior surface 1564 of the footwear upper 1540 between the location from which it extends through the footwear upper 1540 and the terminal end 1521 (e.g., between the opening 841 and the terminal end 1521). The footwear plate 18 extends over the midsole 42 as described with respect to FIG. 5.

Figure 32:
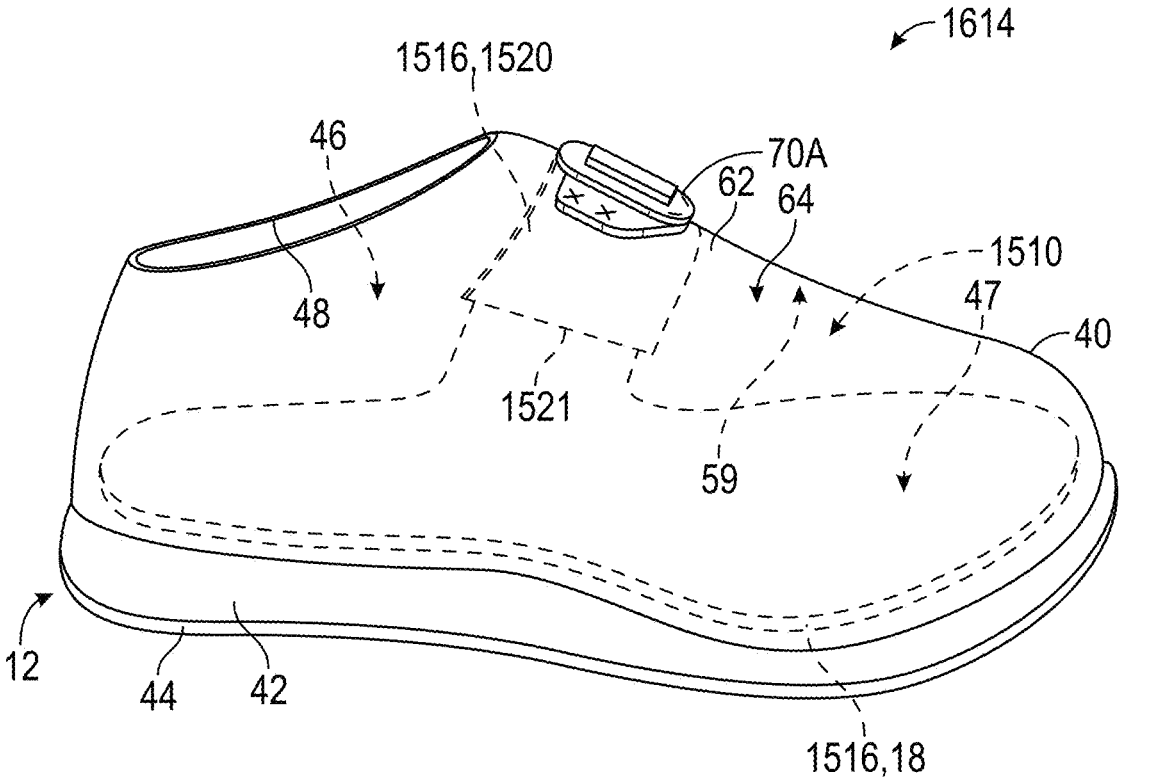
FIG. 32 is a lateral perspective view of an article of footwear including the device of FIG. 29 with the joint connector of FIG. 12.

FIG. 32 is a lateral perspective view of an article of footwear 1614 including the device 1510 of FIG. 29 with the joint connector 70A of FIG. 14. The arced shield 1520 extends along the interior surface 59 of the footwear upper 40 and the joint connector 70A is secured to the exterior surface 64 of the footwear upper 40 at the vamp 62 and outward of the arced shield 1520. The footwear plate 18 extends over the midsole 42 as described with respect to FIG. 5.

Figure 33:
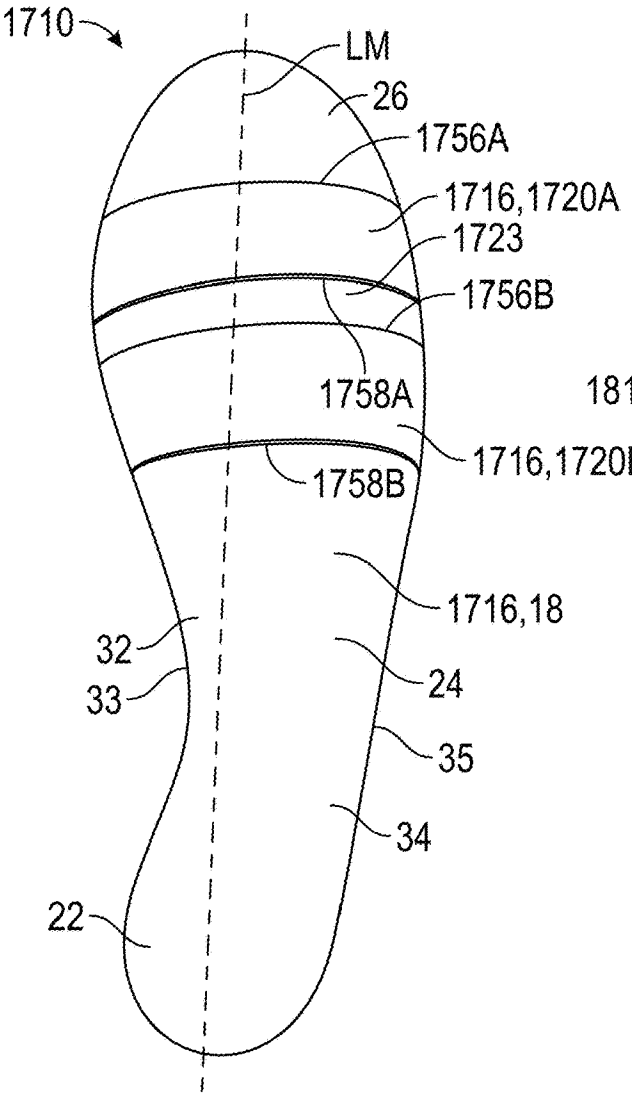
FIG. 33 is a plan view of a device for an article of footwear including a frame with a footwear plate, a first arced shield, and a second arced shield.

FIG. 33 is a plan view of a device 1710 for an article of footwear including a frame 1716 with the footwear plate 18 as described herein and with a first arced shield 1720A and a second arced shield 1720B. Both the first arced shield 1720A and the second arced shield 1720B are integral with the footwear plate 18 such that the frame 1716 is configured as a unitary, one-piece component. Both the first arced shield 1720A and the second arced shield 1720B extend transversely from the footwear plate 18 at least partially over a superior portion of the wearer's foot. The frame 1716, including the footwear plate 18 and the arced shields 1720A and 1720B are relatively rigid, and may include any of the materials described herein with respect to the frame 16 or with respect to any other device described herein.

In the embodiment shown in FIG. 33, both of the arced shields 1720A and 1720B extend from the medial portion 32 to the lateral portion 34 over the superior surface 47 of the footwear plate 18. More specifically, the first and second arced shields 1720A, 1720B both extend from the medial edge 33 to the lateral edge 35.

The first arced shield 1720A is disposed at least partially over the forefoot portion 26 of the footwear plate 18 forward of the second arced shield 1720B. The second arced shield 1720B is disposed at least partially over the midfoot portion 24 of the footwear plate 18. In the embodiment shown, the entire first arced shield 1720A, from its anterior edge 1756A to its posterior edge 1758A, is over the forefoot portion 26 of the footwear plate 18. The second arced shield 1720B extends over both the forefoot portion 26 and the midfoot portion 24, as its anterior edge 1756B is over the forefoot portion 26 while its posterior edge 1758B is over the midfoot portion 24. A gap 1723 separates the first and second arced shields 1720A and 1720B. More specifically, the gap 1723 extends completely along and separates the posterior edge 1758A of the first arced shield 1720A and the anterior edge 1756B of the second arced shield 1720B. Stated differently, the arced shields 1720A and 1720B are not connected to one another, but each are connected to the footwear plate 18. Additionally, because both of the arced shields 1720A, 1720B will extend over the instep of the wearer's foot when incorporated into an article of footwear with the posterior edge 1758B of the second arced shield 1720B forward of the ankle opening at the instep, an external force applied downward on either of the arced shields 1720A, 1720B should cause rotation at the wearer's ankle about a pivot axis like pivot axis A in FIG. 6, aiding plantar flexion.

Providing a frame with two arced shields, such as the frame 1716 with arced shields 1720A, 1720B, may help to distribute point loads while at the same time increasing the flexibility of the device 1710 in comparison to a device with a single arced shield extending the same fore/aft length as the two arced shields 1720A, 1720B (e.g., a device with a single arced shield having an anterior edge at the same position as anterior edge 1756A of the first arced shield 1720A and a posterior edge at the same position as the posterior edge 1758B of the second arced shield 1720B). By at least partially separating the two arced shields 1720A and 1720B, the gap 1723 between them decreases the resistance to bending of the device 1710 about a transverse axis aligned with the arced shields, such as at the wearer's metatarsal phalangeal joint.

Figure 34:
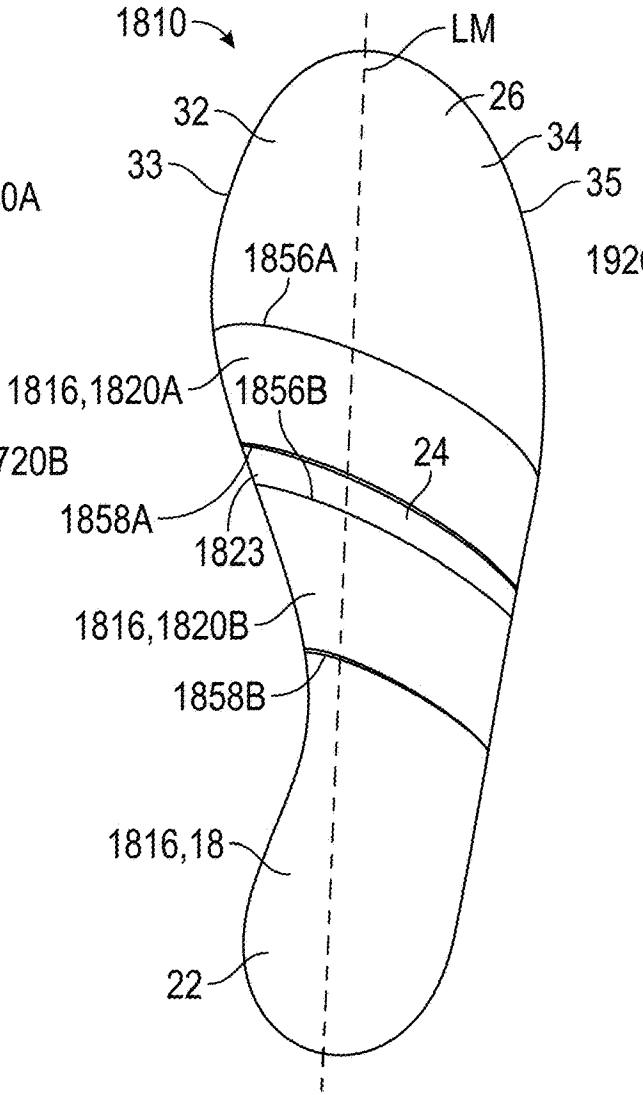
FIG. 34 is a plan view of a device for an article of footwear including a frame with a footwear plate, a first arced shield, and a second arced shield.

FIG. 34 is a plan view of a device 1810 for an article of footwear including a frame 1816 having the footwear plate 18 and having a first arced shield 1820A and a second arced shield 1820B separated from one another by a gap 1823 that extends completely along and separates the posterior edge 1858A of the first arced shield 1820A and the anterior edge 1856B of the second arced shield 1820B. The frame 1816 is constructed similarly to the frame 1716, providing the advantages discussed with respect to the frame 1716. The frame 1816 is different than the frame 1716 in that both of the arced shields 1820A and 1820B are further forward at the medial edge 33 than at the lateral edge 35. Stated differently, each of the anterior edge 1856A, posterior edge 1858A, anterior edge 1856B, and posterior edge 1858B extend rearward from the medial edge 33 to the lateral edge 35. This may provide case of donning from rearward of the second arced shield 1820B with the foot moving forward and transversely inward from the medial edge 33 toward the longitudinal midline LM.

The first arced shield 1820A extends partially over the forefoot portion 26 and the midfoot portion 24 of the footwear plate 18, and the second arced shield 1820B extends partially over the midfoot portion 24 and the heel portion 22 of the footwear plate 18. Additionally, because both of the arced shields 1820A, 1820B will extend over the instep of the wearer's foot when incorporated into an article of footwear with the posterior edge 1858B of the second arced shield 1820B forward of the ankle opening at the instep, an external force applied downward on either of the arced shields 1820A, 1820B should cause rotation at the wearer's ankle about a pivot axis like pivot axis A in FIG. 6, aiding in plantar flexion.

Figure 35:
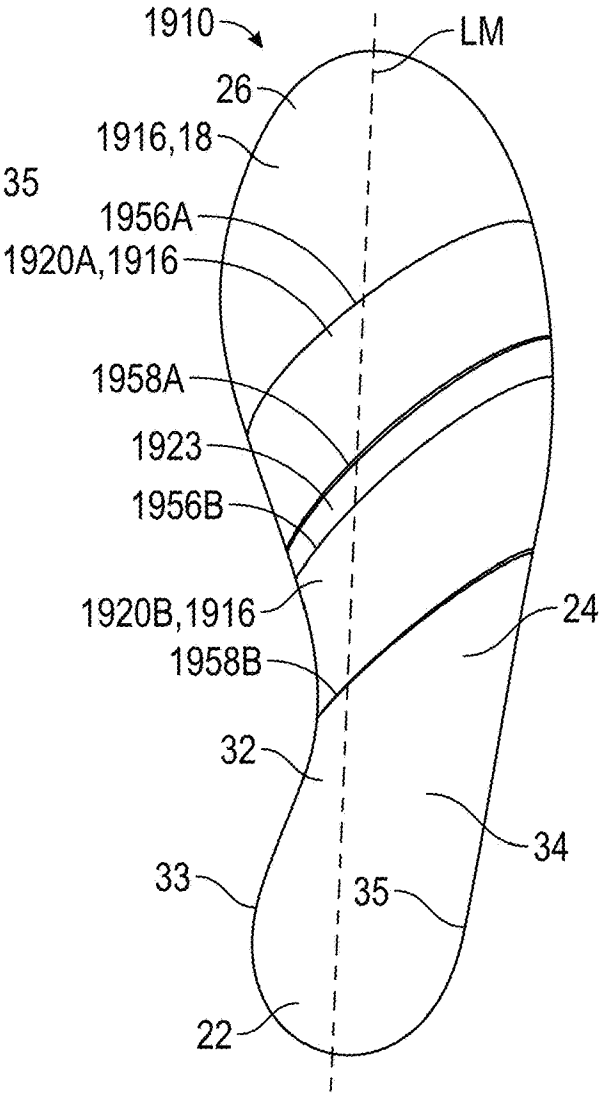
FIG. 35 is a plan view of a device for an article of footwear including a frame with a footwear plate, a first arced shield, and a second arced shield.

FIG. 35 is a plan view of a device 1910 for an article of footwear including a frame 1916 having the footwear plate 18 and having a first arced shield 1920A and a second arced shield 1920B separated from one another by a gap 1923 that extends completely along and separates the posterior edge 1958A of the first arced shield 1920A and the anterior edge 1956B of the second arced shield 1920B. The frame 1916 is constructed similarly to the frame 1716, providing the advantages discussed with respect to the frame 1716. The frame 1916 is different than the frame 1816 in that both of the arced shields 1920A and 1920B are further rearward at the medial edge 33 than at the lateral edge 35. Stated differently, each of the anterior edge 1956A, posterior edge 1958A, anterior edge 1956B, and posterior edge 1958B extend forward from the medial edge 33 to the lateral edge 35. This may provide case of donning from rearward of the second arced shield 1920B with the foot moving forward and transversely inward from the lateral edge 35 toward the longitudinal midline LM.

The first arced shield 1920A extends partially over the forefoot portion 26 and the midfoot portion 24 of the footwear plate 18, and the second arced shield 1920B extends partially over the midfoot portion 24 and the heel portion 22 of the footwear plate 18. Additionally, because both of the arced shields 1920A, 1920B will extend over the instep of the wearer's foot when incorporated into an article of footwear with the posterior edge 1958B of the second arced shield 1920B forward of the ankle opening at the instep, an external force applied downward on either of the arced shields 1920A, 1920B should cause rotation at the wearer's ankle about a pivot axis like pivot axis A in FIG. 6, aiding in plantar flexion.

Figure 36:
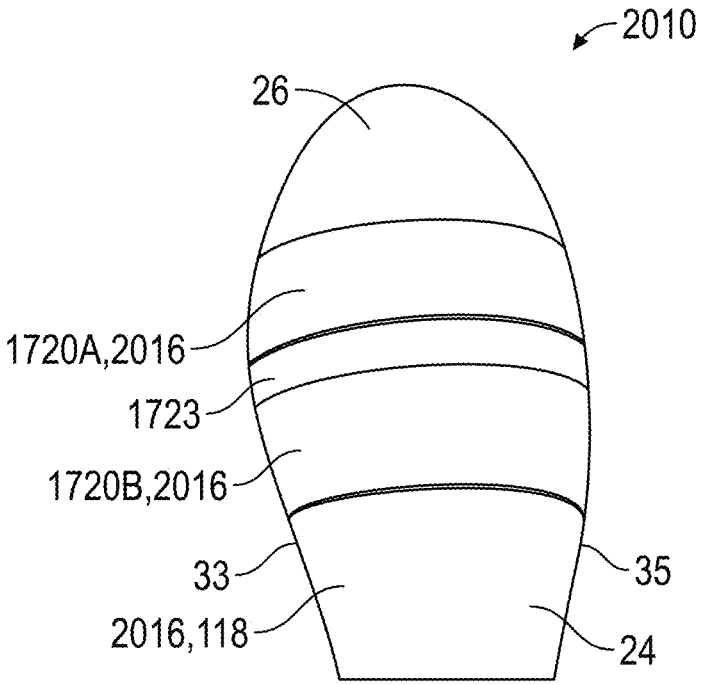
FIG. 36 is a plan view of a device for an article of footwear including a frame having a footwear plate with only a forefoot portion and midfoot portion and having the arced shield of the frame of FIG. 33.

FIG. 36 is a plan view of an alternative device 2010 including a frame 2016 having a footwear plate 118 described in FIG. 3 (having only a forefoot portion 26 and a midfoot portion 24) and having the first and second arced shields 1720A, 1720B of the frame 1716 of FIG. 33.

Figure 37:
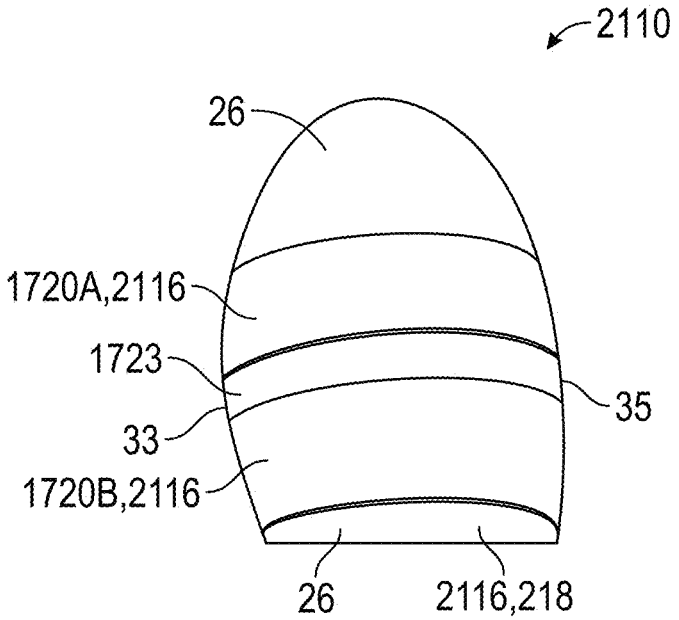
FIG. 37 is a plan view of a device for an article of footwear including a frame having a footwear plate with only a forefoot portion and having the arced shield of the frame of FIG. 33.

FIG. 37 is a plan view of a device 2110 for an article of footwear including a frame 2116 having the footwear plate 218 described in FIG. 4 (having only a forefoot portion 26) and having the first and second arced shields 1720A, 1720B of the frame 1716 of FIG. 33.

Figure 38:
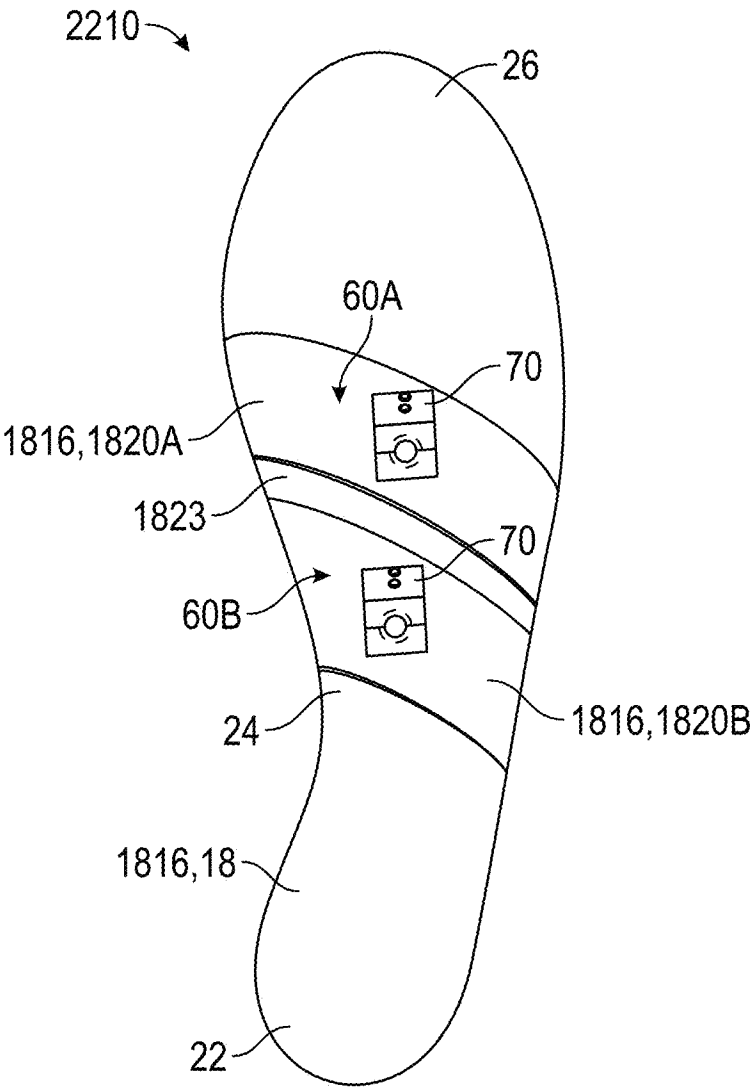
FIG. 38 is a plan view of the device of FIG. 34 with a first joint connector like the joint connector of FIG. 11 secured at the first arced shield and a second joint connector like the joint connector of FIG. 11 secured at the second arced shield.

FIG. 38 is a plan view of a device 2210 for an article of footwear like the device 1810 of FIG. 34 with a first joint connector 70 secured at the superior surface 60A of the first arced shield 1820A and a second joint connector 70 secured at the superior surface 60B of the second arced shield 1820B. Both of the first joint connector 70 and the second joint connector 70 may be identical to one another and to the joint connector 70 described with respect to FIG. 8, for example.

Providing two joint connectors 70 allows for the option of providing different mechanical advantages when applying an external force to the device 1810. For example, the second arced shield 1820B and joint connector 70 thereon which are further rearward than the first arced shield 1820A and joint connector 70 thereon will provide a shorter lever relative to the wearer's ankle joint (such as relative to axis A of FIG. 6) in comparison to the first joint connector 70 on the first arced shield 1820A. The greater mechanical advantage achieved by the longer lever afforded by applying an external force to the first arced shield 1820A via the first (forwardmost) joint connector 70 may be more suitable for certain activities, whereas the lesser mechanical advantage of applying external force to the second arced shield 1820B via the second (rearmost) joint connector 70 may be more suitable for other activities.

Figure 39:
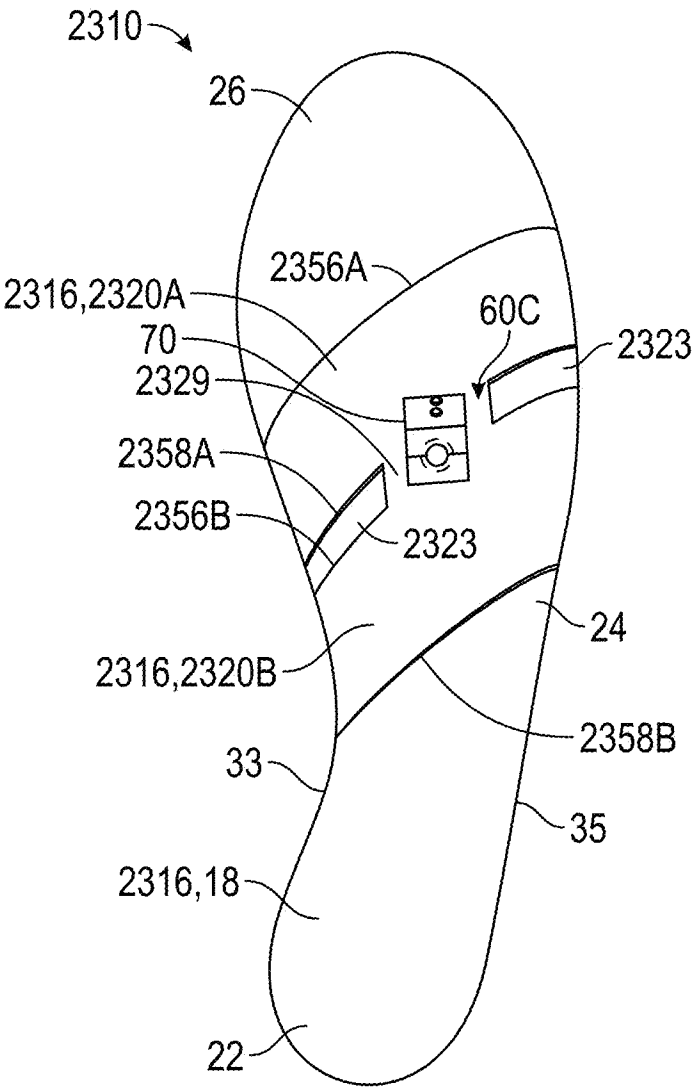
FIG. 39 is a plan view of a device for an article of footwear including a frame with a footwear plate, a first arced shield, a second arced shield, and a bridge connecting the first arced shield and the second arced shield.

FIG. 39 is a plan view of a device 2310 for an article of footwear including a frame 2316 with the footwear plate 18 described herein and with a first arced shield 2310A, a second arced shield 2310B, and a bridge 2329 connecting the first arced shield 2320A and the second arced shield 2320B. The bridge 2329 spans a gap 2323 from the posterior edge 2358A of the first arced shield 2320A to an anterior edge 2356B of the second arced shield 2320B. The arced shields 2320A and 2320B are similar in shape and position to the arced shields 1920A and 1920B of FIG. 35 in that each of the anterior edge 2356A and the posterior edge 2358A of the first arced shield 2320A as well as the anterior edge 2356B and the posterior edge 2358B of the second arced shield 2320B extend forward from the medial edge 33 to the lateral edge 35 of the footwear plate 18. This may provide case of donning from rearward of the second arced shield 1820B with the foot moving forward and transversely inward from the lateral edge 35 toward the longitudinal midline LM (such as the longitudinal midline LM shown in FIG. 35). Additionally, the first arced shield 2320A extends partially over the forefoot portion 26 and the midfoot portion 24 of the footwear plate 18, and the second arced shield 2320B extends partially over the midfoot portion 24 and the heel portion 22 of the footwear plate 18.

The bridge 2329 integrally connects the first arced shield 2320A and the second arced shield 2320B. The device 2310 also includes a joint connector 70, as described in FIG. 8, with the joint connector 70 secured at a superior surface 60C of the bridge 2329. In such an example, at least some of the increased flexibility of providing two arced shields as opposed to one larger arced shield may be realized, and the distribution of external forces applied at the joint connector 70 is afforded at least in part via the bridge 2329. Stated differently, the bridge 2329 may distribute (e.g., spread) an external force acting on the bridge 2329 via the joint connector 70 at least partially to both of the arced shields 2320A and 2320B to lessen the potential of point loads transferred to the wearer's foot.

Figure 40:
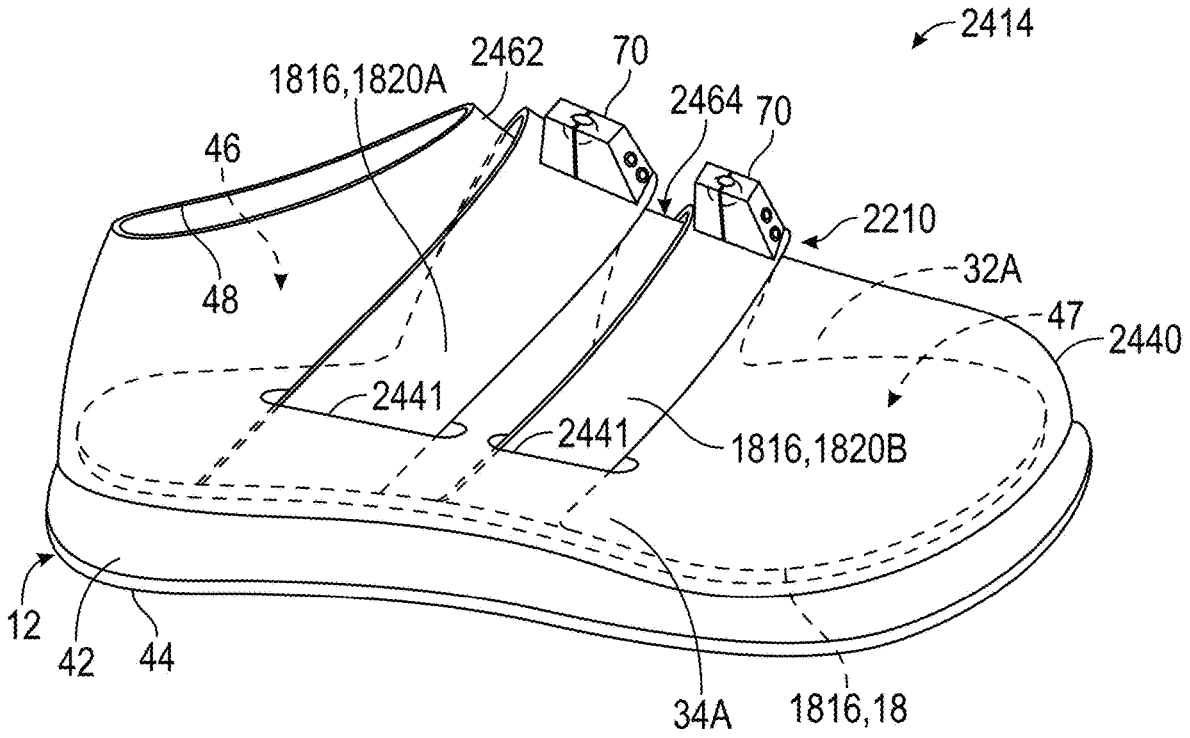
FIG. 40 is a lateral perspective view of an article of footwear including the device and the joint connectors of FIG. 38.

FIG. 40 is a lateral perspective view of an article of footwear 2414 including the device 2210 and the first and second joint connectors 70 of FIG. 38. The article of footwear 2414 includes a footwear upper 2440 and the sole structure 12 described herein disposed with the arced shields 1820A, 1820B extending along an exterior surface 2464 of the vamp 2462 of the footwear upper 2440. Similar to the footwear upper 240, openings 2441 extend through the footwear upper 2440 so that each of the arced shields 1820A, 1820B may extend along the exterior surface 2464 of the vamp 2462 of the footwear upper 2440. Only one set of openings 2441 is shown at the lateral side 34A of the footwear upper 2440, but a like set of openings 2441 extends at the medial side 32A. The arced shields 1820A and 1820B extend outward of the exterior surface 2464 of the footwear upper 2440 by extending from inside of the foot-receiving cavity 46 through the openings 2441 in the footwear upper 2440 at or near one or both of the medial and lateral sides 32A, 34A of the footwear upper 2440, and extending over the exterior surface 2464 of the footwear upper 2440 between the locations from which it extends through the footwear upper 2440 (e.g., between the openings 2441). The footwear plate 18 extends over the midsole 42 as described with respect to FIG. 5.

Figure 41:
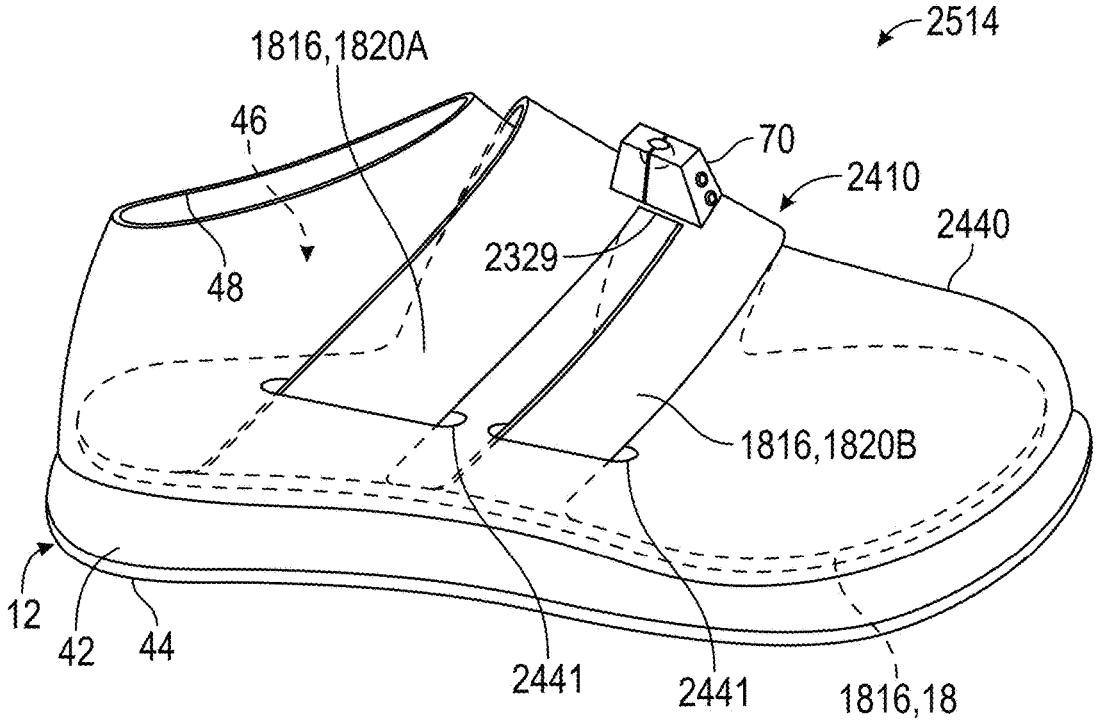
FIG. 41 is a lateral perspective view of an article of footwear including a device with the footwear plate, the first arced shield, and the second arced shield of the footwear plate of FIG. 34, with the bridge of FIG. 39 connecting the first and second arced shields, and with the joint connector of FIG. 11 secured at the bridge.

FIG. 41 is a lateral perspective view of an article of footwear 2514 including the footwear upper 2440 of FIG. 40 and a device 2410 like the device 2210 of FIG. 38 but with a bridge 2329 as described in FIG. 39 connecting the first and second arced shields 1820A and 1820B, and with the joint connector 70 of FIG. 11 secured at the bridge 2329.

Figure 42:
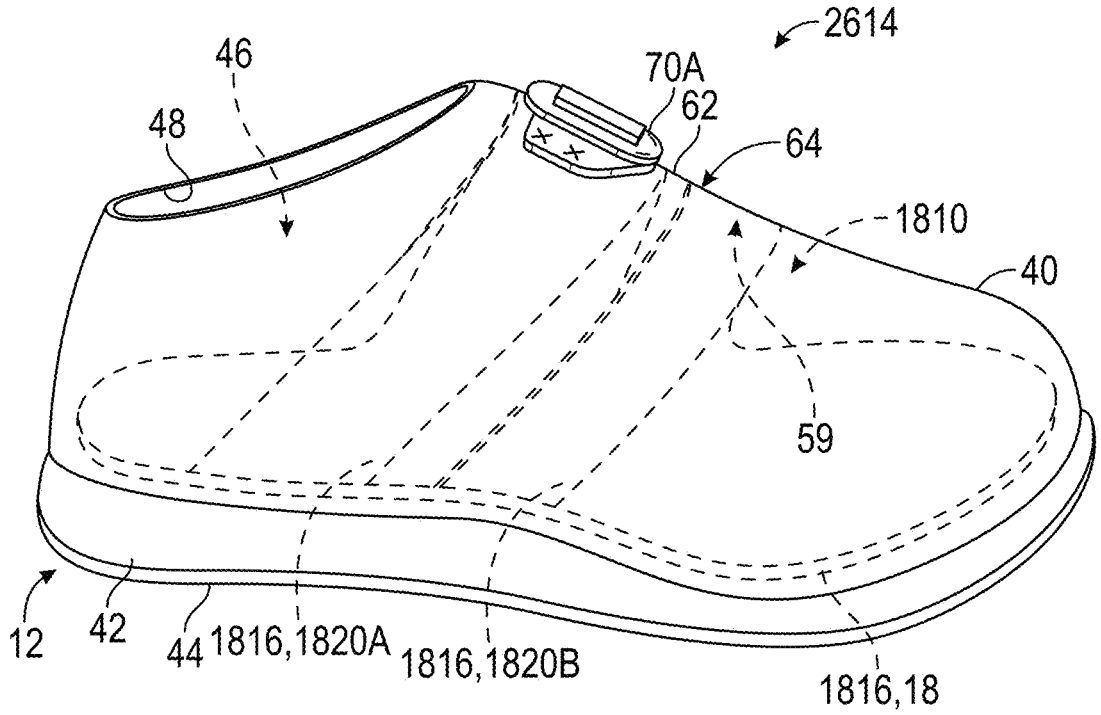
FIG. 42 is a lateral perspective view of an article of footwear including the device of FIG. 34 and the joint connector of FIG. 11.

FIG. 42 is a lateral perspective view of an article of footwear 2614 including the footwear upper 40 and the sole structure 12 described herein with the device 1810 of FIG. 34 and the joint connector 70A of FIG. 11. The arced shields 1820A, 1820B extend along the interior surface 59 of the footwear upper 40. The joint connector 70A is secured to the exterior surface 64 of the footwear upper 40 at the vamp 62 and outward of the arced shield 1820A. The footwear plate 18 extends over the midsole 42 as described with respect to FIG. 5.

Figure 43:
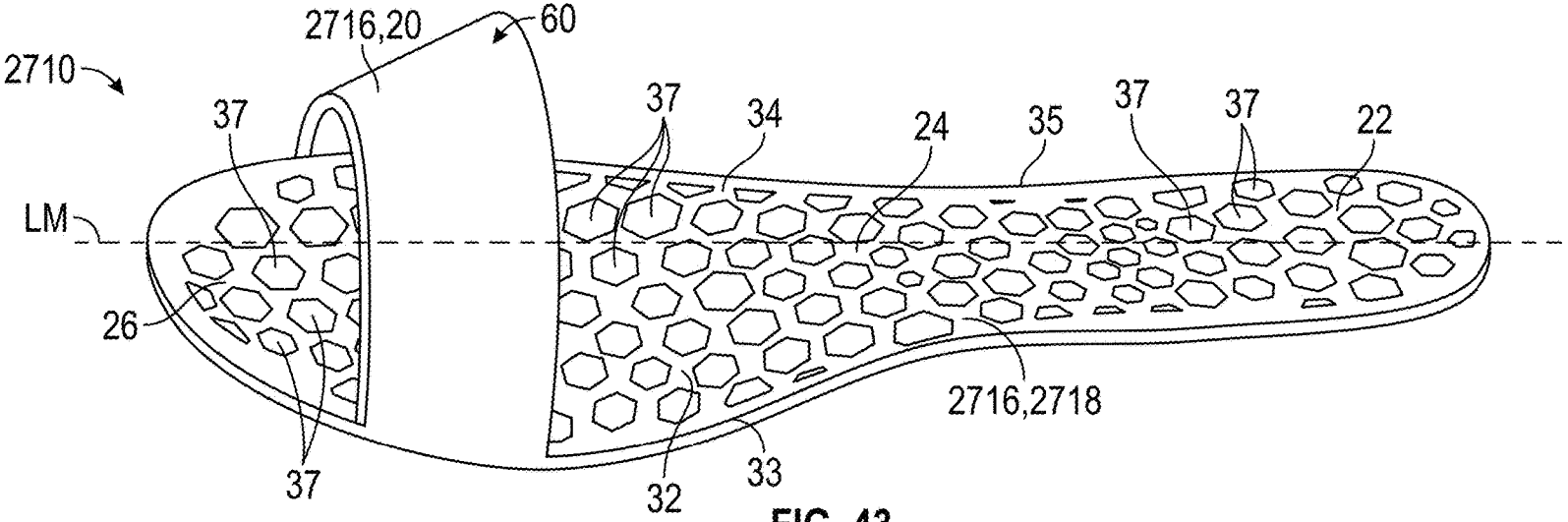
FIG. 43 is a medial perspective view of a device for an article of footwear including a frame having a cellular plate and having the arced shield of FIG. 1.

FIG. 43 is a medial perspective view of a device 2710 for an article of footwear including a frame 2716. The frame 2716 has a footwear plate 2718 and has the arced shield 20 described with respect to FIG. 1. The arced shield 20 is integral with the footwear plate 2718 and is configured to extend from the footwear plate 2718 at least partially over a superior portion of the wearer's foot. The footwear plate 2718 and the arced shield 20 are integrally formed as a unitary, one-piece structure. The footwear plate 2718 and the arced shield 20 are relatively rigid, and may include any of the materials described herein with respect to the frame 16 or with respect to any other device described herein. The arced shield 20 extends transversely over the footwear plate 2718 from the lateral portion 34 of the footwear plate 2718 to the medial portion 32 of the footwear plate 2718 and is connected to both the medial portion 32 and the lateral portion 34. For example, the arced shield 20 connects to the footwear plate 2718 at the lateral edge 35 and at the medial edge 33 of the footwear plate 2718. A joint connector, such as any of the joint connectors disclosed herein, may be operatively connected to and/or secured at the frame 2716, such as operatively connected to a superior surface 60 of the arced shield 20.

The footwear plate 2718 may referred to herein as a cellular plate or a cellular footwear plate, and may provide the advantage of minimizing added weight to an article of footwear while increasing plate strength. The cellular footwear plate 2718 is configured to extend at least partially along and under a sole of a wearer's foot, like footwear plate 18 in FIG. 6. However, rather than being a solid, unitary expanse throughout the forefoot portion 26, midfoot portion 24, and heel portion 22 as is footwear plate 18, the cellular footwear plate 2718 includes a matrix structure that defines a plurality of open cells 37, only some of which are labelled in FIG. 43. The open cells 37 are distributed throughout each of the forefoot portion 26, the midfoot portion 24, and the heel portion 22. A matrix structure with a plurality of open cells 37 may be of a lesser weight and a greater strength in comparison to a solid structure of a similar thickness. A matrix structure allows for the possibility of different, lighter weight materials to be used that may result in the footwear plate 2718 having the same or greater strength than a solid plate like plate 18 of similar thickness and for which heavier materials are used. For example, the footwear plate 2718 could include a plastic material rather than a carbon fiber composite (although in some embodiments a carbon fiber composite may be used).

The matrix structure may be provided by computerized design of the size and shape of the various open cells 37, a height of the footwear plate 2718, and a thickness of the footwear plate 2718 surrounding each of the cells 37 to achieve a particular desired stiffness profile in the different portions of the footwear plate 2718 (e.g., in the forefoot portion 26, the midfoot portion 24, and the heel portion 22, and at the medial portion 32 and the lateral portion 34). For example, a particular design of the cell size and shape, and of the thickness and height of the footwear plate 2718 may be used for every two size increments. For a larger increment in footwear sizes, it may be preferable to provide a separate computerized design of these features. United States Patent Publication 2018/0153264A1 to Amos et al., published Jun. 7, 2018, which is incorporated by reference herein in its entirety, include many features of cellular plates that may be used in the cellular footwear plate 2718 and/or in the other cellular plates disclosed herein. United States Patent Publication 2018/0153254A1 to Fusco et al., published Jun. 7, 2018, and U.S. Pat. No. 10,045,588 to Berend et al. issued Aug. 14, 2018, are also incorporated by reference herein in their entirety, and includes many features of cellular plates that may be used in the cellular plate 2718 and/or in the other cellular plates disclosed herein.

As shown in FIG. 43, at least some of the various cells 37 are polygonal. For example, at least some of the cells 37 are hexagonal. At least some of the various hexagonal shapes may not have six side of equal lengths, but instead may be irregular hexagons that are elongated or otherwise deviate from a regular hexagon with six sides of equal length. Additionally, the cells 37 may be of different sizes and shapes in each of the forefoot portion 26, the midfoot portion 24, and the heel portion 22, as well as in the medial portion 32 and the lateral portion 34, as shown.

The footwear plate 2718 is a full-length plate (e.g., has a forefoot portion 26, a midfoot portion 24, and a heel portion 22). As with all of the full-length footwear plates described herein, the full-length footwear plate such as footwear plate

2718 having the matrix structure may increase the bending stiffness relative to a shorter plate, and thus may be most suitable for use in an article of footwear configured for sprinting, for example, as sprinting is accomplished mainly using the forefoot region of an article of footwear. Flexing of the sole structure 12 may be less for sprinting as compared to distance running. In an article of footwear configured for distance running, the wearer often has a heel impact and a heel to toe transition is made with each stride. The footwear plate in an embodiment for distance running may thus be shorter than in an article of footwear used for sprinting, perhaps having only a forefoot portion 26, or only a forefoot portion 26 and a midfoot portion 24, or having a forefoot portion 26, a midfoot portion 24, and a heel portion 22, but a narrow heel portion 22 or a heel portion 22 with an aperture to allow for more direct engagement of the wearer's foot with resilient foam portions of a midsole during a heel strike, for example.

Figure 44:
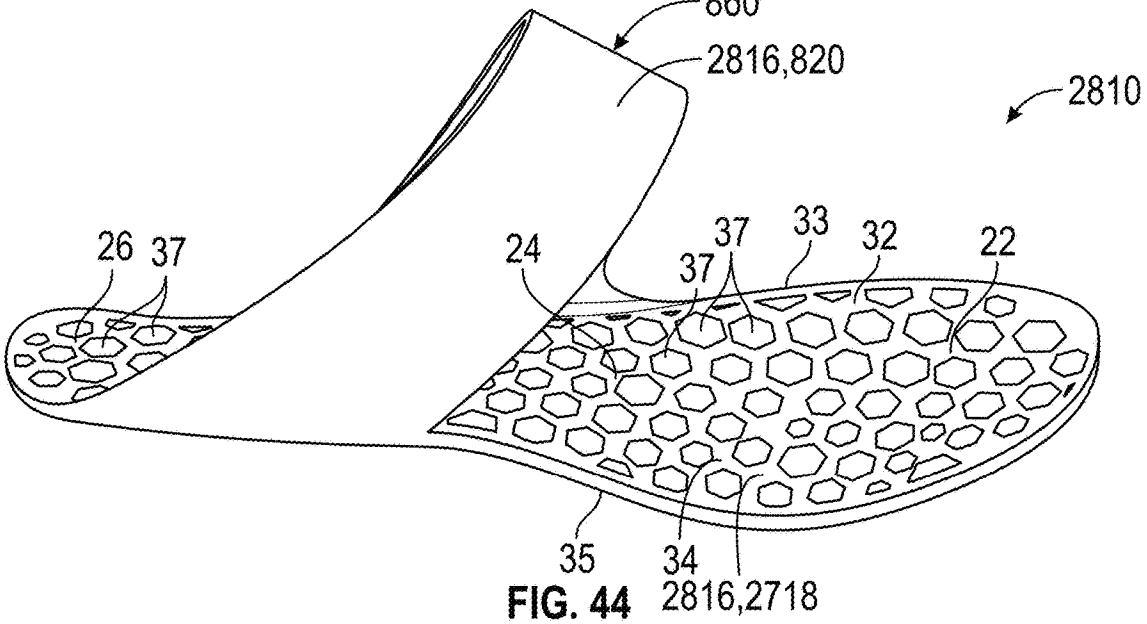
FIG. 44 is a lateral perspective view of a device for an article of footwear including a frame having a cellular plate and having the arced shield of FIG. 17.

FIG. 44 is a lateral perspective view of a device 2810 for an article of footwear including a frame 2816 with the cellular plate 2718 of FIG. 43 and the arced shield 820 of FIG. 17. The arced shield 820 is integral with the footwear plate 2718 and is configured to extend from the footwear plate 2718 at least partially over a superior portion of the wearer's foot. The footwear plate 2718 and the arced shield 820 are integrally formed as a unitary, one-piece structure. The footwear plate 2718 and the arced shield 820 are relatively rigid, and may include any of the materials described herein with respect to the frame 16 or with respect to any other device described herein. The arced shield 820 extends transversely over the footwear plate 2718 from the lateral portion 34 of the footwear plate 2718 to the medial portion 32 of the footwear plate 2718 and is connected to both the medial portion 32 and the lateral portion 34. For example, the arced shield 820 connects to the footwear plate 2718 at the lateral edge 35 and at the medial edge 33 of the footwear plate 2718. A joint connector, such as any of the joint connectors disclosed herein, may be operatively connected to and/or secured at the frame 2816, such as operatively connected to a superior surface 860 of the arced shield 820.

Figure 45:
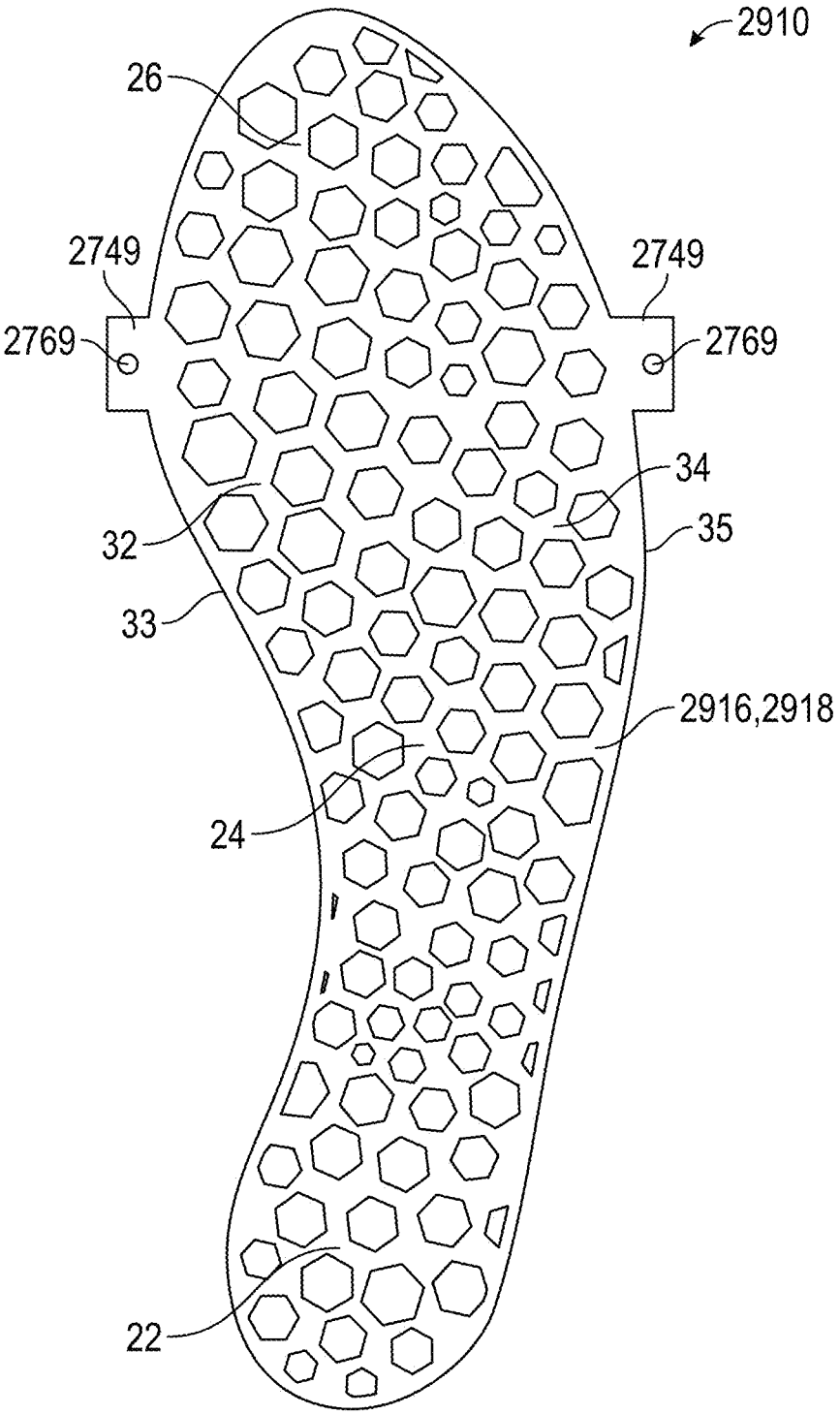
FIG. 45 is a plan view of a device for an article of footwear including a frame with a cellular plate.

FIG. 45 is a plan view of a device 2910 for an article of footwear including a frame 2916 with a footwear plate 2918. The footwear plate 2918 is a cellular plate, and may be referred to as cellular plate 2918 or cellular footwear plate 2918 herein. The cellular plate 2918 is the same as cellular plate 2718 except that attachment features 2749 are provided at the medial portion 32 and at the lateral portion 34. Specifically, the attachment features 2749 are provided as flanges extending transversely outward at the medial edge 33 and the lateral edge 35 of the cellular plate 2918. The attachment features 2749 each include an opening 2769 at which a component for applying an external force may be connected, for example. The attachment features 2749 with the openings 2769 may function as joint connectors. Alternatively, the attachment features may be for attaching a selectively attachable and detachable arced shield configured like any of the arced shields described herein except having added corresponding flanges with openings to receive an attachment device such as a fastener. In another alternative, the attachment features 2749 may instead be configured like any of those disclosed in United States Patent Publication 2023/0124653A1, Farina et al., published Apr. 20, 2023, which is incorporated by reference herein in its entirety. A downward external force applied at the attachment features 2749 should result in forward rotation about the pivot axis A of the ankle shown in FIG. 6 (e.g., plantar flexion). In an example, an exoskeleton may be operatively attached at the attachment features 2749, with the exoskeleton providing the external force that assists with plantar flexion.

Figure 46:
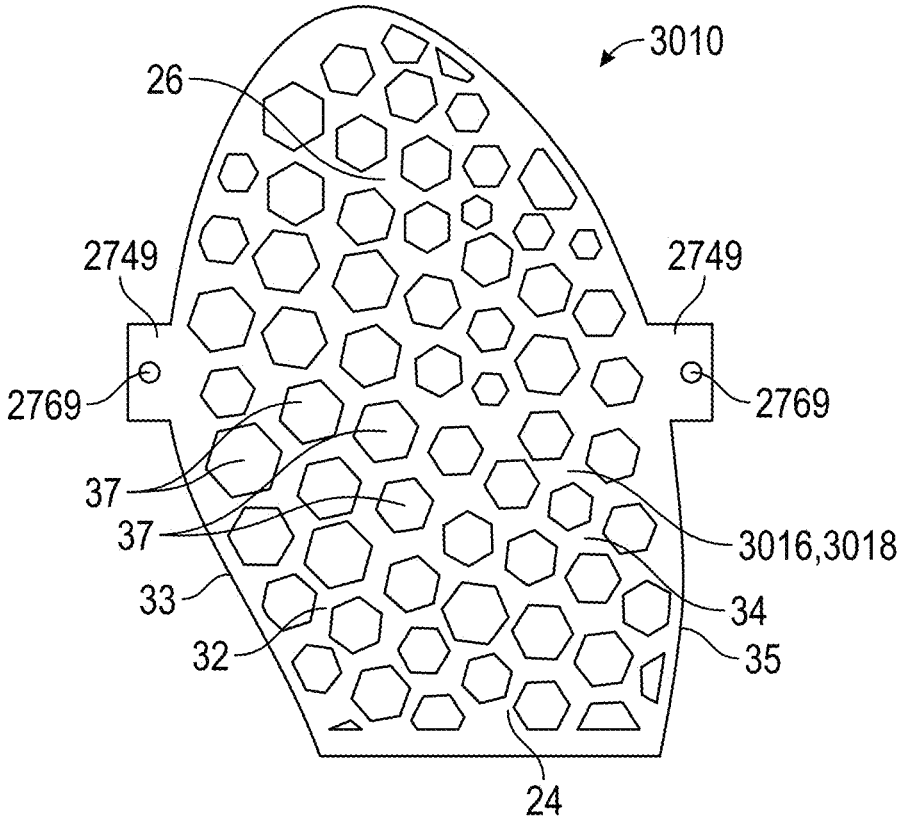
FIG. 46 is a plan view of a device for an article of footwear including a frame having a cellular plate with only a forefoot portion and midfoot portion.

FIG. 46 is a plan view of an alternative device 3010 including a frame 3016 having a cellular plate 3018 similar to cellular plate 2918 but having only a forefoot portion 26 and a midfoot portion 24 (e.g., having no heel portion 22).

Figure 47:
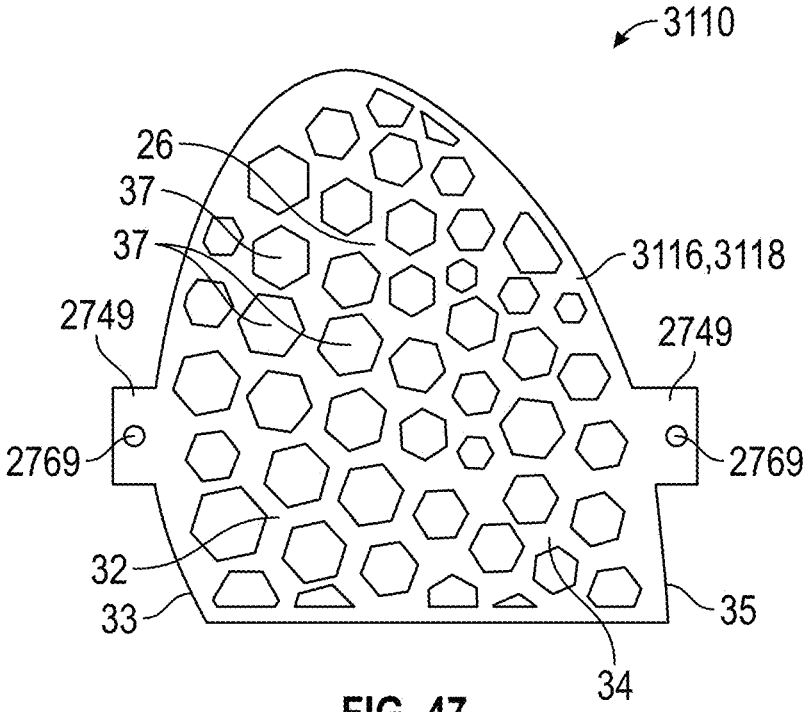
FIG. 47 is a plan view of a device for an article of footwear including a frame having a cellular plate with only a forefoot portion.

FIG. 47 is a plan view of another alterative device 3110 for an article of footwear including a frame 3116 having a cellular plate 3118 similar to cellular plate 2918 but having only a forefoot portion 26 (e.g., having no midfoot portion 24 and no heel portion 22).

Figure 48:
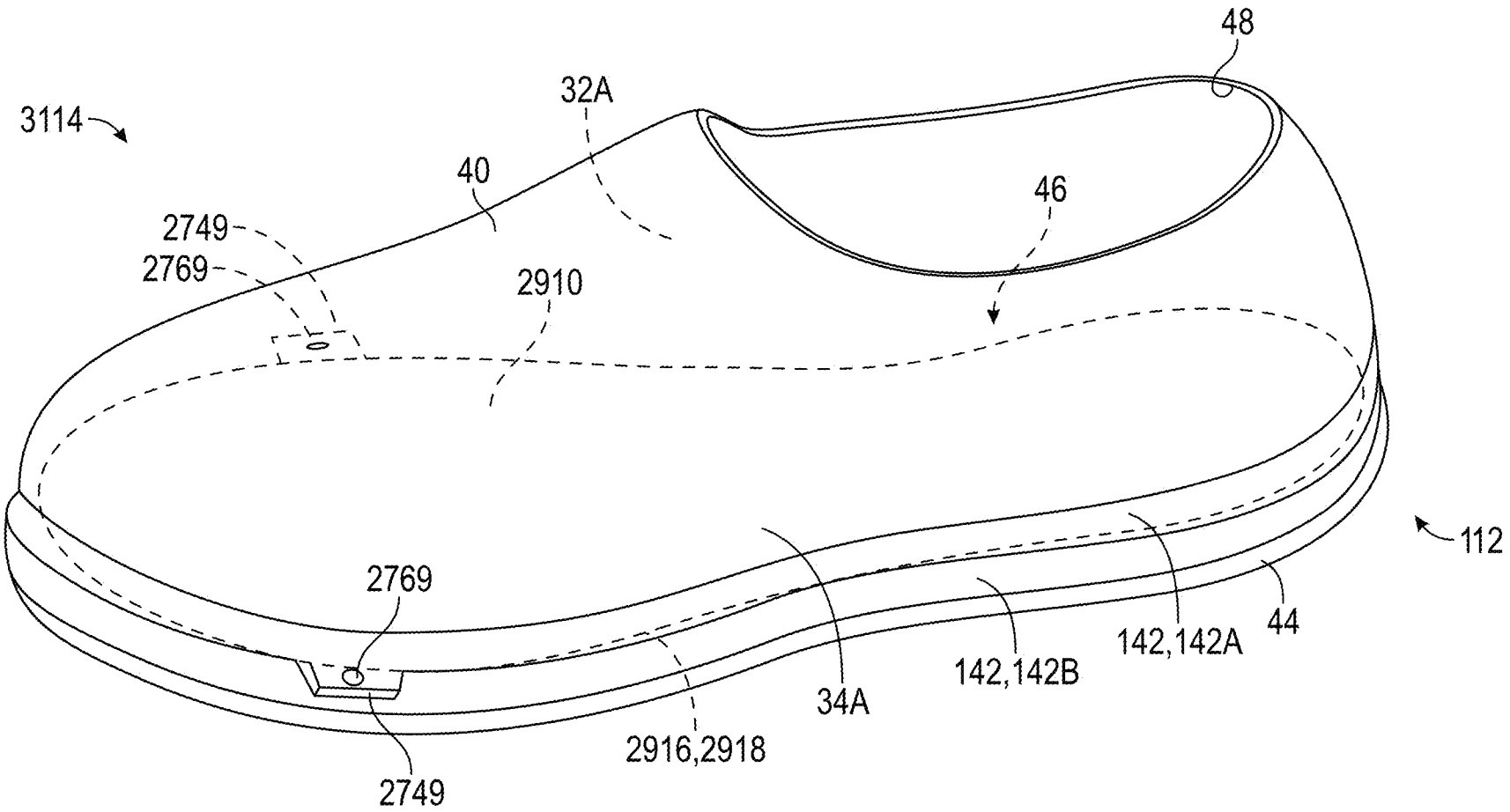
FIG. 48 is a medial perspective view of an article of footwear including the device of FIG. 45.

FIG. 48 is a medial perspective view of an article of footwear 3114 including the device 2910 of FIG. 45. The footwear plate 2918 is embedded within the midsole 142 of the sole structure 112 described with respect to FIG. 6, with the attachment features 2749 extending transversely outward of the medial and lateral sidewalls of the midsole 142 (e.g., exterior to the sole structure 112) for accessibility at the medial and lateral sides 32A, 34A of the article of footwear. For example, the footwear plate 2918 may be embedded between the overlying, upper midsole layer 142A and the underlying, lower midsole layer 142B. Alternatively, the footwear plate 2918 may be embedded within a single midsole layer.

Figure 49:
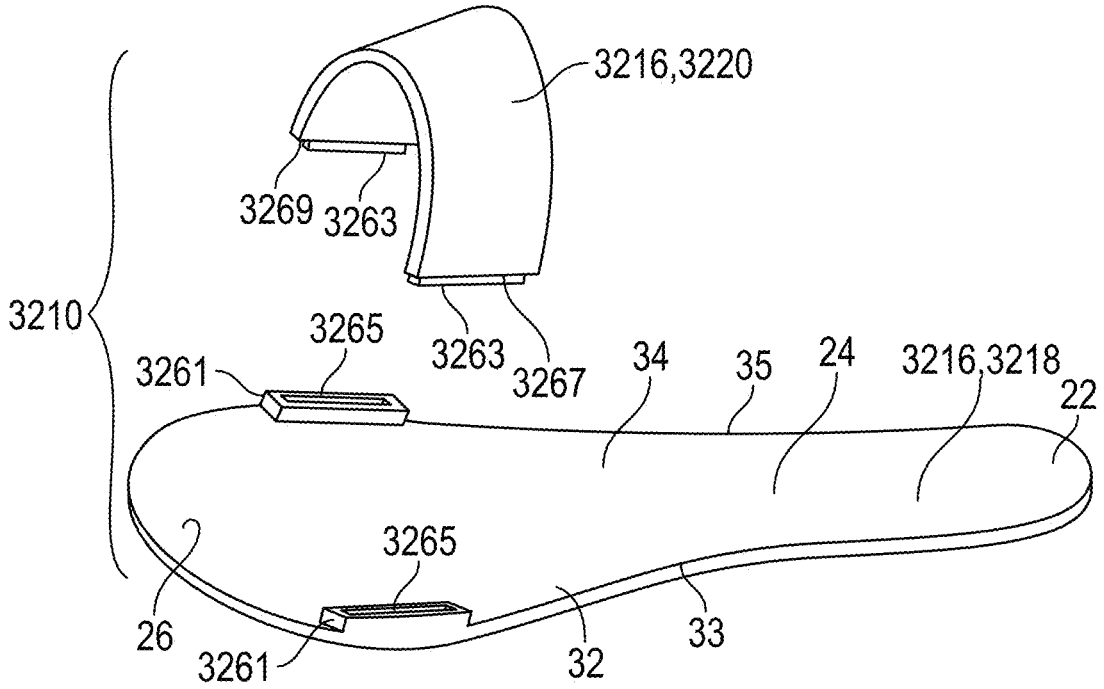
FIG. 49 is a medial perspective exploded view of a device for an article of footwear including a frame with a footwear plate and an arced shield selectively detached from the footwear plate.

FIG. 49 is a medial perspective exploded view of a device 3210 for an article of footwear including a frame 3216. The frame 3216 includes a footwear plate 3218 and an arced shield 3220 selectively detachable from the footwear plate 3218, and shown detached in FIG. 49. The selective attachment of the arced shield 3220 and the footwear plate 3218 is achieved via a tab and slot connection. More specifically, one of the footwear plate 3218 and the arced shield 3220 includes a slot 3265 and the other of the footwear plate 3218 and the arced shield 3220 includes a tab 3263 configured to be received in the slot 3265 to attach the arced shield 3220 to the footwear plate 3218. In the embodiment shown, the slots 3265 are in mounts 3261 provided at the medial and lateral portions 32, 34 of the footwear plate 3218, at or near the medial edge 33 and the lateral edge 35, respectively. In some embodiments, the mounts 3261 may be on outwardly extending flanges, similar to attachment features 2749 of the footwear plate 2918 in FIG. 45. The tabs 3263 extend downward from a medial end 3267 and from a lateral end 3269 of the arced shield 3220. The tabs 3263 fit within the slots 3265 with minimal fore-aft shifting. The arced shield 3220 is thus connected both to the medial portion 32 and to the lateral portion 34 of the footwear plate when the tabs 3263 are received within the slots 3265. The tabs 3263 and slots 3265 may have a friction fit to maintain the connection or, in an implementation in which a downward external force is to be applied to the arced shield 3220, the downward external force would work to reinforce, instead of work against, the connection of the arced shield 3220 and the footwear plate 3218 at the tabs 3263 and the slots 3265 by driving the tabs 3263 in the direction of the slots 3265, in which case no friction fit may be needed. In other embodiments, the tabs 3263 may be provided on the footwear plate 3218 and the slots 3265 may be provided at the medial and lateral ends 3267, 3269 of the arced shield 3220. In still other embodiments, the selective attachment of an arced shield to a footwear plate may be at only one of the medial portion or the lateral portion 34 of the footwear plate.

Figure 50:
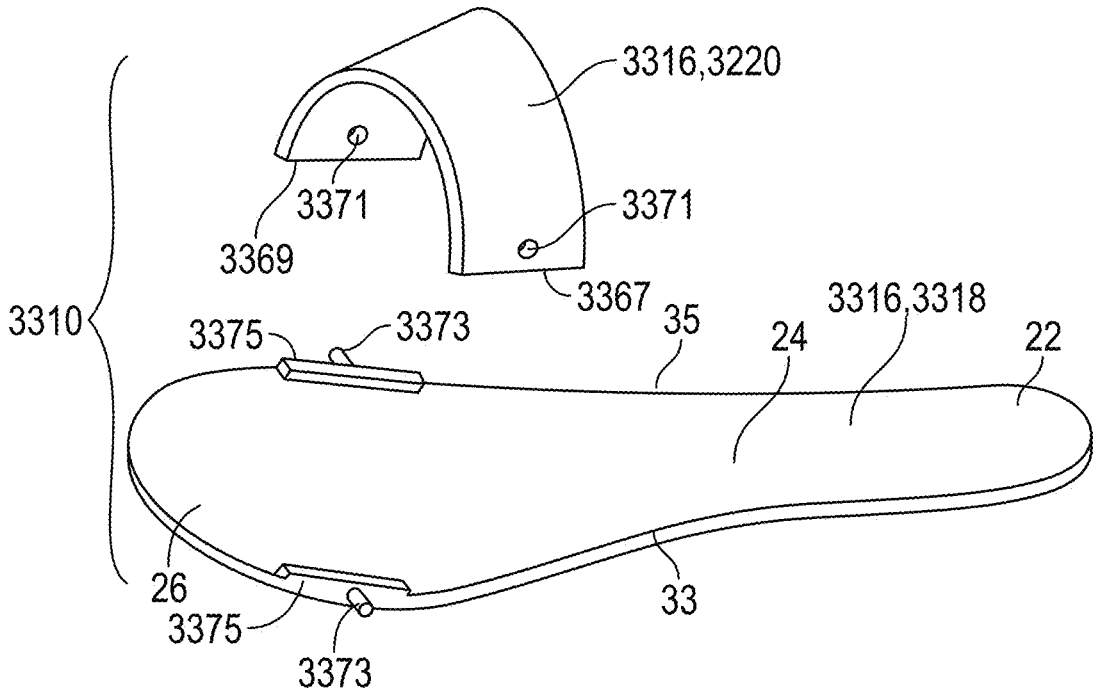
FIG. 50 is a medial perspective exploded view of a device for an article of footwear including a frame with a footwear plate and an arced shield selectively detached from the footwear plate.

FIG. 50 is a medial perspective exploded view of an alternative device 3310 for an article of footwear including a frame 3316. The frame 3316 includes a footwear plate 3318 and an arced shield 3320 selectively detachable from the footwear plate 3318, and shown detached in FIG. 50. The selective attachment of the arced shield 3320 and the footwear plate 3318 is achieved via attachment features that include openings 3371 provided in the arced shield 3320 and pegs 3373 connected to and extending outward from mounts 3375 on the footwear plate 3318. The pegs 3373 may be aligned with and received in the openings 3371 to hold the arced shield 3320 to the footwear plate 3318. The openings 3371 are near a medial end 3367 and a lateral end 3369 of the arced shield 3220. The arced shield 3320 is thus connected both to the medial portion 32 and to the lateral portion 34 of the footwear plate 3318 when the pegs 3373 are received within the openings 3371. The pegs 3373 and openings 3371 may have a friction fit to maintain the connection and/or nuts or other end fittings may be secured to the pegs 3373 after the pegs are inserted in the openings 3371. In other embodiment, pegs may instead be provided on and extend outward from the arced shield 3220 to be received in openings provided on upwardly-extending flanges extending from the medial and lateral edges 33, 35 of the footwear plate 3318.

In some embodiments, selective attachment of an arced shield to a footwear plate may be at only one of the medial portion 32 or the lateral portion 34 of the footwear plate, e.g., in the case in which an arced shield that extends only partway transversely from a lateral portion to a medial portion or from a medial portion to a lateral portion of a footwear plate is used, such as any of the arced shields described herein with respect to FIGS. 21-32. In such an embodiment, the arced shield of any of FIGS. 21-32 would be modified to have a selective attachment feature, such as a tab or slot as discussed with respect to FIG. 49 or an opening or peg as discussed with respect to FIG. 50. Other attachment features may be used to establish a selective attachment and detachment of an arced shield to a footwear plate, such as the use of a hook-and-loop-type connection, etc.

Figure 51:
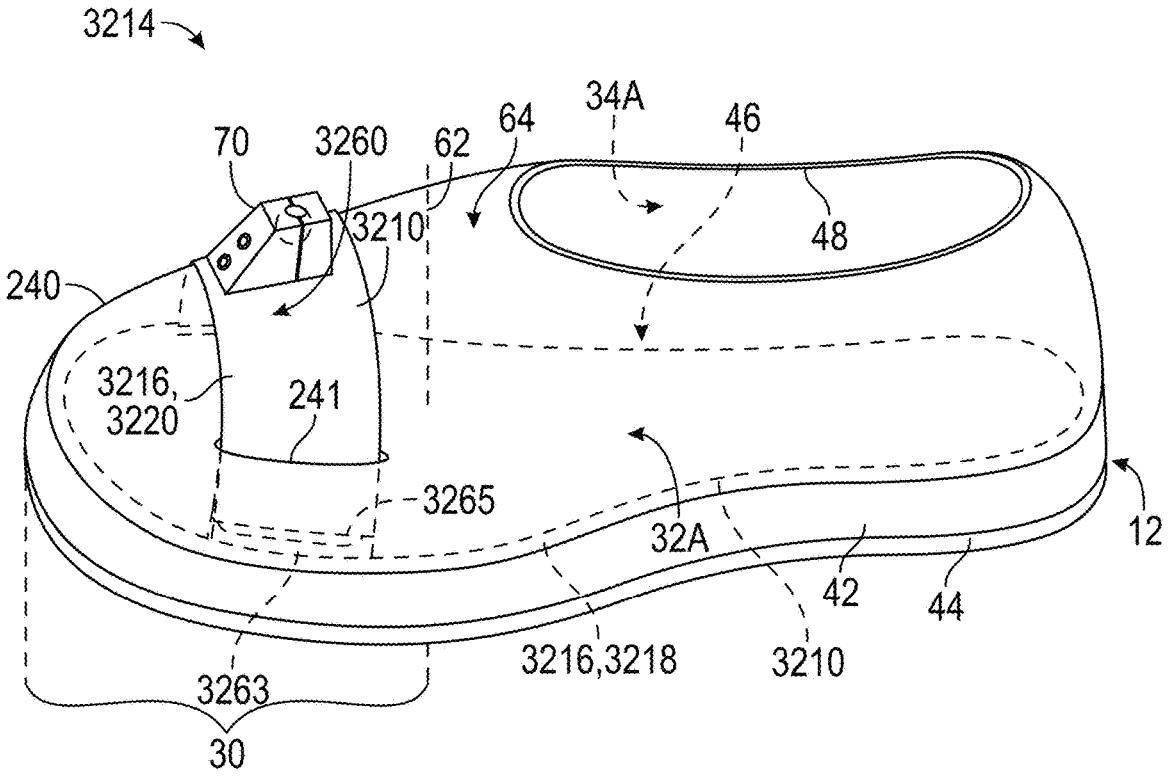
FIG. 51 is medial perspective view of an article of footwear including a footwear upper and a sole structure with the device of FIG. 49 with the arced shield attached to the footwear plate and extending along an exterior surface of the vamp of the footwear upper and including the joint connector of FIG. 11.

FIG. 51 is a medial perspective view of an article of footwear 3214 including the footwear upper 240 and the sole structure 12 described with respect to FIG. 11 with the device of FIG. 49, and showing the arced shield 3220 attached to the footwear plate 3218 and extending from inside the foot-receiving cavity 46 through the openings 241 in the footwear upper 240 to extend along the exterior surface 64 of the vamp 62 of the footwear upper 240. The footwear plate 3218 is configured to extend at least partially along and under a sole of a wearer's foot. The joint connector 70 of FIG. 11 is shown mounted to a superior surface 3260 of the arced shield 3220. In an alternative example the joint connector 70A or any of the other joint connectors described herein could instead be used.

Figure 52:
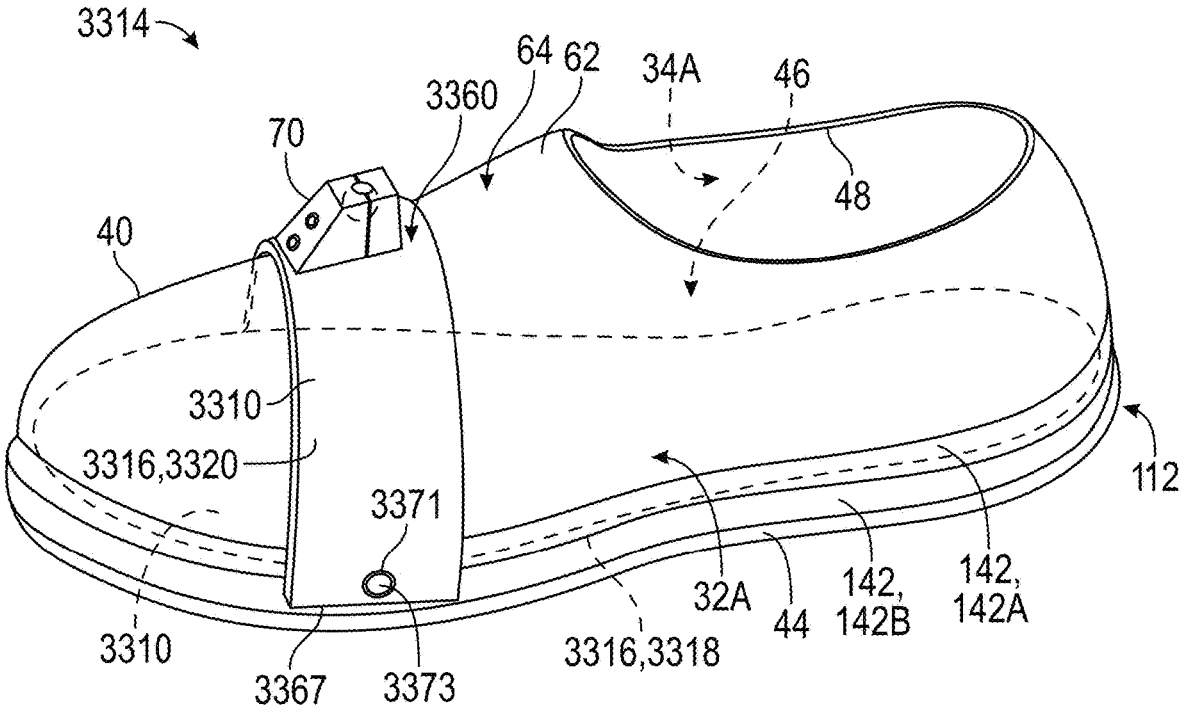
FIG. 52 is medial perspective view of an article of footwear including a footwear upper and a sole structure with the device of FIG. 50 with the arced shield attached to the footwear plate and extending along an exterior surface of the vamp of the footwear upper and including the joint connector of FIG. 11.

FIG. 52 is a medial perspective view of an article of footwear 3314 including the footwear upper 40 and the sole structure 112 of FIG. 6, with the device 3310 of FIG. 50 showing the arced shield 3320 attached to the footwear plate 3318. The footwear plate 3318 is embedded within the midsole 142 of the sole structure 112 described with respect to FIG. 6, such as embedded between the overlying, upper midsole layer 142A and the underlying, lower midsole layer 142B. Alternatively, the footwear plate 3318 may be embedded within a single midsole layer. The pegs 3373 extend outward from the sidewalls of the sole structure 112 or outward through the sides of the footwear upper 40 at the medial and lateral side 32A, 34A of the article of footwear 3314 and extend through the openings 3371 in the arced shield 3320. The arced shield 3320 extends along the exterior surface 64 of the vamp 62 of the footwear upper 40. The footwear plate 3318 is configured to extend at least partially along and under a sole of a wearer's foot. The joint connector 70 of FIG. 11 is shown mounted to a superior surface 3360 of the arced shield 3320. In an alternative example the joint connector 70A or any of the other joint connectors described herein could instead be used.

By configuring an arced shield to be selectively detachable from a footwear plate, such as arced shields 3220 and 3320, the arced shield can be detached when desired, such as when planned activities of the wearer do not necessitate the presence of the arced shield. For example, if any of the joint connectors described herein are operatively connected to and/or secured at the frame, such as joint connectors 70 or 70A operatively connected to and/or secured at a superior surface of the arced shield, and the planned activity of the wearer does not include use of the joint connector, then detaching the arced shield results in less overall weight of the article of footwear.

Additionally, selective attachment and detachment of the arced shield allows for the possibility of using different arced shields for different activities. For example, a first arced shield with a first joint connector may be attached to the footwear plate for one or more activities, and a second arced shield with another joint connector configured for connection with a different component, for example, may be attached to the footwear plate for different activities.

Figure 53:
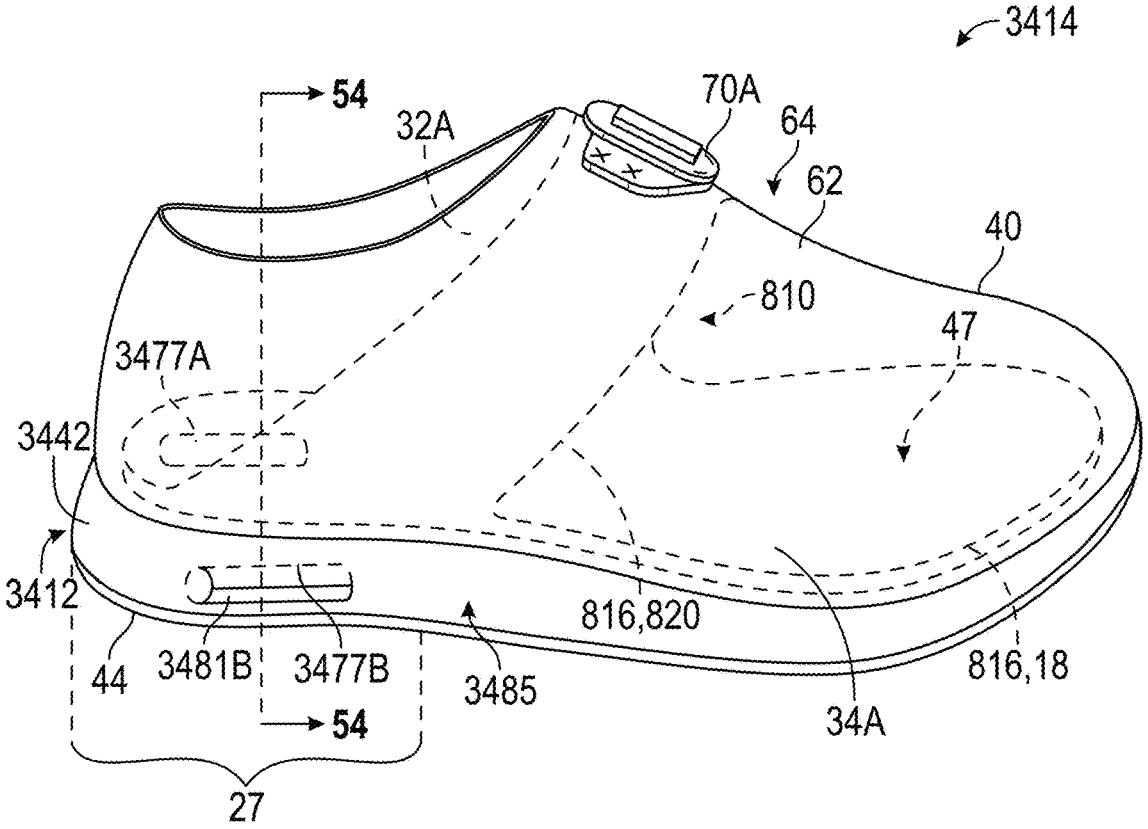
FIG. 53 is a lateral perspective view of an article of footwear including the device of FIG. 17 with the joint connector of FIG. 11 and further including recesses at a surface of the midsole housing magnets or magnetic material.

FIG. 53 is a lateral perspective view of an article of footwear 3414 that is identical to the article of footwear 914 of FIG. 20 except that the sole structure 12 is replaced with a sole structure 3412 having a midsole 3442 that defines recesses 3477A, 3477B at an exterior surface of the midsole 3442, such as at an exterior medial sidewall surface 3483 and an exterior lateral sidewall surface 3485 at each of the medial sidewall 3482A and the lateral sidewall 3482B of the midsole 3442, respectively. The recess 3477A may be referred to as a first recess, and the recess 3477B may be referred to as a second recess. The recesses 3477A, 3477B each include an opening 3481A, 3481B at the exterior medial and lateral sidewall surfaces 3483, 3485, respectively. The opening 3481A, 3481B is smaller than the respective recess 3477A, 3477B. For example, the recesses 3477A, 3477B are each shown as a portion of a cylindrical shape. Additionally, an insole 3443 is added in the foot-receiving cavity 46, overlying the footwear plate 18, as indicated in FIG. 54.

Each recess 3477A, 3477B has a respective magnet (or magnetic material) 3487A, 3487B housed therein, e.g., respectively positioned adjacent to the inner surface 3479A, 3479B of the recess 3477A, 3477B. The magnet (or magnetic material) 3487A may be referred to as a first magnet (or first magnetic material), and the magnet 3487B may be referred to as a second magnet (or second magnetic material). The magnets (or magnetic material) 3487A, 3487B are shaped like portions of cylinders configured to line at least a portion of the inner surfaces 3479A, 3479B, and may be adhered or otherwise secured to the inner surfaces 3479A, 3479B. The magnets (or magnetic material) 3487A, 3487B each have a slot 3489A, 3489B, respectively, that aligns with the respective opening 3481A, 3481B.

The magnets (or magnetic material) 3487A, 3487B thus leave a portion of each of the cylindrical recesses 3477A, 3477B empty in FIGS. 53 and 54, and thus leaving space open for receiving a magnetic connector through the respective opening 3481A, 3481B, such as another magnet or magnetic material configured to attract the magnets (or magnetic material) 3487A, 3487B housed in the recesses 3477A, 3477B. Because the openings 3481A, 3481B are smaller than the respective recesses 3477A, 3477B and the midsole 3442 may be a somewhat flexible foam material, it may be possible to stretch the openings 3481A, 3481B during insertion of another magnet or magnetic material into the recesses 3477A, 3477B through the openings 3481A, 3481B. Once in the recesses 3477A, 3477B, the openings 3481A, 3481B will return to their regular (unstretched) size, allowing the material of the midsole 3442 near the openings 3481A, 3481B to help retain the other inserted magnet or magnetic material in the recesses 3477A, 3477B (in addition to the magnetic forces that act to retain the inserted magnet or magnetic material in the recesses 3477A, 3477B).

Figure 55:
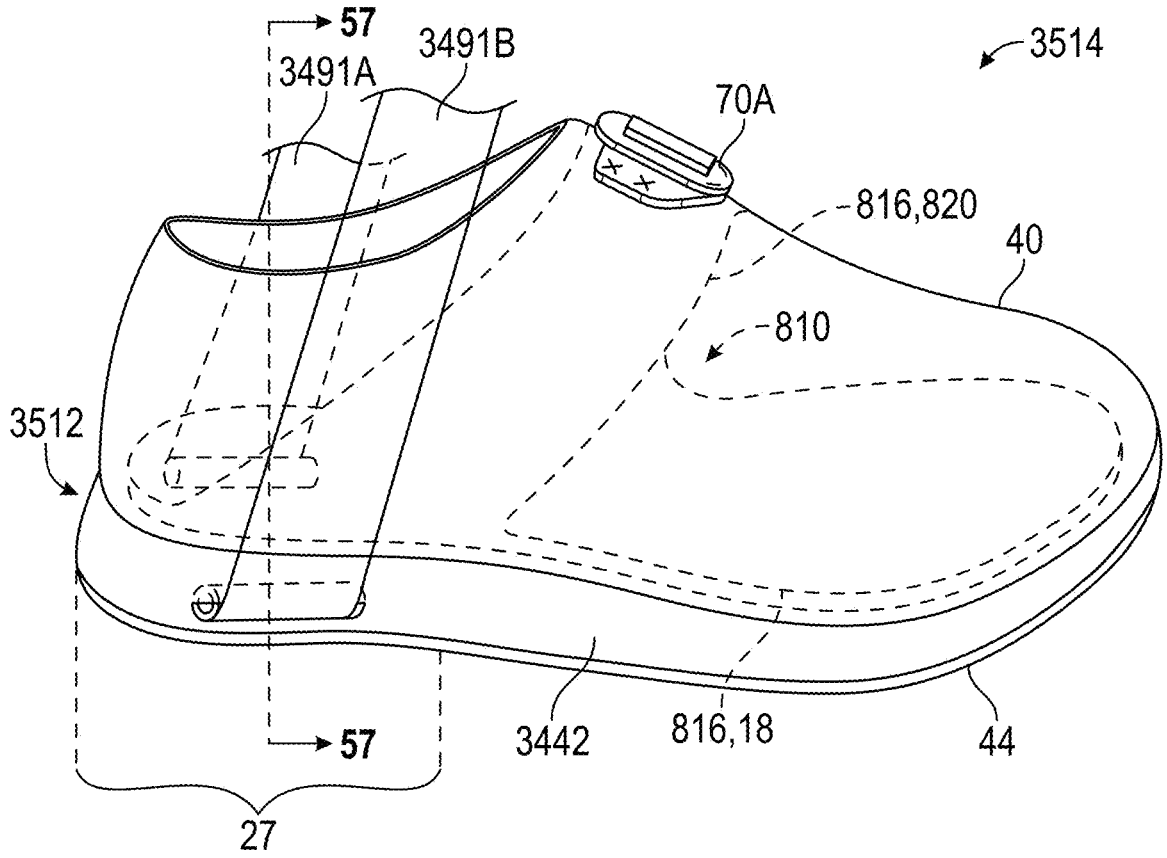
FIG. 55 is a lateral perspective view of an article of footwear with straps having magnets or magnetic material secured thereon and disposed in and secured to magnets or magnetic material housed in recesses in the midsole.
Figure 56:
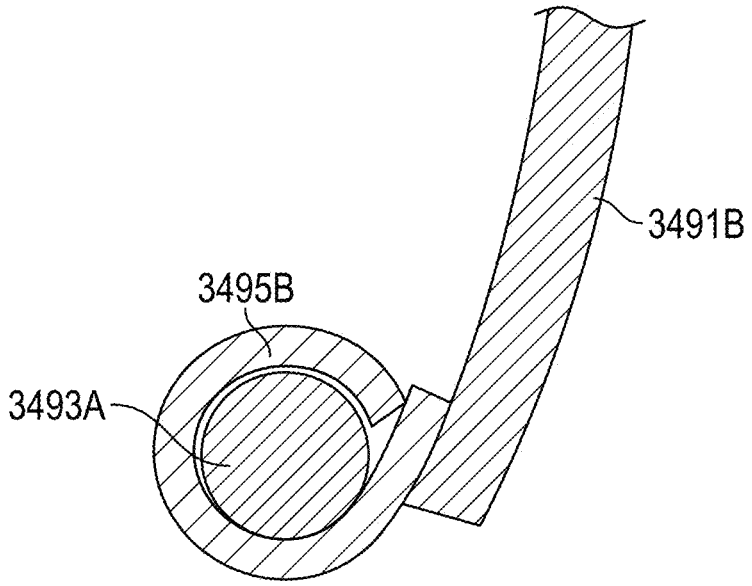
FIG. 56 is a fragmentary cross-sectional view of one of the straps of FIG. 55 with the magnet of magnetic material secured thereon.
Figure 57:
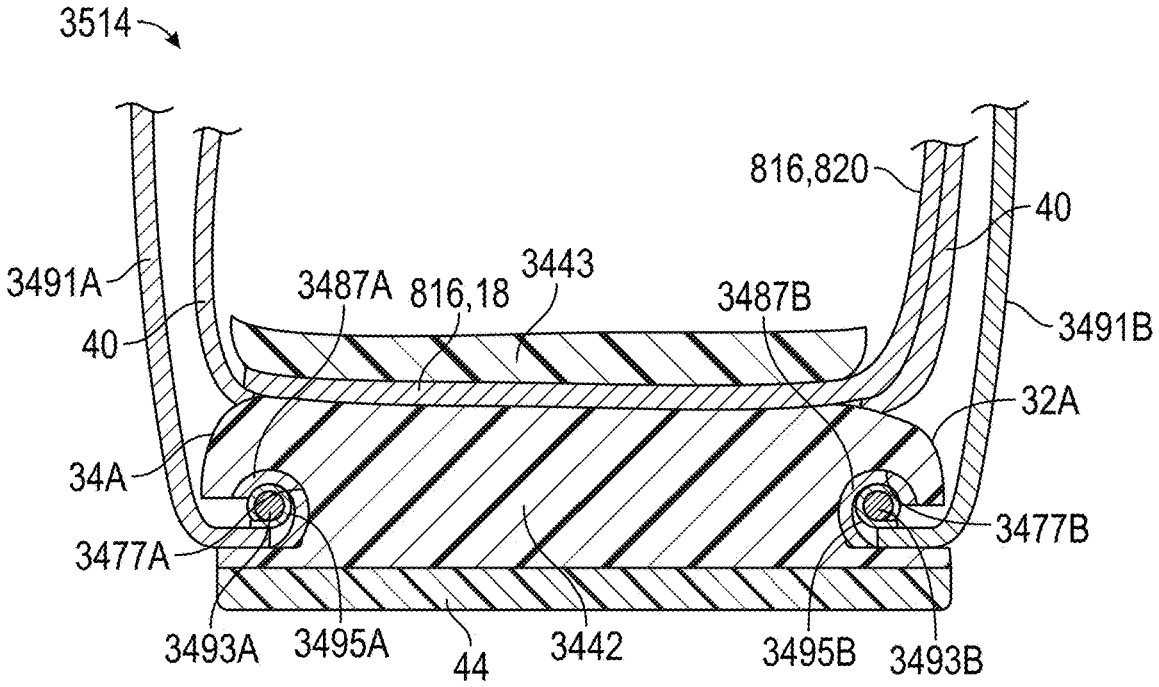
FIG. 57 is a cross-sectional view of the article of footwear of FIG. 55 taken at lines 57-57 in FIG. 55.

For example, FIG. 55 is a lateral perspective view of an article of footwear 3514 identical to the article of footwear 3414 except that the sole structure 3412 is replaced with an identical sole structure 3512 with the addition of straps 3491A and 3491B having magnets 3493A, 3493B (or magnetic material), respectively, secured thereon and received through the openings 3481A, 3481B to be disposed in the recesses 3477A, 3477B, respectively, and secured to the magnets or magnetic material 3487A, 3487B housed therein, as best shown in the cross-sectional view of FIG. 57. Each of the magnets 3493A, 3493B (or magnetic material) may be secured within a retainer 3495A, 3495B, respectively that is in turn adhered to the respective strap 3491A, 3491B by adhesive, stitching, or otherwise, as best illustrated in FIG. 56 with respect to the magnet 3493A, the retainer 3495B, and the strap 3491B. The cross-section of FIG. 56 is taken along the same lines as in FIG. 55 but showing only the strap 3491B, the retainer 3495B, and the magnet 3493B (or magnetic material).

The magnets 3493A, 3493B (or magnetic material) including the retainers 3495A, 3495B, respectively, are generally cylindrical, and thus are shaped to be received in the respective recess 3477A, 3477B. Accordingly, when the magnets or magnetic material 3493A, 3493B are received in the recesses 3477A, 3477B, the magnetic connection between the magnets 3487A, 3487B (or magnetic material) housed in the recesses 3477A, 3477B and the magnets 3493A, 3493B (or magnetic material) secured to the straps 3491A, 3491B operatively connects the straps 3491A, 3491B to the midsole 3442. Forces may be applied to the straps 3491A, 3491B to move the midsole 3442. For example, if the recesses 3477A, 3477B are in the heel region 27 of the midsole 3442 as shown, an upward force applied to either or both of the straps 3491A, 3491B will cause the footwear plate 18 to apply an upward force to the wearer's sole rearward of the ankle joint. This force on either or both of the straps 3491A, 3491B may hold a heel region 27 of the sole structure 3512 that includes the heel portion 22 of the footwear plate 18 against the wearer's sole, and may counteract any tendency of the heel portion 22 to move away from the wearer's sole when an upward force is applied at the joint connector 70A forward of the ankle.

Figure 58:
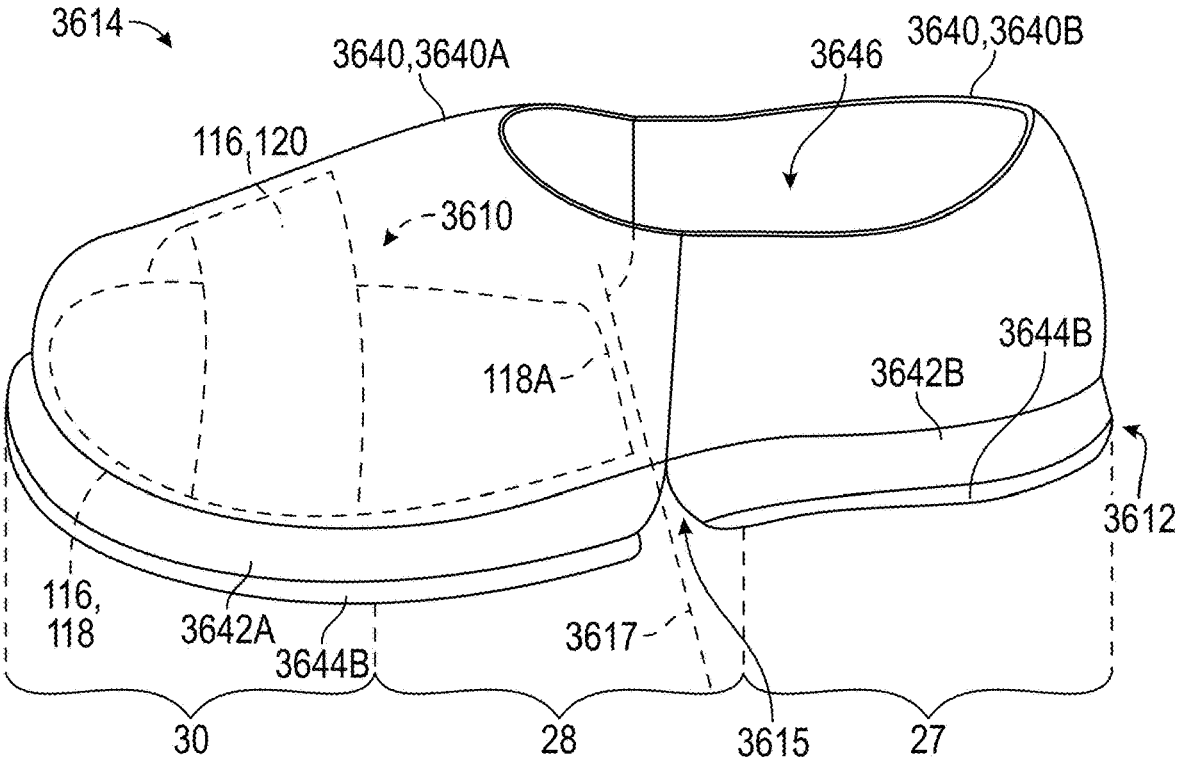
FIG. 58 is a medial perspective view of an article of footwear having front and rear midsole components pivotable relative to one another, shown in a use position, and having a device with a footwear plate and an arced shield.
Figure 59:
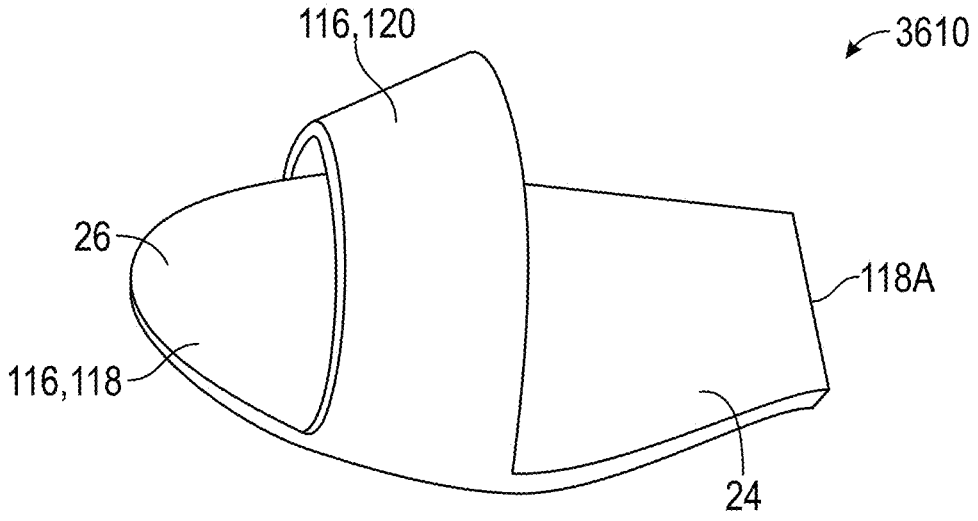
FIG. 59 is a medial perspective view of the device included in the article of footwear of FIG. 58.

FIG. 58 is a medial perspective view of an article of footwear 3614 including a device 3610 that includes the footwear plate 118 of FIG. 3 having the arced shield 120 and the footwear plate 118, as best shown in FIG. 59. The article of footwear 3614 includes a sole structure 3612 that includes a front midsole component 3642A and a rear midsole component 3642B. A front outsole component 3644A is secured to the front midsole component 3642A and a rear outsole component 3644B is secured to the rear midsole component 3642B.

The article of footwear 3614 further includes a footwear upper 3640 that includes a front upper component 3640A secured to the front midsole component 3642A, and a rear upper component 3640B secured to the rear midsole component 3642B. The front and rear upper components 3640A, 3640B together define the foot-receiving cavity 46. In FIG. 58, the front midsole component 3642A and the rear midsole component 3642B are shown in a use position in which a rear of the front midsole component 3642A and the front of the rear midsole component 3642B define a groove 3615 therebetween. As used herein, a "use" position is a position of the midsole when worn on a foot during walking, etc. The front midsole component 3642A and the rear midsole component 3642B are pivotable relative to one another between the use position of FIG. 58 and an access position shown in FIG. 60 by pivoting at a pivot axis 3617 that extends transversely across a midfoot region 28 of the sole structure 3612. The pivot axis 3617 extends generally at the top of the groove 3615. The sole structure 3612 lifts at the pivot axis 3717 in the access position with the groove 3615 relatively closed in comparison to the use position. The sole structure 3612 rests on a ground plane G at a forward portion 3612A (e.g., at or near a front of the forward portion of the front outsole component 3644A and at a rear portion 3612B (e.g., at or near a rear of the rear outsole component 3644B) in the access position.

Figure 60:
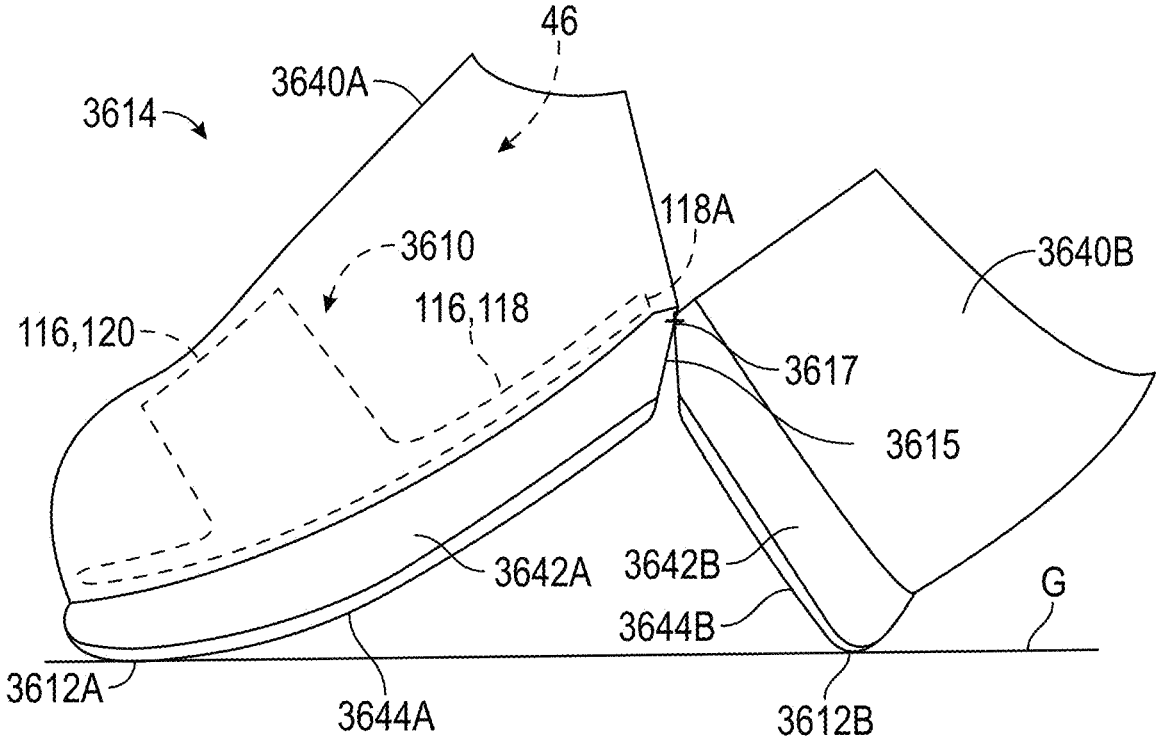
FIG. 60 is a medial side view of the article of footwear of FIG. 58 with the front and rear midsole components pivoted relative to one another to an access position.

The footwear upper 3640 may be referred to as a divided footwear upper 3640 as the front upper component 3640A is separate from the rear upper component 3640B and movable relative thereto as shown in FIG. 60 when the sole structure 3612 is in the access position to ease foot entry.

The footwear plate 118 has a rear edge 118A that is disposed over the front midsole component 3442A and forward of the pivot axis 3617. The footwear plate 118 thus extends at least partially along the front midsole component 3442A. In the example shown, the footwear plate 118 extends in both the forefoot region 30 and the midfoot region 28 of the sole structure 3612. In another implementation, the rear edge 118A could be further forward than shown, so that the footwear plate 118 extends only in the forefoot region 30. In either case, the rear edge 118A is forward of the pivot axis 3617. Alternatively, a separate plate could be provided extending over the rear midsole component 3642B rearward of the pivot axis 3617 and connected to the footwear plate 118 by a hinge mechanism so that the plate pivots with the front and rear midsole components 3642A, 3642B between the use and access positions.

Optionally, a joint connector, such as joint connector 70A could be secured to the front upper component 3640A and/or any of the attachment features described herein could be added to the footwear plate 118, in which case a downward external force applied at the joint connector and/or at the attachment features should result in forward rotation of the article of footwear 3614 about the pivot axis A of the ankle shown in FIG. 6 (e.g., plantar flexion). With the foot in the foot-receiving cavity 3646, the sole structure 3612 will remain in the use position even with such an applied external force. In an example, an exoskeleton may be operatively attached the joint connector and/or at the attachment features, providing the external force that assists with plantar flexion.

Figure 61:
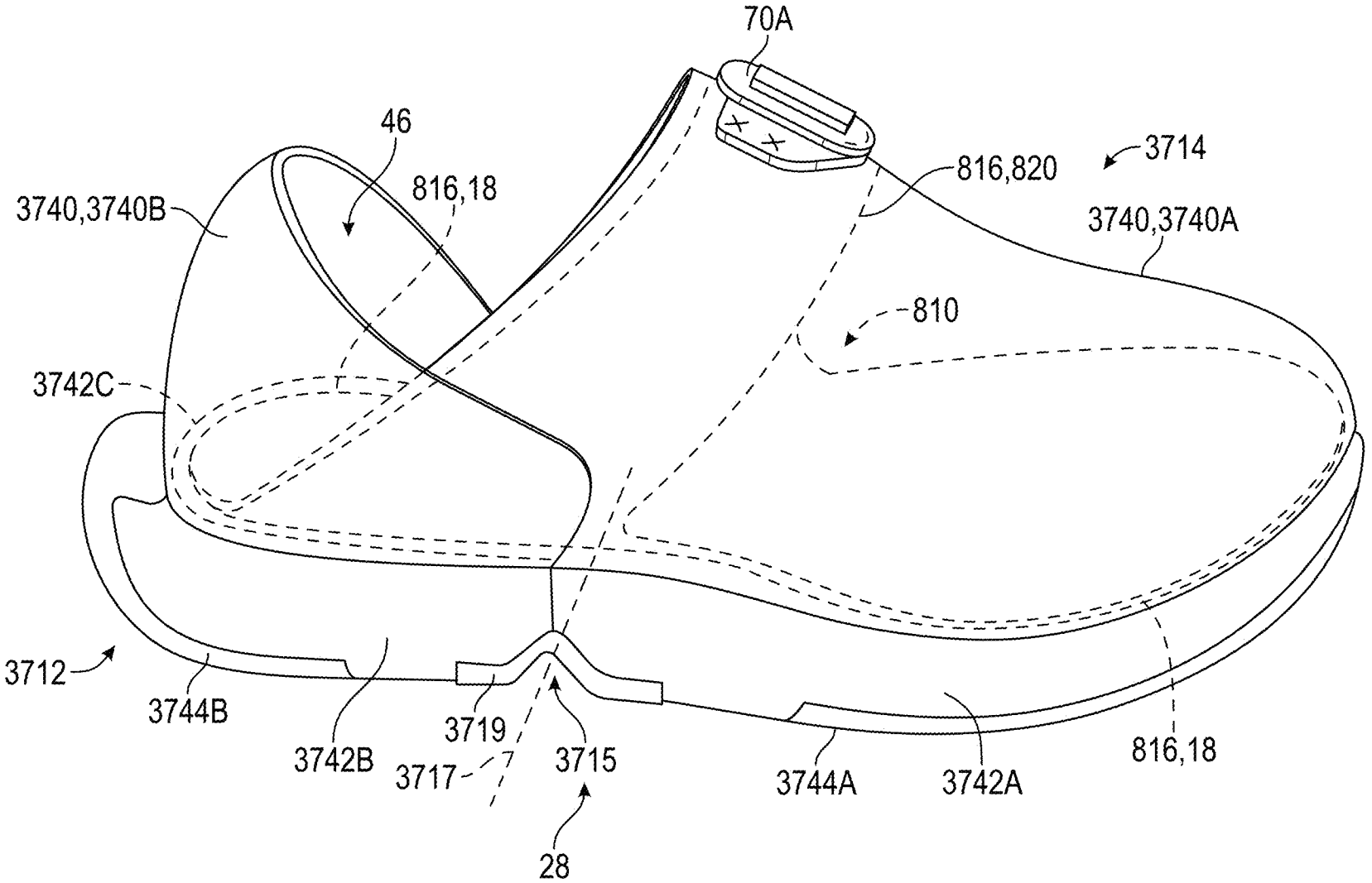
FIG. 61 is a lateral perspective view of an article of footwear having front and rear midsole components pivotable relative to one another, shown in a use position, and having the device of FIG. 17 with the joint connector of FIG. 11.

FIG. 61 is a lateral perspective view of an article of footwear 3714 in a use position. The article of footwear 3714 includes the device 810 of FIG. 17 with the joint connector 70A of FIG. 14. Similar to the article of footwear 3614, the article of footwear 3714 has a jointed sole structure 3712, including a front midsole component 3742A and a rear midsole component 3742B. A front outsole component 3744A underlies at least a portion of the front midsole component 3742A and a rear outsole component 3744B underlies at least a portion of the rear midsole component 3742B. The front midsole component 3742A and the rear midsole component 3742B are pivotable relative to one another at a transverse pivot axis 3717 between a use position shown in FIG. 61 and an access position shown in FIG. 62.

In the use position, a rear of the front midsole component 3742A and a front of the rear midsole component 3742B define a groove 3715 therebetween. A connector 3719, which may be an outsole component, lines the groove 3715. The pivot axis 3717 extends transversely across a midfoot region 28 of the sole structure 3712 generally at the top of the groove 3715. The sole structure 3712 lifts at the pivot axis 3717 in the access position with the groove 3715 relatively closed in comparison to the use position. The sole structure 3712 rests at a forward portion 3712A (e.g., at or near a front of the forward portion of the front outsole component 3744A and at a rear portion 3712B (e.g., at or near a rear of the rear outsole component 3744B) in the use position.

Figure 62:
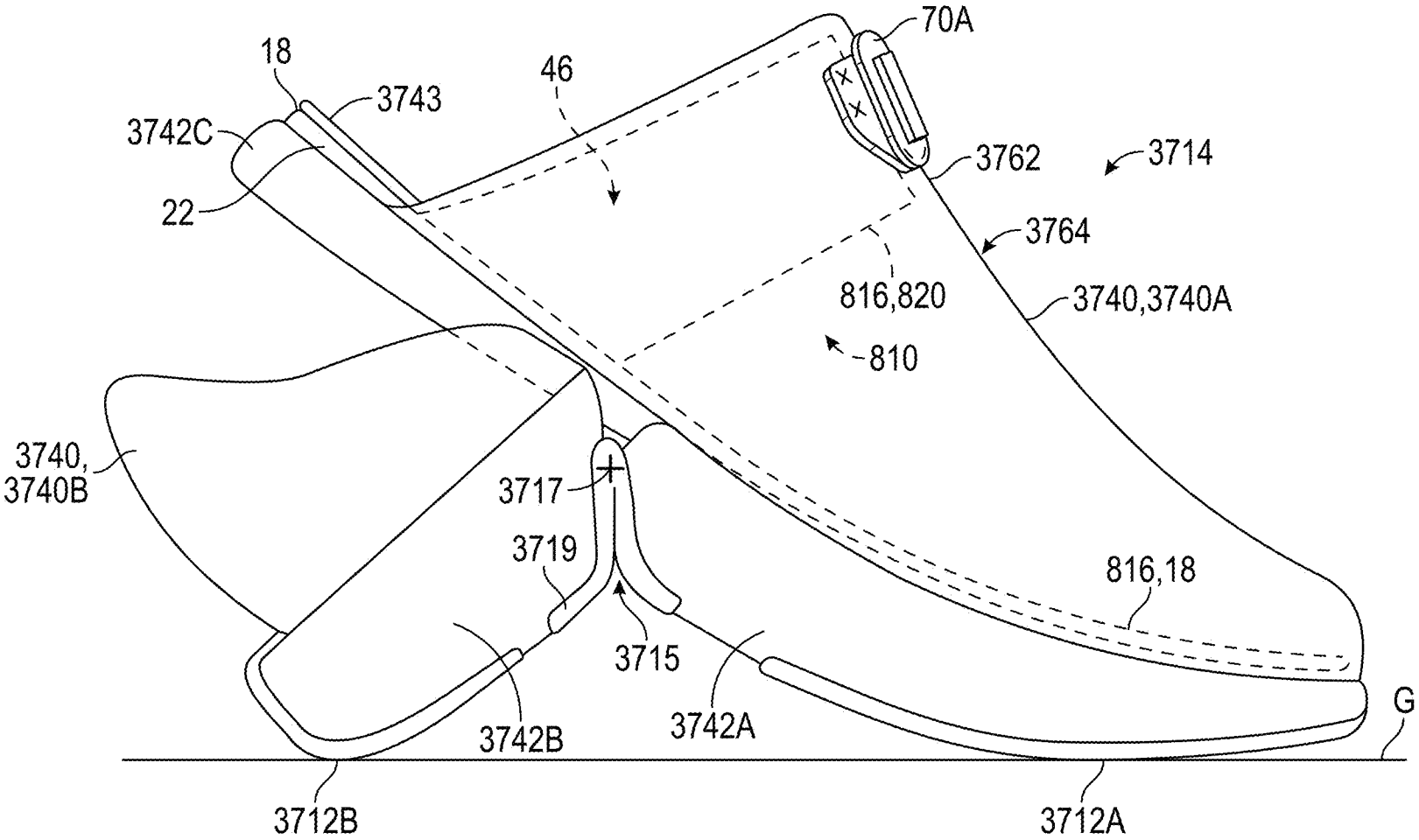
FIG. 62 is a lateral side view of the article of footwear of FIG. 61 with the front and rear midsole components pivoted relative to one another to an access position.

The article of footwear 3714 further includes a footwear upper 3740 that includes a front footwear upper 3740A secured to the front midsole component 3742A, and a rear footwear upper 3740B secured to the rear midsole component 3742B. The front footwear upper 3740A and the rear footwear upper 3740B together define a foot-receiving cavity 46. The footwear upper 3740 may be referred to as a divided footwear upper 3740 as the front footwear upper 3740A is separate from the rear footwear upper 3740B and movable relative thereto as shown in FIG. 62 when the sole structure 3712 is in the access position to provide easier access into the foot-receiving cavity 46.

The front midsole component 3742A includes an integral heel footbed 3742C that overlays the rear midsole component 3742B in the use position and is spaced apart from the rear midsole component 3742B in the access position. For example, U.S. Pat. No. 11,185,125 to Blanche et al., issued Nov. 30, 2021, which is incorporated by reference herein in its entirely, discloses such an integral heel footbed. In such implementations, a device with a frame that includes a footwear plate that extends rearward of the transverse pivot axis 3717 may be implemented, such as the device 810 with frame 816 having the footwear plate 18 that includes a heel portion 22. In FIG. 62, the heel portion 22 of the footwear plate 18 is shown with an insole 3743 disposed over the superior surface of the footwear plate 18. The heel footbed 3742C and the footwear plate 18 both extend rearward of the pivot axis 3717 in both the use position and the access position. Because the heel footbed 3742C moves with and is an integral portion of the front midsole component 3742A, configuring the footwear plate 18 to extend rearward of the pivot axis 3717 over the rear midsole component 3742B will not interfere with pivoting at the pivot axis 3717.

The joint connector 70A is secured to an exterior surface 3764 at the vamp 3762 of the front footwear upper 3740A. A downward external force applied at the joint connector 70A should result in forward rotation of the article of footwear 3714 about the pivot axis A of the wearer's ankle shown in FIG. 6 (e.g., plantar flexion). With the foot in the foot-receiving cavity 46, the sole structure 3712 will remain in the use position even with such an applied external force. In an example, an exoskeleton may be operatively attached the joint connector 70A, providing the external force that assists with plantar flexion. Any of the other joint connectors and/or at the attachment features disclosed herein could instead be used with the article of footwear 3714.

Figure 63:
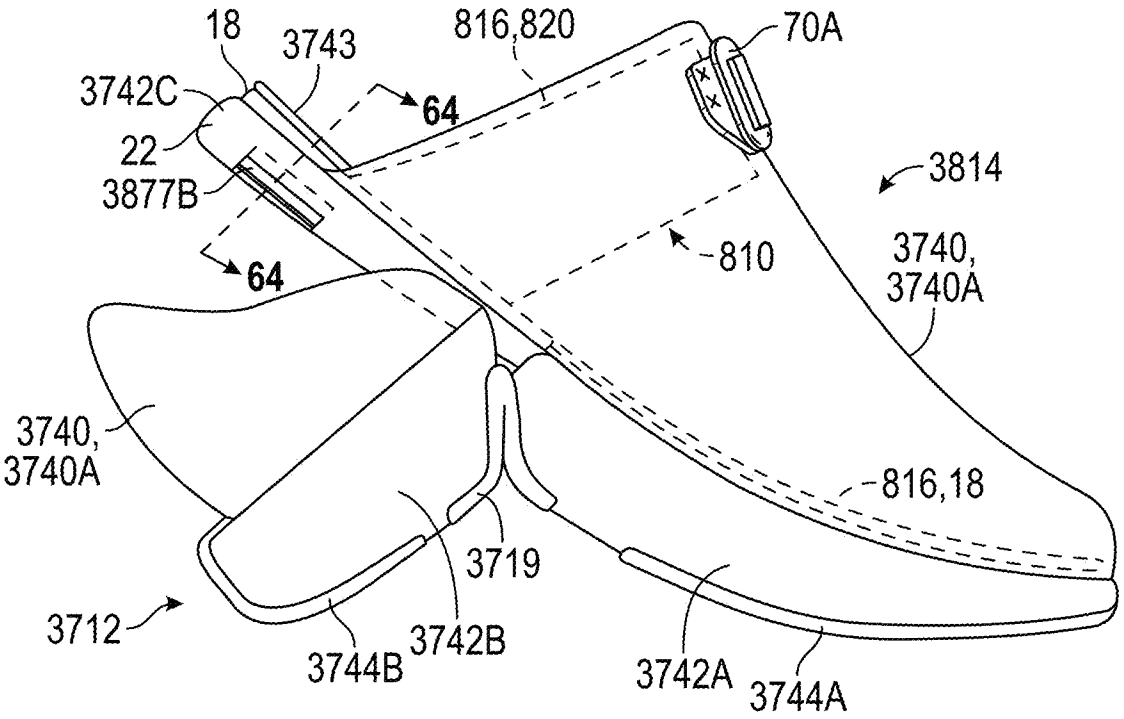
FIG. 63 is a lateral perspective view of an article of footwear including the device of FIG. 17 with the joint connector of FIG. 11 and further including recesses at a surface of a heel footbed of the front midsole component housing magnets or magnetic material.
Figure 64:
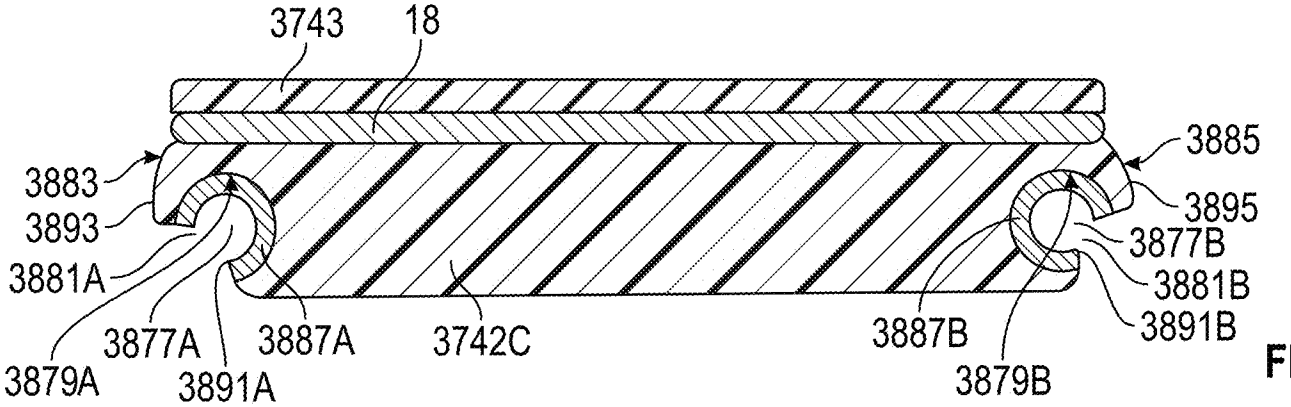
FIG. 64 is a cross-sectional view of the heel footbed of FIG. 63 taken at lines 64-64 in FIG. 63.

FIG. 63 is a lateral perspective view of an article of footwear 3814 identical to the article of footwear 3714 and shown in the use position, but further including recesses 3877A and 3877B at exterior medial and lateral side surfaces 3883 and 3885 at each of the medial and lateral sidewalls 3893 and 3895 of the heel footbed 3742C in the heel portion 22 of the heel footbed 3742C. FIG. 64 is a cross-sectional view of the heel footbed 3742C of FIG. 63 taken at lines 64-64 in FIG. 63.

The recess 3877A may be referred to as a first recess, and the recess 3877B may be referred to as a second recess. The recesses 3877A, 3877B open at the exterior medial and lateral side surfaces 3883, 3885, respectively defining openings 3881A, 3881B that are oriented transversely outward and downward along a lower edge of the heel footbed 3742C. The recesses 3877A, 3877B are each shown as a portion of a cylindrical shape.

Each recess 3877A, 3877B has a magnet (or magnetic material) 3887A, 3887B housed therein, e.g., respectively positioned adjacent to the inner surface 3879A, 3879B of the recess 3877A, 3877B. The magnet (or magnetic material) 3887A may be referred to as a first magnet (or first magnetic material), and the magnet 3887B may be referred to as a second magnet (or second magnetic material). The magnets (or magnetic material) 3887A, 3887B are portions of cylinders configured to line at least a portion of the inner surfaces 3879A, 3879B, and may be adhered or otherwise secured to the inner surfaces 3879A, 3879B. The magnets (or magnetic material) 3887A, 3887B each have a slot 3891A, 3891B, respectively, that aligns with the respective opening 3881A, 3881B.

The magnets (or magnetic material) 3887A, 3887B thus leave a portion of the cylindrical recesses 3877A, 3877B empty in FIG. 64, and thus having space open for receiving a magnetic connector through the respective opening 3881A, 3881B, such as another magnet or magnetic material configured to attract the magnets (or magnetic material) 3887A, 3887B housed in the recesses 3877A, 3877B.

Figure 65:
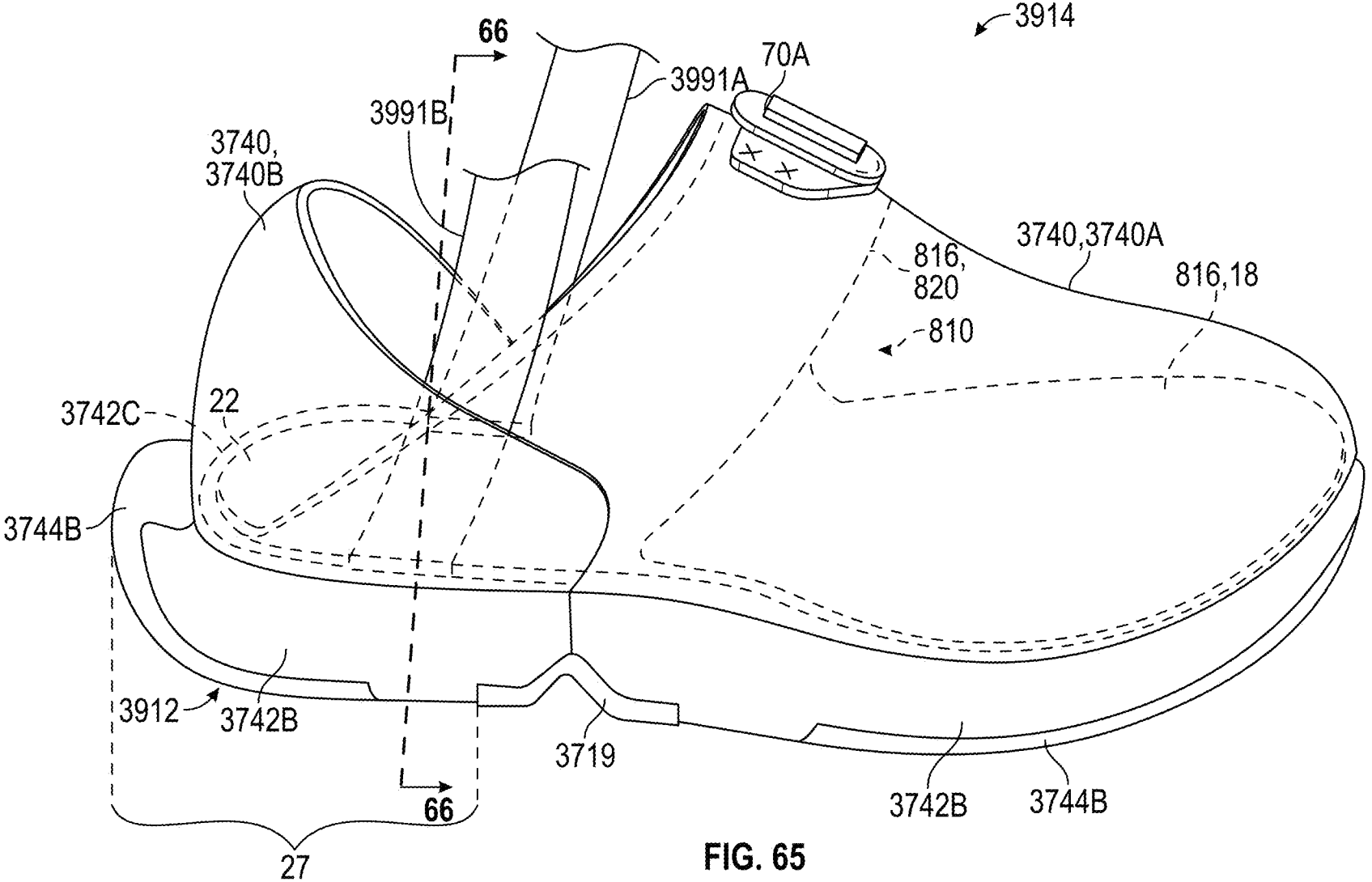
FIG. 65 is a lateral perspective view of the article of footwear of FIG. 63 in the use position with straps having magnets or magnetic material secured thereon and disposed in the recesses of the heel footbed.
Figure 66:
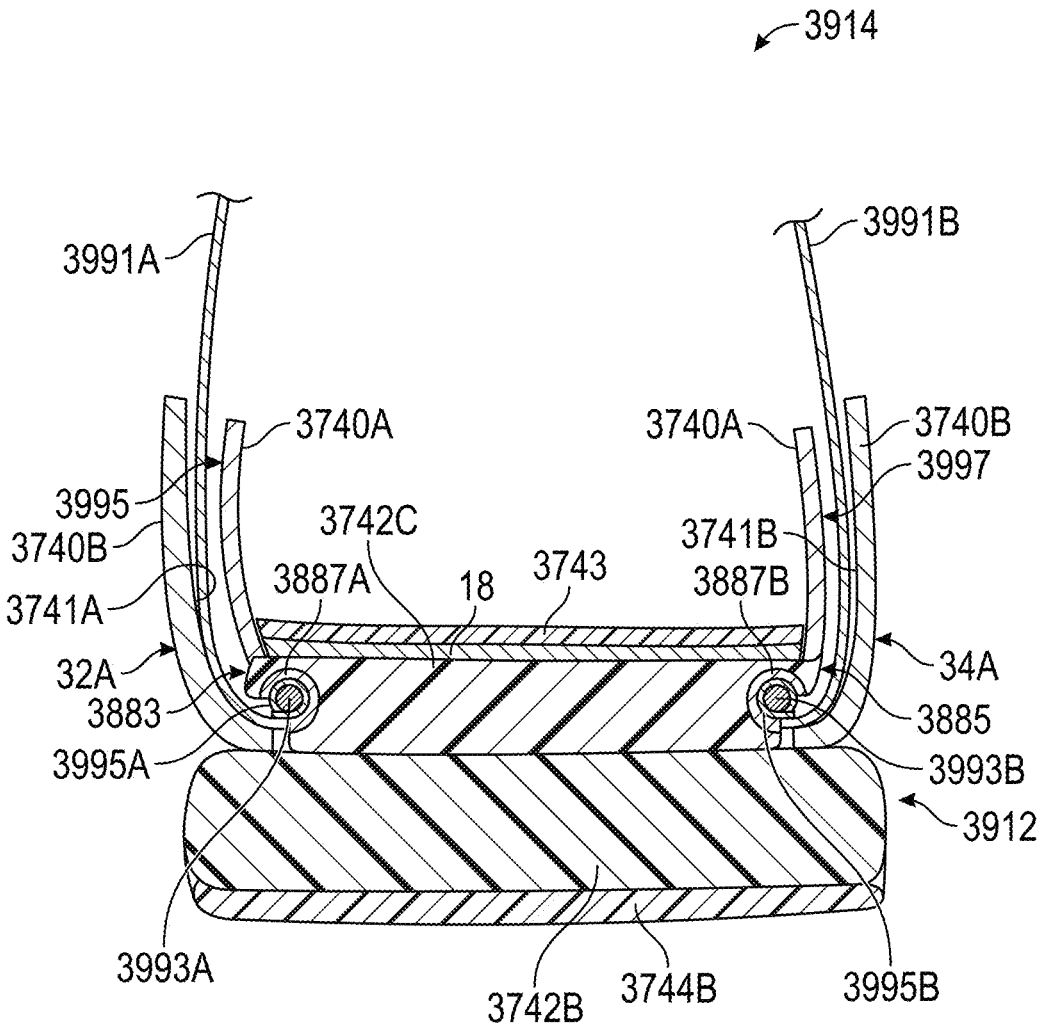
FIG. 66 is a cross-sectional view of the article of footwear of FIG. 65 taken at lines 66-66 in FIG. 65.

FIG. 65 is a lateral perspective view of an article of footwear 3914 identical to the article of footwear 3814 except that the sole structure 3712 is replaced with an identical sole structure 3912 with the addition of straps 3991A and 3991B having magnets 3993A, 3993B (or magnetic material), respectively, secured thereon and received through the openings 3881A, 3881B to be disposed in the recesses 3877A, 3877B (openings 3881A, 3881B and recesses 3877A, 3877B best shown in FIG. 64), respectively, and secured to the magnets or magnetic material 3887A, 3887B housed therein, as best shown in the cross-sectional view of FIG. 66. Each of the magnets 3993A, 3993B (or magnetic material) is shown secured within a retainer 3995A, 3995B, respectively that is in turn adhered to the respective strap 3991A, 3991B by adhesive, stitching, or otherwise, similar to the retainer 3495B and the strap 3491B of FIG. 56.

The magnets 3993A, 3993B (or magnetic material) including the retainers 3995A, 3995B, respectively, are generally cylindrical, and thus are shaped to be received in the respective recess 3877A, 3877B. Accordingly, when the magnets 3993A, 3993B (or magnetic material) are received in the recesses 3877A, 3877B, the magnetic connection between the magnets 3887A, 3887B (or magnetic material) housed in the recesses 3877A, 3877B and the magnets 3993A, 3993B (or magnetic material) secured to the straps 3991A, 3991B operatively connects the straps 3991A, 3991B to the heel footbed 3742C.

As shown in FIG. 66, the straps 3991A, 3991B are disposed at least partially between the heel footbed 3742C and an inner side of the rear footwear upper 3740B when the sole structure 3912 is in the use position. Specifically, the strap 3991A is between the medial inner side 3741A of the rear footwear upper 3740B and the medial side surface 3883 of the heel footbed 3742C, and the strap 3991B is between the lateral inner side 3741B of the rear footwear upper 3740B and the exterior lateral side surface 3885 of the heel footbed 3742C.

The straps 3991A, 3991B are also disposed between the inner side of the rear footwear upper 3740B and the outer side of the front footwear upper 3740A where they overlap at the medial and lateral sides 32A, 34A in the use position. Specifically, the strap 3991A is between the medial inner side 3741A of the rear footwear upper 3740B and the medial outer side surface 3995 of the front footwear upper 3740A, and the strap 3991B is between the lateral inner side 3741B of the rear footwear upper 3740B and the lateral outer side surface 3997 of the front footwear upper 3740A. This helps further secure the straps 3991A, 3991B and the magnets 3993A, 3993B (or magnetic material) secured to the straps 3991A, 3991B to the magnets 3887A, 3887B (or magnetic material) housed in the recesses 3877A, 3877B when the sole structure 3912 is in the use position.

Additionally, the downward and outward orientation of the openings 3881A and 3881B further helps to trap the straps 3991A, 3991B and the magnets 3993A, 3993B (or magnetic material) secured to the straps 3991A, 3991B slightly under at least a portion of the heel footbed 3742C, which will help to further secure their positions when the weight of the wearer is on the heel footbed 3742C.

An upward force applied to either or both of the straps 3991A, 3991B will cause the heel footbed 3742C and the footwear plate 18 secured thereto to apply an upward force to the wearer's sole rearward of the ankle joint. This force on either or both of the straps 3991A, 3991B may hold a heel region 27 of the sole structure 3912 that includes the heel portion 22 of the footwear plate 18 and the heel footbed 3742C against the wearer's sole, and may counteract any tendency of the heel portion 22 to move away from the wearer's sole when an upward force is applied at the joint connector 70A forward of the ankle.

The following Clauses provide example configurations of an article of footwear disclosed herein.

Clause 1. A device for an article of footwear comprising: a frame including: a footwear plate configured to extend at least partially along and under a sole of a wearer's foot; and an arced shield integral with the footwear plate and configured to extend transversely from the footwear plate at least partially over a superior portion of the wearer's foot.

Clause 2. The device of clause 1, wherein the arced shield and the footwear plate are a unitary, one-piece structure.

Clause 3. The device of any of clauses 1-2, wherein the frame comprises a carbon fiber composite material.

Clause 4. The device of any of clauses 1-3, wherein the frame has a compressive rigidity of a predetermined numerical value or within a predetermined range of numerical values.

Clause 5. The device of any of clauses 1-4, wherein the frame is sufficiently rigid to prevent flexing of the arced shield relative to the footwear plate upon receiving a force not greater than a predetermined force on the arced shield.

Clause 6. The device of any of clauses 1-6, further comprising: a joint connector operatively connected to and/or secured at a superior surface of the arced shield.

Clause 7. The device of clause 6, wherein the arced shield is configured to extend along an interior surface of a vamp of a footwear upper, and the joint connector comprises a textile secured at an exterior surface of the vamp of the footwear upper.

Clause 8. The device of clause 7, wherein the textile is configured to be pivotable relative to the exterior surface of the footwear upper at least about two perpendicular axes.

Clause 9. The device of clause 7, wherein the joint connector further comprises a magnet or magnetic material operatively secured to the textile.

Clause 10. The device of clause 6, wherein the joint connector is configured to function as a portion of a ball joint.

Clause 11. The device of any of clauses 1-10, wherein arced shield extends over a forefoot portion of the footwear plate.

Clause 12. The device of any of clauses 1-11, wherein the footwear plate is configured to extend only in a forefoot region of the article of footwear.

Clause 13. The device of any of clauses 1-10, wherein the footwear plate is configured to extend only in a forefoot region and a midfoot region of the article of footwear.

Clause 14. The device of any of clauses 1-10, wherein the footwear plate is configured to extend in a forefoot region, a midfoot region, and a heel region of the article of footwear.

Clause 15. The device of any of clauses 1-14, wherein the arced shield extends transversely over the footwear plate from a lateral portion of the footwear plate to a medial portion of the footwear plate.

Clause 16. The device of any of clauses 1-15, wherein the arced shield has an anterior edge and a posterior edge, and the anterior edge is nearer to a superior surface of the footwear plate than is the posterior edge such that a superior surface of the arced shield has a downward and forward pitch from the posterior edge to the anterior edge.

Clause 17. The device of any of clauses 1-16, wherein the joint connector is positioned anterior to an ankle opening of the article of footwear to transfer an external force to the frame to augment plantar flexion of the wearer's foot.

Clause 18. The device of any of clauses 1-17, wherein the joint connector is positioned at a portion of the arced shield that is over the superior portion of a wearer's foot for operative connection to an exoskeleton.

Clause 19. A sole structure for an article of footwear comprising: a frame including: a footwear plate configured to extend at least partially along and under a sole of a wearer's foot; and an arced shield integral with the footwear plate and configured to extend transversely from the footwear plate at least partially over a superior portion of the wearer's foot.

Clause 20. The sole structure of clause 19, further comprising: a midsole layer; and wherein the footwear plate extends at least partially over the midsole layer.

Clause 21. The sole structure of clause 19 in combination with the frame of any of clauses 2-18.

Clause 22. An article of footwear comprising: a frame including: a footwear plate configured to extend at least partially along and under a sole of a wearer's foot; and an arced shield integral with the footwear plate and configured to extend transversely from the footwear plate at least partially over a superior portion of the wearer's foot.

Clause 23. The article of footwear of clause 22, further comprising: a footwear upper; wherein the arced shield extends along an interior surface of a vamp of a footwear upper.

Clause 24. The article of footwear of clause 23, further comprising: a joint connector operatively connected to and/or secured at an exterior surface of the vamp of the footwear upper.

Clause 25. The article of footwear of clause 24, wherein the joint connector comprises a textile secured at an exterior surface of the vamp of the footwear upper.

Clause 26. The article of footwear of clause 22 in combination with the frame of any of clauses 2-18 and/or in combination with the sole structure of any of clauses 19-20.

Clause 27. A device for an article of footwear comprising: a frame including: a footwear plate configured to extend at least partially along and under a sole of a wearer's foot; and an arced shield integral with the footwear plate and configured to extend/transversely from the footwear plate at least partially over a superior portion of the wearer's foot from a medial portion of the footwear plate to a lateral portion of the footwear plate; wherein an anterior extent of the arced shield at the medial portion of the footwear plate is further forward or further rearward than an anterior extent of the arced shield at the lateral portion of the footwear plate such that an anterior edge of the arced shield angles rearward or forward, respectively, from the medial portion of the footwear plate to the lateral portion of the footwear plate.

Clause 28. The device of clause 27, wherein a posterior edge of the arced shield angles rearward or forward, respectively, from the medial portion of the footwear plate to the lateral portion of the footwear plate.

Clause 29. The device of clause 27, wherein the anterior extent of the arced shield at the medial portion of the footwear plate is at one of a forefoot portion or a midfoot portion of the footwear plate and the anterior extent of the arced shield at the lateral portion of the footwear plate is at the other one of the forefoot portion or the midfoot portion of the footwear plate.

Clause 30. The device of clause 27 and further according to any of clauses 2-19.

Clause 31. A sole structure including the device of any of clauses 27-30.

Clause 32. An article of footwear in combination with the device of any of clauses 27-30, and/or in combination with the sole structure of clause 31.

Clause 33. A device for an article of footwear comprising: a frame including: a footwear plate configured to extend at least partially along and under a sole of a wearer's foot; and an arced shield integral with the footwear plate and configured to extend transversely from the footwear plate at least partially over a superior portion of the wearer's foot from one of a medial portion or a lateral portion of the footwear plate to a terminal end disposed above a superior surface of the footwear plate.

Clause 34. The device of clause 33, wherein the arced shield extends from a medial side and/or a medial edge of the footwear plate and does not extend to a lateral side and/or a lateral edge of the footwear plate.

Clause 35. The device of clause 33, wherein the arced shield extends from a lateral side and/or a lateral edge of the footwear plate and does not extend to a medial side and/or a medial edge of the footwear plate.

Clause 36. The device of any of clauses 33-35, further comprising: a joint connector operatively connected to and/or secured at a superior surface of the arced shield.

Clause 37. The device of any of clauses 33-36, wherein the arced shield extends partially over an exterior surface of a vamp of a footwear upper.

Clause 38. The device of clause 33 and further according to any of clauses 2-19.

Clause 39. A sole structure including the device of any of clauses 33-37.

Clause 40. An article of footwear in combination with the device of any of clauses 33-37, and/or in combination with the sole structure of clause 38.

Clause 41. A device for an article of footwear comprising: a frame including: a footwear plate configured to extend at least partially along a sole of a wearer's foot; a first arced shield integral with the footwear plate and configured to extend transversely from the footwear plate at least partially over a superior portion of the wearer's foot; and a second arced shield integral with the footwear plate and configured to extend transversely from the footwear plate at least partially over the superior portion of the wearer's foot.

Clause 42. The device of clause 41, wherein the first arced shield is disposed at least partially over a forefoot portion of the footwear plate forward of the second arced shield.

Clause 43. The device of clause 42, wherein the second arced shield is disposed at least partially over a midfoot portion of the footwear plate.

Clause 44. The device of any of clauses 41-43, further comprising: a first joint connector operatively connected to and/or secured at a superior surface of the first arced shield; and a second joint connector operatively connected to and/or secured at a superior surface of the second arced shield.

Clause 45. The device of any of clauses 41-43, wherein the frame further includes a bridge integrally connecting the first arced shield and the second arced shield; and the device further comprising: a joint connector operatively connected to and/or secured at a superior surface of the bridge.

Clause 46. The device of clause 41 and further according to any of clauses 2-19.

Clause 47. A sole structure including the device of any of clauses 41-46.

Clause 48. An article of footwear in combination with the device of any of clauses 41-46, and/or in combination with the sole structure of clause 47.

Clause 49. A sole structure for an article of footwear comprising: a frame including a footwear plate configured to extend at least partially along and under a sole of a wearer's foot; a joint connector operatively connected to and/or secured at the frame; and a midsole; wherein the midsole includes a front midsole component and a rear midsole component pivotable relative to one another between a use position and an access position at a pivot axis extending transversely across a midfoot region of the sole structure, with the sole structure lifted at the pivot axis in the access position; and wherein the footwear plate extends at least partially along the front midsole component.

Clause 50. The sole structure of clause 49, wherein the footwear plate extends only in a forefoot region of the sole structure and/or only forward of the pivot axis.

Clause 51. The sole structure of any of clauses 49-50, wherein the front midsole component includes a heel footbed that overlays the rear midsole component in the use position and is spaced apart from the rear midsole component in the access position; and wherein the footwear plate further extends along the heel footbed rearward of the pivot axis.

Clause 52. The sole structure of any of clauses 49-51 including the device of any of clauses 2-11 and 15-18.

Clause 53. An article of footwear in combination with the sole structure of any of clauses 49-52.

Clause 54. A device for an article of footwear comprising: a frame including a footwear plate configured to extend at least partially along and under a sole of a wearer's foot; wherein the footwear plate includes a matrix structure defining a plurality of open cells; and a joint connector operatively connected to and/or secured at the frame.

Clause 55. The device of clause 54, wherein the frame includes an arced shield integral with the footwear plate and configured to extend from the footwear plate at least partially over a superior portion of the wearer's foot.

Clause 56. The device of clause 55, wherein the joint connector is operatively connected to a superior surface of the arced shield.

Clause 57. The device of any of clauses 54-56, wherein at least some of the cells are polygonal.

Clause 58. The device of clause 57, wherein at least some of the cells are hexagonal.

Clause 59. The device of any of clauses 54-58, wherein a height of the footwear plate, a thickness of the footwear plate between adjacent ones of the open cells, and/or a shape of the open cells is configured to provide a predetermined stiffness profile of the footwear plate.

Clause 60. The device of clause 54 and further according to any of clauses 2-19.

Clause 61. A sole structure including the device of any of clauses 54-60.

Clause 62. An article of footwear in combination with the device of any of clauses 54-60, and/or in combination with the sole structure of clause 61.

Clause 63. A device for an article of footwear comprising: a frame including: a footwear plate configured to extend at least partially along and under a sole of a wearer's foot; and an arced shield selectively attachable to and detachable from the footwear plate and configured to extend transversely from the footwear plate at least partially over a superior portion of the wearer's foot from a medial portion of the footwear plate to a lateral portion of the footwear plate when attached to the footwear plate.

Clause 64. The device of clause 63, wherein the arced shield is configured to extend over an exterior surface of a vamp of a footwear upper when attached to the footwear plate.

Clause 65. The device of any of clauses 63-64, further comprising: a joint connector operatively connected to and/or secured at a superior surface of the arced shield.

Clause 66. The device of any of clauses 63-65, wherein one of the footwear plate and the arced shield includes a slot and the other of the footwear plate and the arced shield includes a tab configured to be received in the slot to attach the arced shield to the footwear plate.

Clause 67. The device of clause 63 and further according to any of clauses 3-19.

Clause 68. A sole structure including the device of any of clauses 63-67.

Clause 69. An article of footwear in combination with the device of any of clauses 63-67, and/or in combination with the sole structure of clause 68.

Clause 70. A sole structure for an article of footwear comprising: a frame including a footwear plate configured to extend at least partially along and under a sole of a wearer's foot; a joint connector operatively connected to and/or secured at the frame; a midsole; wherein the footwear plate extends at least partially along the midsole; wherein the midsole defines a recess at a surface of the midsole; and a magnet or magnetic material housed in the recess.

Clause 71. The sole structure of clause 70, wherein: the midsole includes a front midsole component and a rear midsole component pivotable relative to one another between a use position and an access position at a pivot axis extending transversely across a midfoot region of the sole structure, with the sole structure lifted at the pivot axis in the access position; the front midsole component includes a heel footbed that overlays the rear midsole component in the use position and is spaced apart from the rear midsole component in the access position; and the surface of the midsole at which the midsole defines the recess is a surface of the heel footbed.

Clause 72. The sole structure of any of clauses 70-71, wherein: the recess is a first recess, the surface of the midsole includes a medial side surface, and the magnet or magnetic material is a first magnet or a first magnetic material; the surface of the midsole includes a lateral side surface and defines a second recess at least partially at the lateral side surface; and the sole structure further comprising: a second magnet or second magnetic material housed in the second recess.

Clause 73. The sole structure of any of clauses 70-72, wherein the recess has a partially cylindrical shape.

Clause 74. The sole structure of any of clauses 70-73, wherein the surface of the midsole at which the midsole defines a recess is at an exterior side wall of the midsole.

Clause 75. The sole structure of any of clauses 70-74, further comprising: a strap; and an additional magnet or magnetic material secured to the strap and configured to attract the magnet or magnetic material housed in the recess; wherein the additional magnet or magnetic material secured to the strap is shaped to be received in the recess.

Clause 76. The sole structure of any of clauses 70-75 including the device of any of clauses 2-19.

Clause 77. An article of footwear in combination with the sole structure of any of clauses 70-76.

Clause 78. A sole structure for an article of footwear comprising: a frame including a footwear plate configured to extend at least partially along and under a sole of a wearer's foot; a joint connector operatively connected to and/or secured at the frame; a midsole including a front midsole component and a rear midsole component pivotable relative to one another between a use position and an access position at a pivot axis extending transversely across a midfoot region of the sole structure, with the sole structure lifted at the pivot axis in the access position; wherein the footwear plate extends at least partially along the front midsole component; wherein the front midsole component includes a heel footbed that overlays the rear midsole component in the use position and is spaced apart from the rear midsole component in the access position; wherein a surface of the heel footbed defines a recess; and a magnet or magnetic material housed in the recess.

Clause 79. The sole structure of clause 78, wherein: the recess is a first recess, the surface of the heel footbed defining the recess includes a medial side surface, and the magnet or magnetic material is a first magnet or a first magnet material; and the surface of the heel footbed includes a lateral side surface that defines a second recess; and the sole structure further comprising: a second magnet or second magnetic material housed in the second recess.

Clause 80. The sole structure of any of clauses 78-79, wherein the recess has a partially cylindrical shape.

Clause 81. The sole structure of any of clauses 78-80, further comprising: a strap; and an additional magnet or magnetic material secured to the strap and configured to attract the magnet or magnetic material housed in the recess; wherein the additional magnet or magnetic material secured to the strap is shaped to be received in the recess.

Clause 82. The sole structure of any of clauses 78-81 including the device of any of clauses 2-19.

Clause 83. An article of footwear in combination with the sole structure of any of clauses 78-82.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A device for an article of footwear comprising:

a frame including:

a footwear plate configured to extend at least partially along and under a sole of a wearer's foot;

an arced shield integral with the footwear plate and configured to extend transversely from the footwear plate at least partially over a superior portion of the wearer's foot; and a joint connector operatively connected to and/or secured at a superior surface of the arced shield.

2. The device of claim 1, wherein the arced shield and the footwear plate are a unitary, one-piece structure.

3. The device of claim 1, wherein the frame is sufficiently rigid to prevent flexing of the arced shield relative to the footwear plate upon receiving a force not greater than a predetermined force on the arced shield.

4. The device of claim 1, wherein the arced shield is configured to extend along an interior surface of a vamp of a footwear upper, and the joint connector comprises a textile secured at an exterior surface of the vamp of the footwear upper.

5. The device of claim 4, wherein the textile is configured to be pivotable relative to the exterior surface of the footwear upper at least about two perpendicular axes.

6. The device of claim 4, wherein the joint connector further comprises a magnet or magnetic material operatively secured to the textile.

7. The device of claim 1, wherein the joint connector is configured as a portion of a ball joint.

8. The device of claim 1, wherein the joint connector is positioned anterior to an ankle opening of the article of footwear to transfer an external force to the frame to augment plantar flexion of the wearer's foot.

9. The device of claim 1, wherein the joint connector is positioned at a portion of the arced shield that is over the superior portion of a wearer's foot for operative connection to an exoskeleton.

10. The device of claim 1, wherein the footwear plate is configured to extend in a forefoot region, a midfoot region, and a heel region of the article of footwear.

11. The device of claim 1, wherein the arced shield extends transversely over the footwear plate from a lateral portion of the footwear plate to a medial portion of the footwear plate.

12. The device of claim 1, wherein the arced shield has an anterior edge and a posterior edge, and the anterior edge is nearer to a superior surface of the footwear plate than is the posterior edge such that the superior surface of the arced shield has a downward and forward pitch from the posterior edge to the anterior edge.

13. The device of claim 1, wherein the joint connector is at least partially above the superior surface of the arced shield.

14. The device of claim 1, wherein the joint connector is at least partially outward of the superior surface of the arced shield.

15. A sole structure for an article of footwear comprising:

a frame including a footwear plate configured to extend at least partially along and under a sole of a wearer's foot;

a joint connector operatively connected to and/or secured at the frame;

a midsole including a front midsole component and a rear midsole component pivotable relative to one another between a use position and an access position at a pivot axis extending transversely across a midfoot region of the sole structure, with the sole structure lifted at the pivot axis in the access position;

wherein the footwear plate extends at least partially along the front midsole component;

wherein the front midsole component includes a heel footbed that overlays the rear midsole component in the use position and is spaced apart from the rear midsole component in the access position;

wherein a surface of the heel footbed defines a recess; and a magnet or magnetic material housed in the recess.

16. The sole structure of claim 15, wherein:

the recess is a first recess, the surface of the heel footbed defining the recess includes a medial side surface, and the magnet or magnetic material is a first magnet or a first magnet material; and the surface of the heel footbed includes a lateral side surface that defines a second recess; and the sole structure further comprising:

a second magnet or second magnetic material housed in the second recess.

17. The sole structure of claim 15, wherein the recess has a partially cylindrical shape.

18. The sole structure of claim 15, further comprising:

a strap; and an additional magnet or magnetic material secured to the strap and configured to attract the magnet or magnetic material housed in the recess;

wherein the additional magnet or magnetic material secured to the strap is shaped to be received in the recess.

* * * * *